US008015760B2

(12) United States Patent
Kemeny

(10) Patent No.: US 8,015,760 B2
(45) **Date of Patent: *Sep. 13, 2011**

(54) SEISMIC ISOLATION ACCESS FLOOR ASSEMBLY

(76) Inventor: Zoltan Kemeny, Tempe, AZ (US)

( * ) Notice: Subject to any disclaimer, the term of this patent is extended or adjusted under 35 U.S.C. 154(b) by 1022 days.

This patent is subject to a terminal disclaimer.

(21) Appl. No.: 11/756,295

(22) Filed: May 31, 2007

(65) Prior Publication Data

US 2007/0220815 A1 Sep. 27, 2007

Related U.S. Application Data

(63) Continuation-in-part of application No. 11/208,584, filed on Aug. 22, 2005, now Pat. No. 7,290,375.

(60) Provisional application No. 60/651,976, filed on Feb. 14, 2005.

(51) Int. Cl.
*E04B 1/98* (2006.01)
*E04H 9/02* (2006.01)

(52) U.S. Cl. ..... 52/167.4; 52/167.7; 52/167.8; 52/385; 248/580

(58) Field of Classification Search ..... 52/167.1, 52/167.4, 167.5, 167.6, 167.7, 167.8, 167.9, 52/384–387, 390–392; 248/580
See application file for complete search history.

(56) References Cited

U.S. PATENT DOCUMENTS

| | | | | |
|---|---|---|---|---|
| 99,973 | A | 2/1870 | Touaillon | |
| 2,014,643 | A * | 9/1935 | Bakker | 384/49 |
| 5,452,548 | A * | 9/1995 | Kwon | 52/167.8 |
| 5,452,549 | A * | 9/1995 | Medeot et al. | 52/167.8 |
| 5,816,559 | A * | 10/1998 | Fujimoto | 248/636 |
| 5,913,503 | A | 6/1999 | Satoh et al. | |
| 6,123,313 | A * | 9/2000 | Otsuka et al. | 248/580 |
| 6,324,795 | B1 * | 12/2001 | Stiles et al. | 52/167.4 |
| 6,631,593 | B2 * | 10/2003 | Kim | 52/167.9 |
| 7,290,375 | B2 * | 11/2007 | Kemeny | 52/167.1 |
| 2004/0262487 | A1 * | 12/2004 | Kawashima et al. | 248/638 |
| 2005/0241245 | A1 | 11/2005 | Tsai | |

FOREIGN PATENT DOCUMENTS

| | | | |
|---|---|---|---|
| JP | 09248223 | A * | 9/1997 |
| JP | 2010230057 | A * | 10/2010 |

* cited by examiner

*Primary Examiner* — Jeanette E. Chapman
(74) *Attorney, Agent, or Firm* — Parsons & Goltry; Michael W. Goltry; Robert A. Parsons

(57) ABSTRACT

An access floor assembly includes a base floor, a substructure mounted to the base floor, a bearing plate, formed with a first cavity, mounted to the substructure and disposed apart from the base floor, an isolator plate, formed with a second cavity, overlying the bearing plate, a ball disposed between the bearing plate and the isolator plate contacting the first and second cavities, and a floor plate coupled to the isolator plate and together forming an access floor disposed at an elevated location relative to the base floor.

5 Claims, 46 Drawing Sheets

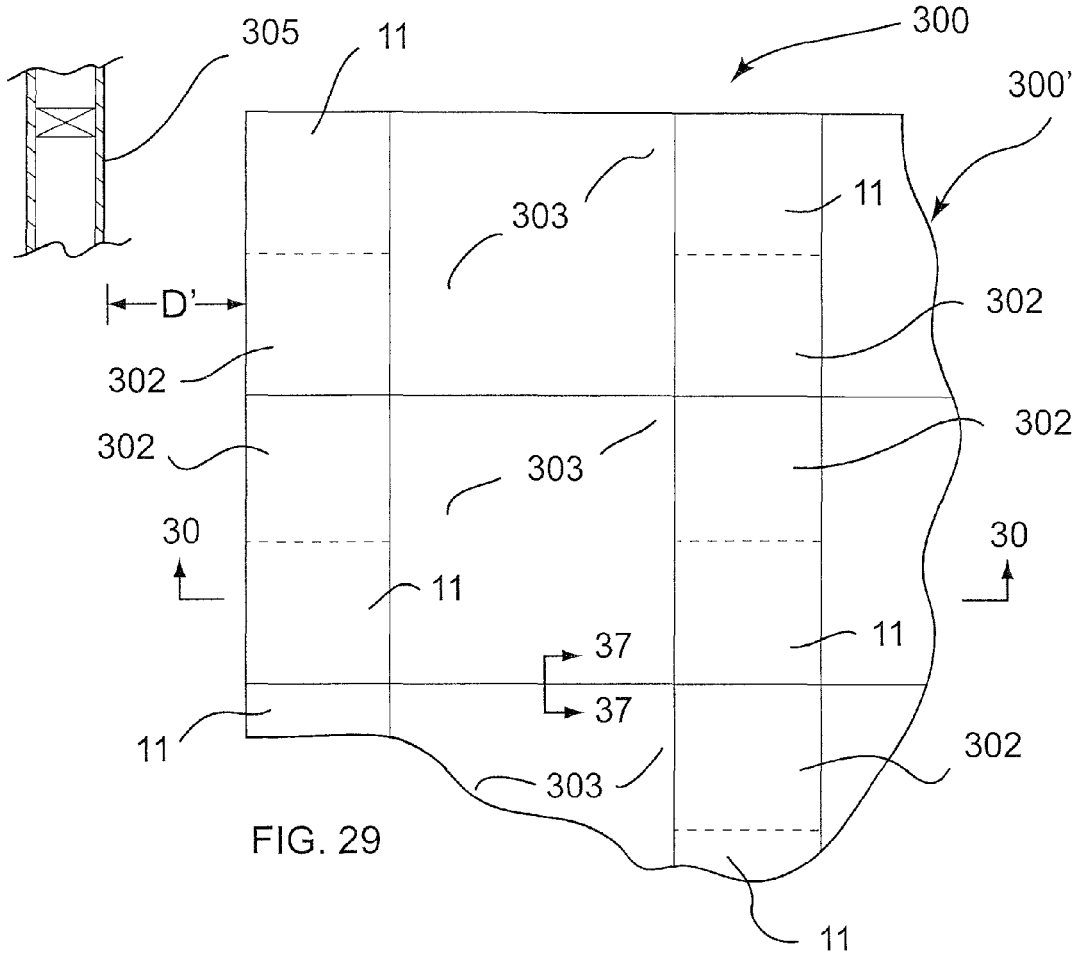
FIG. 29
FIG. 30
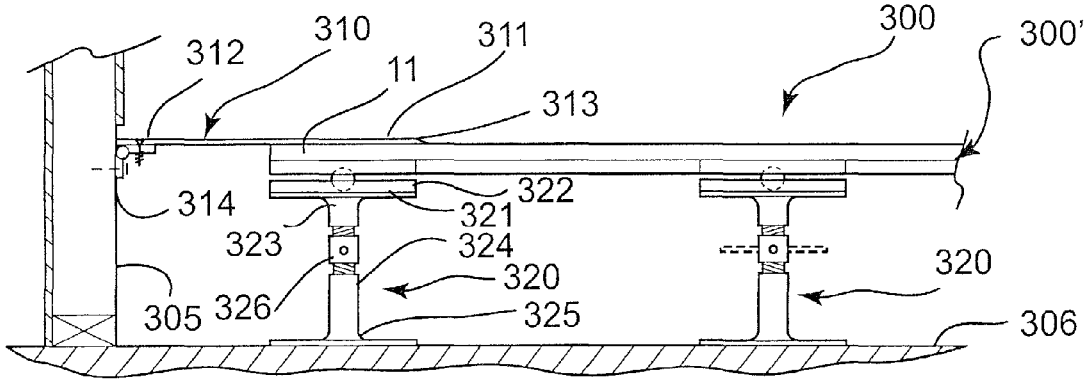

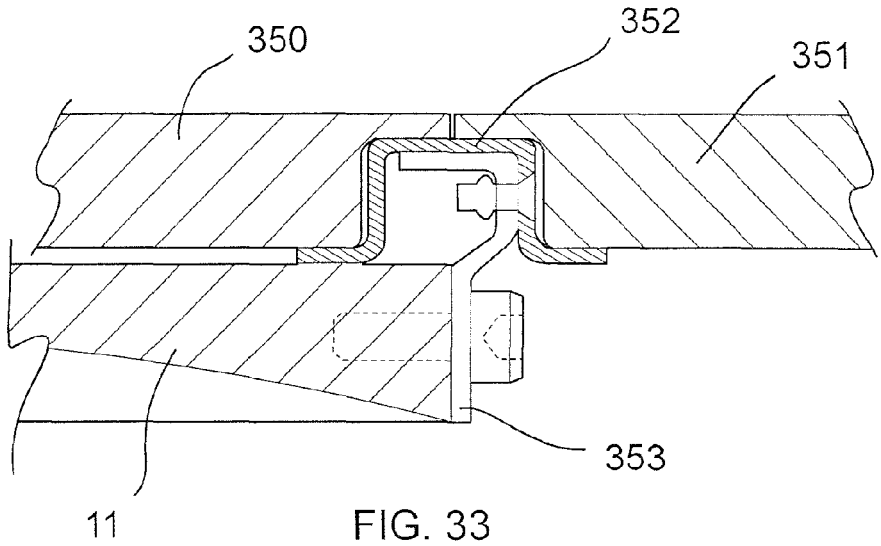
FIG. 33
FIG. 34
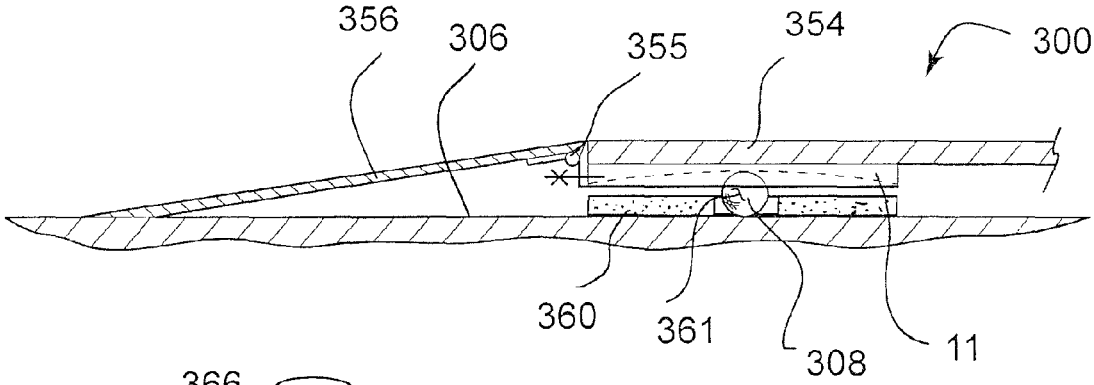
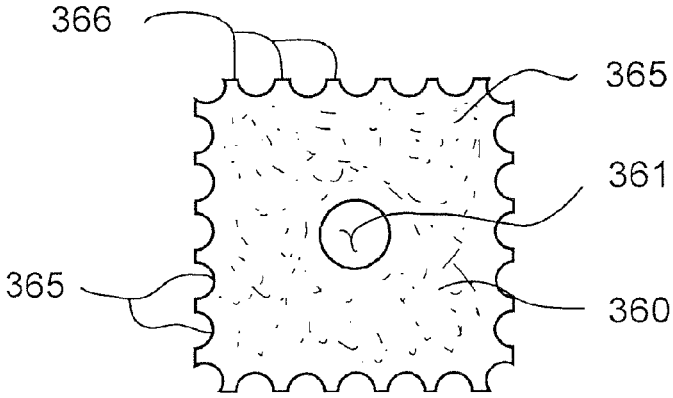
FIG. 34A 1100
11
1111
1111A
1103
1103A
1103B
1105
1101
1110
1112
1104

SEISMIC ISOLATION ACCESS FLOOR ASSEMBLY

CROSS-REFERENCE TO RELATED APPLICATION

This application is a continuation-in-part of U.S. patent application Ser. No. 11/208,584 filed 22 Aug. 2005, which in turn claims the benefit of U.S. Provisional Application Ser. No. 60/651,976, filed 14 Feb. 2005.

FIELD OF THE INVENTION

The present invention relates to raised access floors and, more particularly, to raised access floors with seismic isolation capabilities.

BACKGROUND OF THE INVENTION

Access floors are raised above base floors typically fashioned of concrete, and provide access for cables, pipes, ducts and other utility or supply lines, equipment, and equipment hookups. Access floors are normally made of large, lightweight floor plates supported by a supporting substructure positioned on the base floor. Typical substructures incorporate pedestals and/or stringers. In most instances the pedestals of known substructures are braced to the base floor and/or to each other, which transfers lateral loads between the floor plates and stringers and the base floor. Lateral loads can originate above the access floor in some instances, such as from the rolling resistance of equipment moving thereacross. Seismic load is mainly a lateral load, which originates on the base floor and is transmitted to the access floor through the substructure supporting it above the base floor, and further to equipment resting on the access floor.

Existing raised access floors and their associated supporting substructures prove adequate, but it has been noticed that known raised access floors actually amplify base floor accelerations, which often results in damage to equipment and fixtures positioned thereon, such as server racks, main frame computers, electronics cabinets, semiconductor tools and manufacturing equipment, etc., which is obviously problematic, especially when such access floors are installed in geographical areas prone to seismic activity. Although there has long been a need in the art to provide a seismically-isolated raised access floor, none that is practical and economically feasible has yet been introduced to the art. Although some skilled artisans have attempted to isolate access floors by mounting the understructure over heavy-duty steel or aluminum or sheet metal framing of beams and columns and large seismic isolators, this structure not only does not satisfactorily provide the desired seismic isolation, but also encroaches into most of the usable access space and is complicated to build and install, expensive, and imposes large punching shear on the concrete floor, and thus proving to be unworkable and impracticable in the marketplace.

SUMMARY OF THE INVENTION

According to the invention, there is provided a seismic isolation access floor assembly including a base floor, a bearing plate coupled to the base floor, an isolator plate overlying the bearing plate, and a ball disposed between and contacting the bearing plate and the isolator plate. A floor plate is coupled to the isolator plate and together with the isolator plate forms an access floor disposed at an elevated location relative to the base floor. In a particular embodiment, there is a frame coupled to the isolator plate, and which is capable of receiving and supporting a floor plate, in which in a particular embodiment there is a floor plate supported by the frame. Further to the present invention is a substructure mounted to the base floor, and the bearing plate is mounted to the substructure and disposed at an elevated location relative to the base floor. The substructure consists of at least one upstanding pedestal having an end coupled to the base floor and an opposing end coupled to the bearing plate. The pedestal is adjustable between shortened and lengthened conditions. A first cavity is formed into the bearing plate, a second cavity is formed into the isolator plate, the first cavity confronts the second cavity, and the ball contacts first and second cavities. Preferably, the first and second cavities are each concave.

According to the principle of the invention, there is provided a seismic isolation access floor assembly including a base floor, a bearing plate coupled to the base floor, an isolator plate overlying the bearing plate, a ball disposed between and contacting the bearing plate and the isolator plate, and a first floor plate coupled to the isolator plate and together forming an access floor disposed at an elevated location relative to the base floor. Further to the present embodiment is a frame coupled to the isolator plate, and the first floor plate supported by the frame. A floor plate receiving frame is coupled to the isolator plate, a second floor plate is supported by the floor plate receiving frame. A substructure is mounted to the base floor, and the bearing plate is mounted to the substructure and is disposed at an elevated location relative to the base floor. The substructure includes at least one upstanding pedestal having an end coupled to the base floor and an opposing end coupled to the bearing plate. The pedestal is adjustable between shortened and lengthened conditions. A first cavity formed into the bearing plate, a second cavity formed into the isolator plate, the first cavity confronting the second cavity, and the ball contacts the first and second cavities. The first and second cavities are each concave.

According to the invention, there is provided an assembly of attached isolator plates and floor plates together forming an access floor disposed at an elevated location relative to a base floor, in which each of the isolator plates overlies a bearing plate coupled to a base floor and which is formed with a first cavity contacting a ball disposed on an opposed second cavity formed in the bearing plate. The bearing plate associated with each of the isolator plates is mounted to a substructure coupled to the base floor, in which the substructure consists of at least one pedestal. The pedestal is adjustable between shortened and lengthened conditions, and the first and second cavities are each preferably concave. In a particular embodiment, a frame attached to at least one of the isolator plates, and one of the floor plates is supported by the frame.

According to the invention, there is provided a base floor, a base floor, an isolator plate overlying the base floor, and a ball disposed between and contacting the base floor and the isolator plate. A floor plate is coupled to the isolator plate together forming an access floor disposed at an elevated location relative to the base floor. A frame is coupled to the isolator plate and is capable of receiving and supporting a floor plate. In a particular embodiment a floor plate is supported by the frame.

According to the invention, there is provided a base floor, A bearing plate coupled to the base floor, an isolator plate overlying the bearing plate, a ball disposed between and contacting the bearing plate and the isolator plate, a first floor plate coupled to the isolator plate and together forming an access floor disposed at an elevated location relative to the base floor, a structure spaced from the access floor, and an expansion joint plate coupled between the wall and the structure, whereby the access floor is capable of displacing relative to the expansion joint plate. The expansion joint plate includes a first end disposed adjacent to the structure and a second end positioned atop the access floor. The first end of the expansion joint plate is hinged permitting pivotal displacement of the expansion joint plate. A substructure is mounted to the base floor, and the bearing plate is mounted to the substructure and disposed at an elevated location relative to the base floor. The substructure includes at least one upstanding pedestal having an end coupled to the base floor and an opposing end coupled to the bearing plate. The pedestal is adjustable between shortened and lengthened conditions. A first cavity is formed into the bearing plate, a second cavity is formed into the isolator plate; the first cavity confronts the second cavity, and the ball contacts the first and second cavities. Preferably, the first cavity is concave, as is the second cavity. In one embodiment, the structure is a wall. In another embodiment, the structure is a floor.

According to the invention, there is provided a base floor, an isolator plate seismically isolated over the base floor, and a ramp coupled between the access floor and the base floor. A ball is coupled between the isolator plate and the base floor seismically isolating the isolator plate relative to the base floor. In another embodiment, a bearing plate is coupled to the base floor, the isolator plate overlies the bearing plate, and a ball is disposed between and contacting the bearing plate and the isolator plate seismically isolating the isolator plate relative to the base floor. A floor plate is coupled to the isolator plate together forming an access floor disposed at an elevated location relative to the base floor.

Consistent with the foregoing summary of preferred embodiments and the ensuing disclosure of the invention, which are to be taken together as the disclosure of the invention, the invention also contemplates other apparatus and method embodiments.

BRIEF DESCRIPTION OF THE DRAWINGS

Referring to the drawings:

FIG. 29 is a top plan view of a seismic isolation access floor assembly constructed and arranged in accordance with a further alternate embodiment of the invention;

FIG. 30 is a sectional view taken along line 30-30 of FIG. 29;

FIG. 33 is a vertical sectional view of an isolator plate of the seismic isolation access floor assembly of FIG. 29 illustrating floor plates set thereon and secured together with a bracket, which is in turn affixed to the isolator plate with another bracket;

FIG. 34 is a fragmented vertical sectional view of a ramp shown attached to the outer extremity of the seismic isolation access floor assembly of FIG. 29 shown as it would appear mounted to a base floor, including a retainer positioned on the base floor retaining a ball between the base floor and an isolator plate of the seismic isolation access floor assembly;

FIG. 34A is a top plan view of a retainer of FIG. 34;

DETAILED DESCRIPTION OF PREFERRED EMBODIMENTS

Seismic isolation access floor assemblies are disclosed, which incorporate an access floor consisting of an assemblage of plates including seismically isolated plates assembled in conjunction with floor plates and which are low in cost, which are safe, in which the isolator plates each are inexpensively and efficiently seismically isolated to a base floor and that when displaced are able to restore themselves to their original positions efficiently and automatically.

Figure 1:
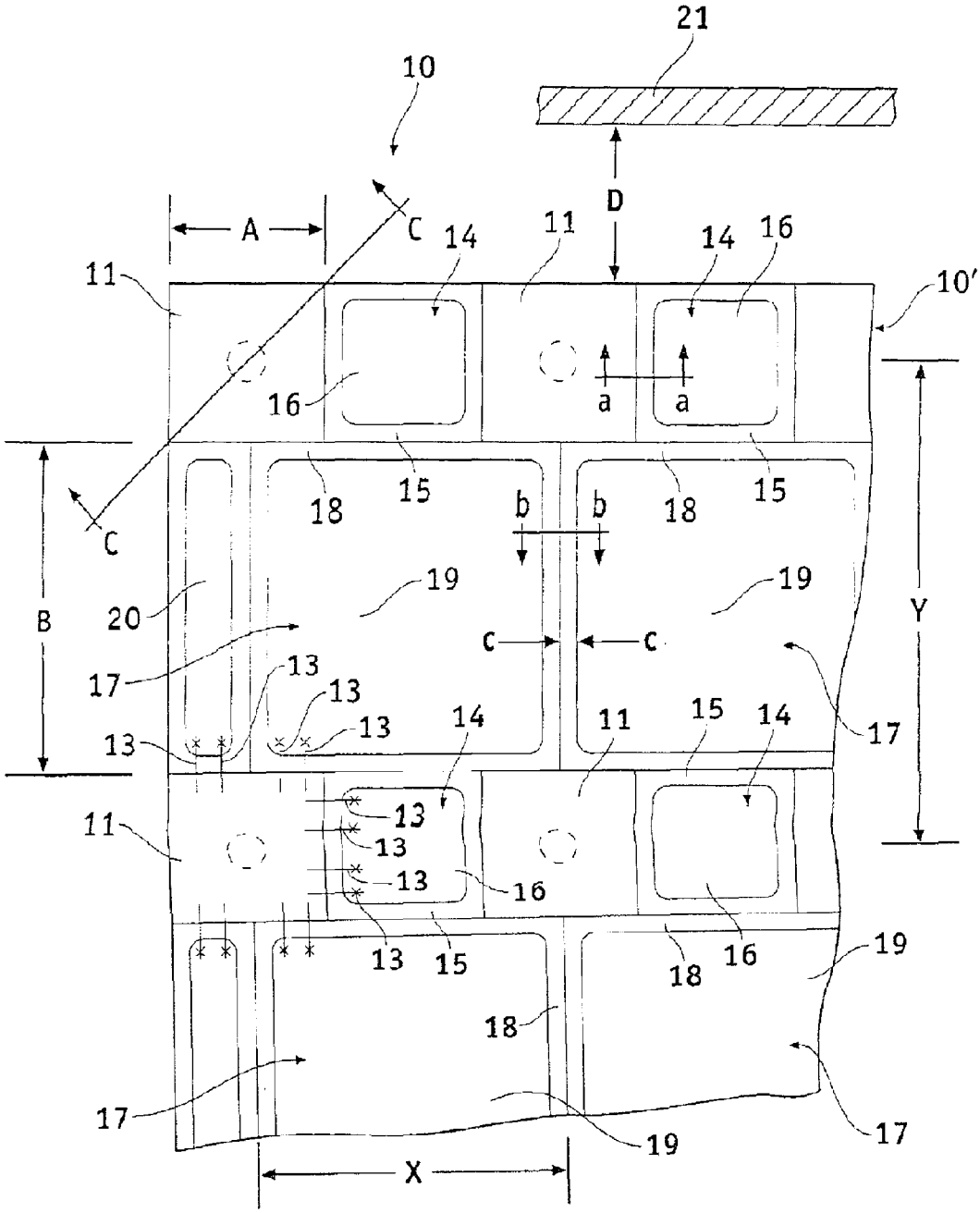
FIG. 1 is a top plan view of a seismic isolation access floor assembly constructed and arranged in accordance with a preferred embodiment of the invention.

Referring now to the drawings, in which like reference characters indicate corresponding elements throughout the several views, attention is first directed to FIG. 1 in which there is seen a top plan view of a seismic isolation access floor assembly 10 including isolator plates 11 and a series of floor plates, which are denoted, as a matter of reference, at 14, 16, 17, 19, and 20, and that together with the isolator plates form an access floor 10' constructed and arranged in accordance with the principle of the invention. Isolator floor plates 11, and the structure associated therewith to be presently described, each constitutes a seismic isolation component of assembly 10 together providing assembly 10 as a whole and, more over, access floor 10', with seismic isolation, in accordance with the principle of the invention. In FIG. 1, only a portion of access floor assembly 10 is shown, with the understanding that the components of access floor assembly 10 can be multiplied as need for providing an access floor having any specified surface area. This applies to each seismic isolation access floor assembly disclosed in this specification.

Isolator plates 11 are laid down in basically a two way array of separation, in which this separation is denoted generally by separation distances denoted at X and Y, respectively, in conjunction with the remaining floor plates 14, 16, 17, 19, and 20 of assembly 10. In this preferred embodiment, isolator plates 11 are square, and each have a relative size indicated generally at A and which is indicative of the length thereof, and also the width thereof given the square shape of each isolator plate. In accordance with the principle of the invention, isolator plates 11 each rest on a ball 12, in which balls 12 are each depicted in phantom outline in FIG. 1. Fasteners, designated generally at 13 and which are each bolts in a preferred embodiment, rigidly attach plates 11 to floor plates 14, 17, 19, and 20. Again, it is to be understood that a matrix of attached isolator plates 11 and floor plates 14, 16, 17, 19, and 20 forms access floor 10', in accordance with the principle of the invention.

Here, floor plate 17 is square, has a relative size indicated at B and is fashioned with a perimeter frame 18 onto which is removably set plate 19. In this regard, it is to be understood that plate 19 when set onto perimeter frame 18 of plate 17 together form a floor plate assembly. The size of plate 17 indicated at B is indicative of its length, and also its width given its square shape. Perimeter frame 18, which is considered a stringer, is secured to isolator plate 11. Similarly, floor plate 14 is also fashioned with a perimeter frame 15, onto which is removably set plate 16. In this regard, it is to be understood that plate 16 when set onto perimeter frame 15 of plate 14 together form a floor plate assembly. The width of the perimeter frames of the floor plates here described is denoted here generally at C, which is very small compared to size B and is comparable to the thickness of floor plates 14, 17, 19 and 20, and isolation isolator plate 11 being that of approximately 1.5 inches.

Figure 4:
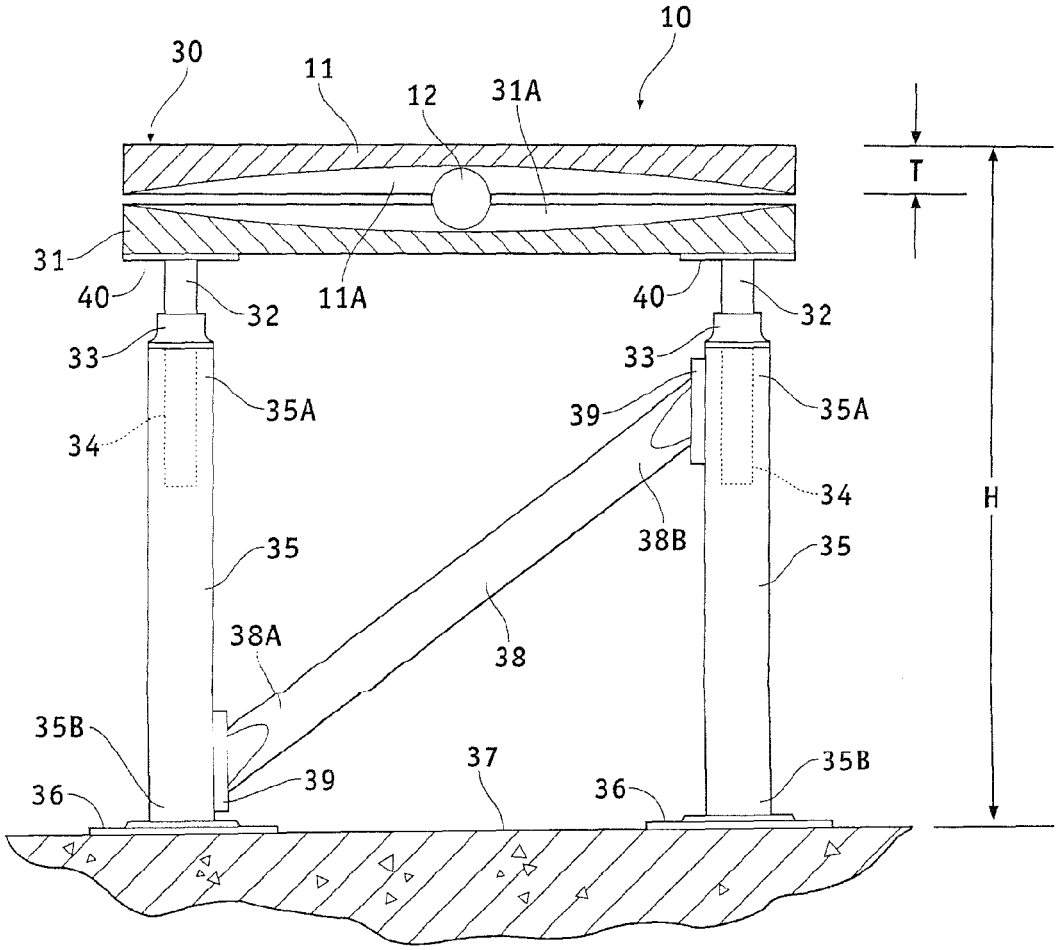
FIG. 4 is a sectional view taken along line c-c of FIG. 1.

Assembly 10 is separated from a wall 21 a distance denoted by D, in which wall 21 is a stationary wall built over a base floor, which is referenced in FIG. 4 at 37. The base floor, which is preferably a concrete base floor, supports a substructure, which in turn supports access floor 10'. When seismic activity shakes the base floor, isolator plates 11, and the structure associated therewith to be presently described allows, permits access floor 10' as a whole to displace and move laterally or otherwise horizontally relative to the base floor from its normal resting state and then restore to its normal resting state after the movement activity discontinues thereby providing access floor 10' with seismic isolation.

Figure 2:
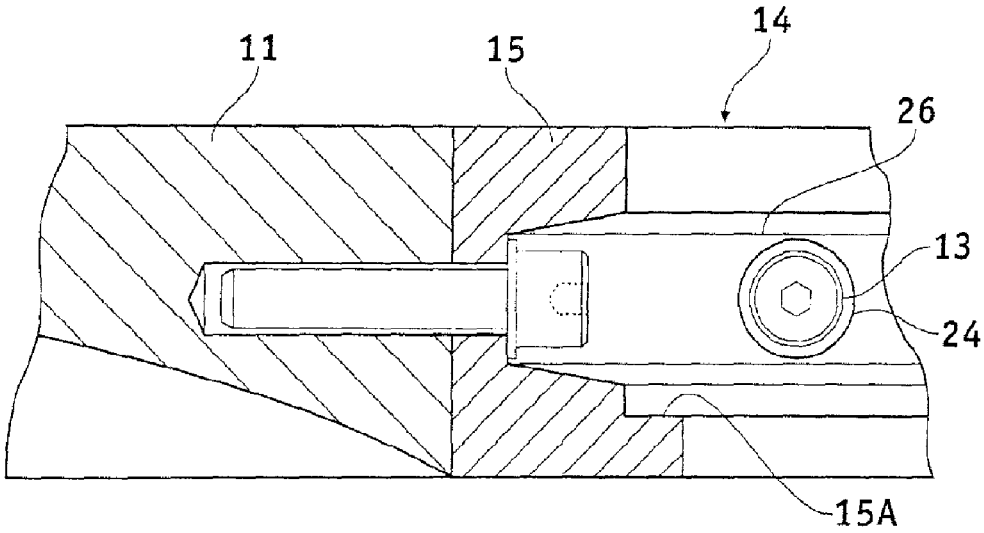
FIG. 2 is a sectional view taken along line a-a of FIG. 1.
Figure 3:
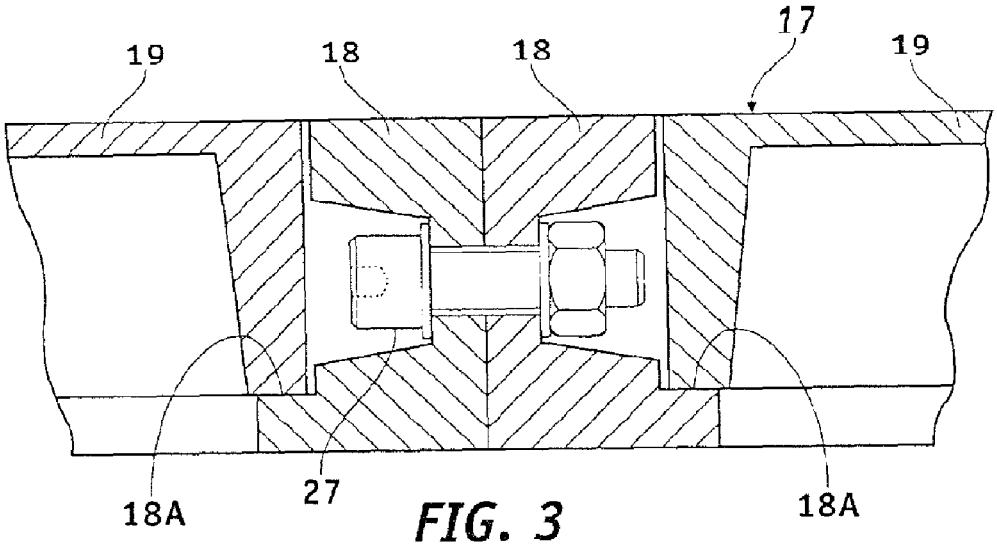
FIG. 3 is a sectional view taken along line b-b of FIG. 1.

The ensuing sectional views set forth in FIGS. 2 and 3 illustrate the connections between the plates of assembly 10, in which the plates of assembly 10 have load bearing capacity and in-plane and out-of-plane rigidity across the components and connections thereof.

Turning first to FIG. 2, which is a sectional view taken along line a-a of FIG. 1, there is illustrated a connection point between isolator plate 11 and floor plate 14, with the understanding the a plurality of such connection points are used in conjunction therewith, in which the structure of only one connection point is shown for illustrative purposes. In FIG. 2, perimeter frame 15 is fastened to isolator plate 11 with a fastener, which in this instance is a bolt 23, although a cap screw or other suitable mechanical fastener can be used, if desired. Perpendicularly disposed relative to bolt 23 is another fastener secured to an adjacent floor plate (not shown), which in this instance is bolt 13 incorporating a lock washer 24. In this embodiment, perimeter frame 15 has an inwardly directed flange or lip 15A, onto which is set plate 16 (not shown), and onto which equipment is to be set.

According to the principle of the invention, each isolator plate 11 is the upper part of a seismic isolator component of the invention, which is formed with a concave cavity 11A that is recessed upwardly. There is no appreciable gap between plate 11 and frame 15, and in this moment connection bolt 23 bears the tension and the compression is transferred on the top and the bottom part of the mating surfaces of plate 11 and frame 15 providing seismic isolation to isolator plate 11 and also plate 16 positioned on frame 15, in accordance with the principle of the invention. Bolts 23 and 13 are preferably sunk, although they can be countersunk or inwardly recessed, if desired. FIG. 2 illustrates a recess formed into the inner side of frame 15, which is denoted at 26, and which runs around perimeter frame 15 of plate 14 and at which fasteners, such as bolts 23, are positioned to secure adjacent plates and/or frames. Plates 17 and 20 are also preferably formed with a similar recess and their respective perimeter frames for at which fasteners are positioned for securing adjacent plates and/or frames.

Referring now to FIG. 3, which is a sectional view taken along line b-b of FIG. 1, there is illustrated the connection between adjacent plates 17, with the understanding the a plurality of such connection points are used in conjunction therewith, in which the structure of only one connection point is shown for illustrative purposes. In this embodiment, a fastener fastens together opposed perimeter frames 18 of plates 17, respectively, in which the fastener in this instance is a bolt 27 locked by a nut and being exemplary of a nut-and-bolt assembly although other mechanical fasteners may be used, if desired. It is to be understood that on lips 18A of perimeter frames 18 rest removable plates 19 and onto which equipment is to be set. Removable plates 19 may be formed with a perimeter rib and two-way sub-divider ribs (not shown) for enhanced strength.

FIG. 4 is a sectional view taken along line c-c of FIG. 1, which illustrates the seismic isolation system constituting a sub-assembly 30 of access floor assembly 10 shown in FIG. 1. For reference and understanding, it is to be understood that the height of the access floor assembly 10 is denoted at H and its thickness is denoted at T, which, in this specific embodiment, is about 1.5 inches. Beneath access floor assembly 10 is the vertical clearance/space for pipes, ducts, conduits and cables.

The main component of the illustrated isolation system at assembly 10 comprises opposing plates 31 and 11 and ball 12 disposed therebetween, and it is to be understood that the ensuing discussion of the isolation system at assembly 10 respecting each isolator plate 11 applies to each isolator plate 11 not only with the immediate embodiment but also with all seismic isolation access floor assemblies set forth herein incorporating isolator plates designated by the reference character 11. Plates 11 and 31 are load-bearing plates having concave cavities 11A and 31A, respectively, which face inwardly toward one another capturing ball 12 therebetween. Ball 12 can be rigid, and in another embodiment can be constructed and arranged having plasticity and elasticity. The combination of cavities 11A and 31A and ball 12 provide bearing re-centering after seismic activity passes and ball 12 provides and ensures damping and reduction in the seismic displacement of plates 11 and 31 relative to each other, as well as a reduction in the settling time of plates 11 and 31 after seismic displacement, in accordance with the principle of the invention. In a preferred embodiment, ball 12 is made of elastomeric material or composite material with an elastomer provided as one or more applied layers and/or as a core positioned within ball 12, which enhances the ability of ball 12 to provide damping and re-centering. Due to the combination of concave cavities 11A and 31A and ball 12 captured therebetween, isolator plate 11 displaces laterally up to distance A and rises by up to twice the depth of its concave cavity thus providing lateral and vertical displacement.

System 30 in FIG. 4 is a gravity restoring isolation system, in which ball 12 interacting with cavities 11A and 31A of plates 11 and 31 allows plate 31 to displace relative to plate 11 providing seismic isolation to not only plate 11 but also the plates attached to it, whether directly or by way of frames onto which plates are set. The displacement of plate 31 relative to isolator plate 11 constitutes a decoupling of plates 11 and 31 from their normal resting positions, which reduces the seismic acceleration transmitted from the base floor to the payload on access floor assembly 10. As such, equipment may be placed onto the access floor 10' without having to fasten it down and being, nevertheless, protected from seismic overturning by reduced base shear, in accordance with the principle of the invention. The isolation system described herein is automatic requiring no external energy input for functioning. Isolator plate 11 may be considered a second plate or upper or top plate or isolated plate. Plate 31 may be considered a first plate or lower or bottom plate or isolator plate or bearing plate.

Bearing plate 31, in addition to each bearing plate associated with its respective isolator plate, is supported by a substructure or understructure, which rests on base floor 37. The substructure or understructure consists of pedestals which are anchored to base floor 37 and to bearing plate 31. Opposing pairs of the pedestals associated with each bearing plate 31 are preferably coupled together with at least one brace 38. The pedestals are preferably structurally identical, and different geometries can be used, if desired, consistent with the teachings set forth herein.

In the present embodiment, pedestals are identical to one another each having a top plate 40, which is fastened to the underside of bearing plate 31. Top plate 40 is rigidly coupled to bearing plate 31 with, for instance, a suitable adhesive, and/or one or more screws, bolts, nut-and-bolt assemblies, etc. Top plate 40 may, if desired, be welded to the underside of bearing plate 31. Top plate 40 is rigidly secured to a relatively short threaded stem 32 that depends downwardly therefrom to a distal end 34 which projects through a threaded nut 33 positioned atop an upper end 35A of upright stud 35, and also is partially received into upper end 35A of an upright stud 35. Threaded nut 33 threadably retains stem 32 at upper end 35A of stud 35. Lower end 35B of stud 35 is rigidly affixed to a load distributor plate 36 positioned against base floor 37. Stem 32 is reciprocally adjustable relative to stud 35, in which nut 33 is used to secure stem 32 at whatever position it is adjusted to and thus providing height adjustment for plate 31 for setting the access floor at a specified height. Stem 32 and stud 35 have complementing cylindrical shapes in the preferred embodiment, but can be provided in other complementing shapes, such as square, triangular, etc. Also, although nut 33 is used to secure stem 32 to stud 35, other forms of mechanical devices can be used for providing this function, such as a clamp, a keyed nut, etc.

The bracing between opposing pairs of pedestals is provided by at least one brace 38, which is an elongate rigid member made of steel, aluminum, titanium or the like, being strong and highly resilient. Brace 38 has opposing ends 38A and 38B to which are attached connector plates 39, respectively, which are fastened, such as by welding, screwing, bolting, or the like, to the opposing studs of an opposing pair of pedestals. Plate 31 is preferably supported by four equally spaced-apart pedestals, although less or more can be used, if desired. That fact illustrates the economy of the access floor isolation system disclosed herein, which needs no beams and heavy-duty isolators. The greatly reduced price of the isolator type illustrated in FIG. 4 ensures such economy and the feasibility of the access floor configurations disclosed and illustrated herein.

In order to adapt prior art floor studs to suit the need of this invention, plate 40 may need to be reconfigured. Examples of such reconfigurations of plate 40 illustrated in FIGS. 5, 6 and 7.

Figure 5:
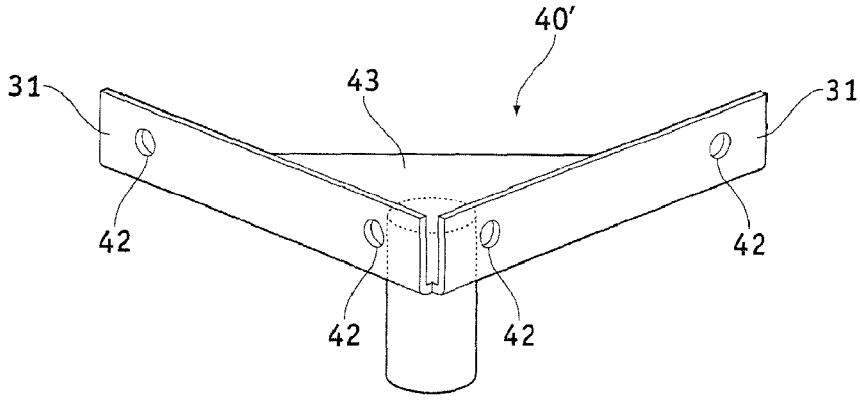
FIGS. 5-7 are perspective views of preferred embodiments of top plates for use with the seismic isolation apparatus of the access floor of FIG. 1.

FIG. 5 illustrates a preferred embodiment of a reconfiguration of plate 40 being a stud head 40', having a triangular support member 43 and opposed upturned sides 41 disposed in orthogonal directions, and which are fashioned with fastener attachment holes 42 used to receive fasteners for attachment to a bearing plate. Support member 43 is welded to a stem 44, which is to be attached to an upright stud as previously discussed.

Figure 6:
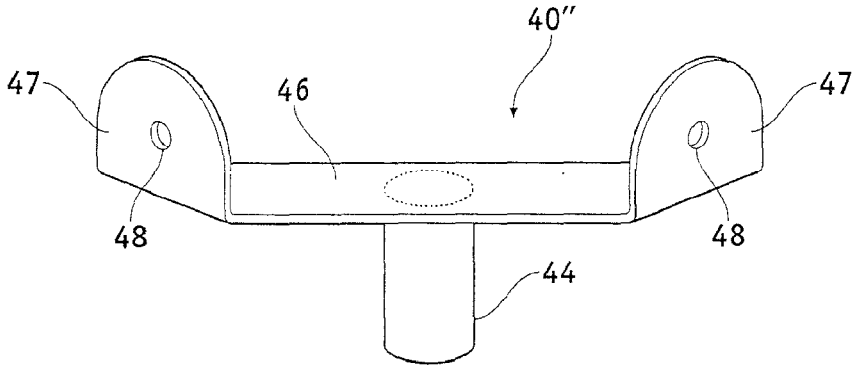

FIG. 6 illustrates another reconfiguration of plate 40" being a head including an elongate support 46 with a stem 44 rigidly affixed thereto, such as by welding or the like, at an intermediate location. Upturned tabs 47 with fastener holes 48, respectively, are located at each end of support 46. Tabs 47 are diagonal relative to one another, so that they may be bolted to the adjacent edges of a bearing plate, such as bearing plate 31 (not shown in FIG. 6). Stem 44 is to be attached to an upright stud as previously discussed.

Figure 7:
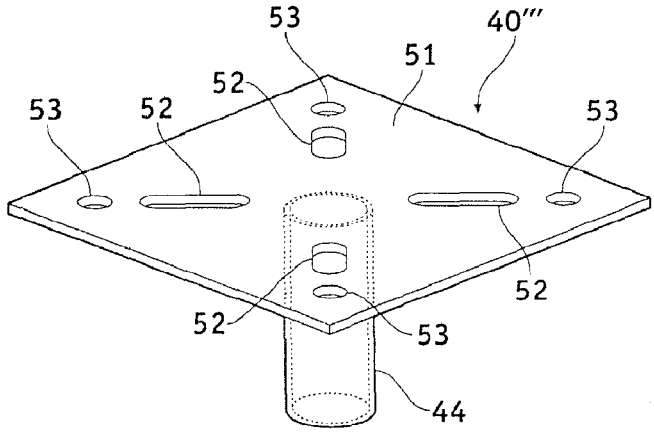

FIG. 7 illustrates yet another reconfiguration of plate 40''' being a head including a plate 51 formed with stiffening ribs 52, and four fastener holes 53 disposed at the four corners of plate 51 being square in shape in this embodiment, and which accommodate fasteners for securement to a bearing plate. Plate 51 is rigidly fastened to stem 44, although it can be rigidly attached in other ways. Stem 44 is to be attached to an upright stud as previously discussed.

Figure 8:
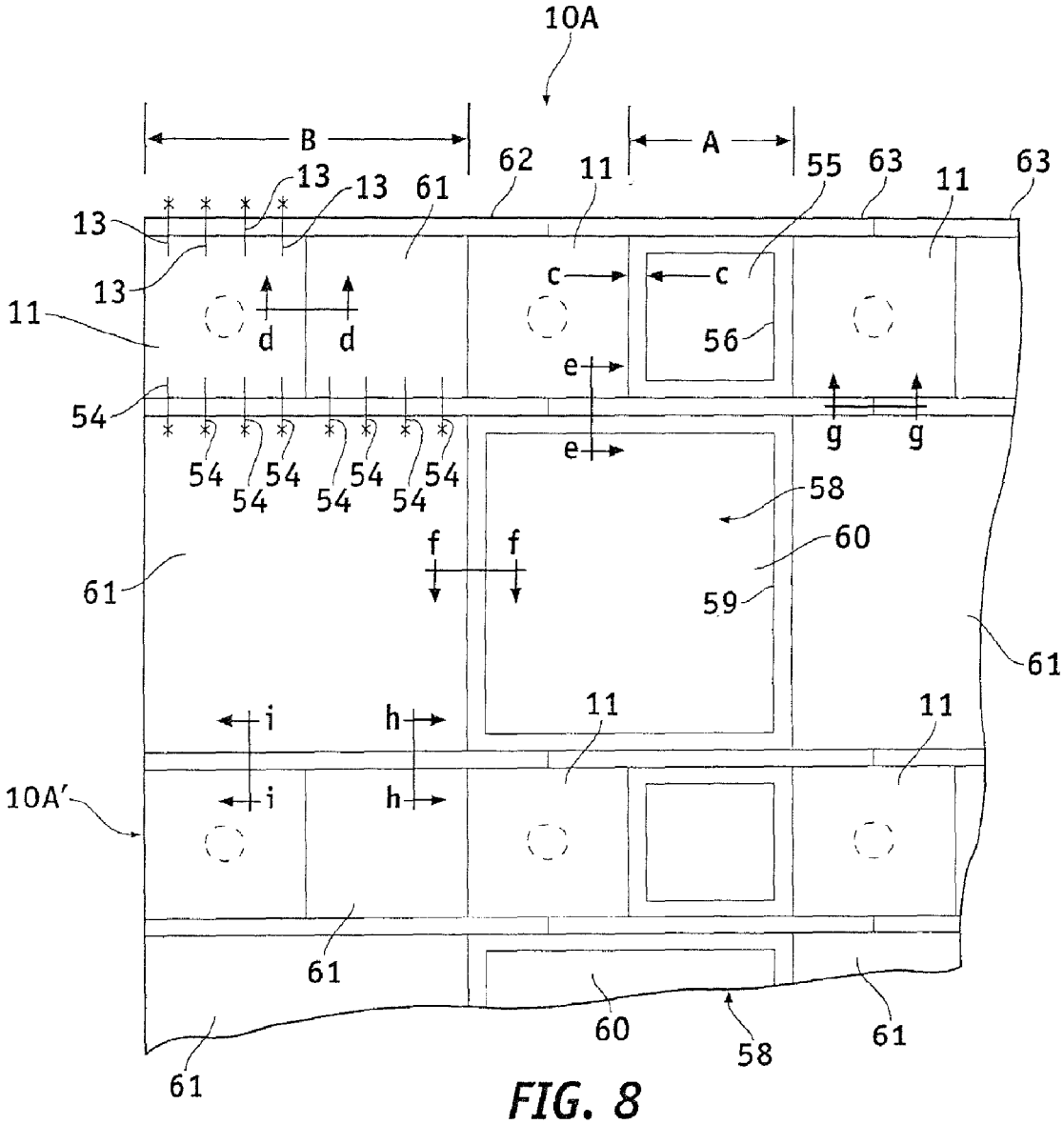
FIG. 8 is a top plan view of a seismic isolation access floor assembly constructed and arranged in accordance with an alternate embodiment of the invention.

FIG. 8 is a perspective view of another preferred embodiment of a seismic isolation access floor assembly 10A incorporating isolator plates 11, each forming a seismic isolation component as previously discussed in conjunction with FIG. 4, and the other floor plates as previously discussed in conjunction with the embodiment designated 10 forming an access floor 10A', and also in-plane stringers 62 and 63, which form a narrow (size A+2C) and a wide (size B) floor area or strips of floor. In the narrow strip, floor plates 61 are not removable, and yet floor plates 55 are being supported on a perimeter frame 56. Stringers 62 and 63 are attached, such as by bolts 13, to isolator plates 11 on the exterior and by bolts 54 on the interior. Floor plates 61 are not removable in the wide strip, but floor plates 58 each have a perimeter frame 59 onto which is set removable floor plate 60.

At an infield of access floor 10A' stringers 63 are spliced across plates 11, while at the outfield or at the edge of access floor 10A' shorter stringers 62 are used un-spliced. FIGS. 9-14 illustrate sectional views taken along lines d-d, e-e, f-f, g-g, h-h and i-i, respectfully, illustrating the connections of the main components of floor assembly 10A. In order to ensure stability of floor assembly 10A in case most of plates 58 are removed for service, some plates 61 need to remain bolted at all times.

Figure 9:
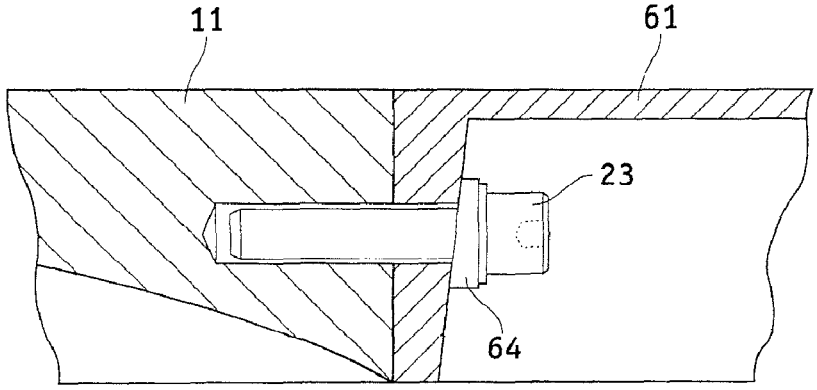
FIG. 9 is a sectional view taken along line d-d of FIG. 8.

FIG. 9 is a sectional view taken along line d-d of FIG. 8 illustrating a moment connection of isolator plate 11 to plate 61, with the understanding the a plurality of such connection points are used in conjunction therewith, in which the structure of only one connection point is shown for illustrative purposes. Here, a bolt 23 connects isolator plate 11 to directly to floor plate 61, which is shouldered by wedge washer 64.

Figure 10:
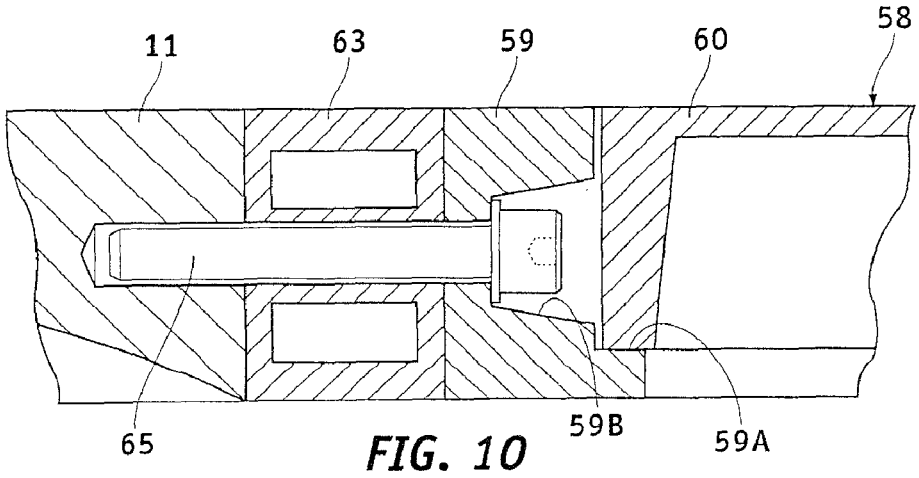
FIG. 10 is a sectional view taken along line e-e of FIG. 8.

FIG. 10 is a sectional view taken along line e-e of FIG. 8 illustrating a connection of stringer 63 to isolator plate 11 and perimeter frame 59 to stringer 63 using bolt 65, with the understanding the a plurality of such connection points are used in conjunction therewith, in which the structure of only one connection point is shown for illustrative purposes. Plate 60 is set onto frame 59 forming floor plate 58, which is actually a floor plate assembly. In this regard, floor plate 60 rests on lip 59A of perimeter frame 59. The head of bolt 59 is recessed in a groove 59B formed into frame 59.

Figure 11:
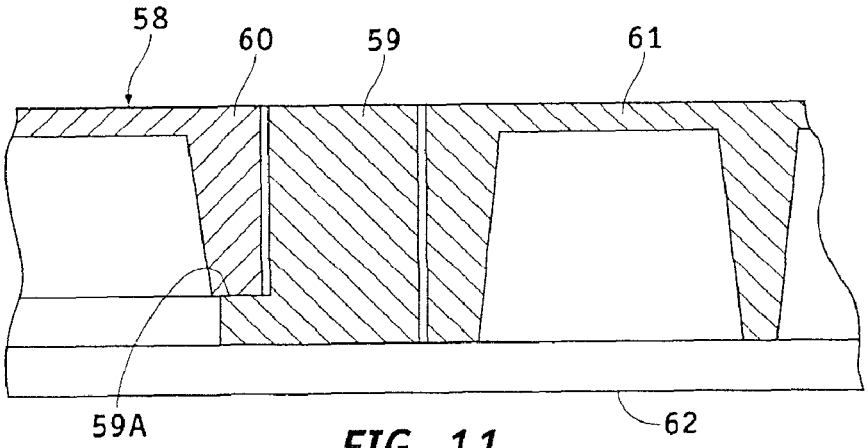
FIG. 11 is a sectional view taken along line f-f of FIG. 8.

FIG. 11 is a sectional view take along line f-f of FIG. 8, which illustrates a non-connected association of plates 58 and 61, where plate 61 is bolted to stringer 62 (not shown) and plate 60 is positioned onto lip 59A of perimeter frame 59.

Figure 12:
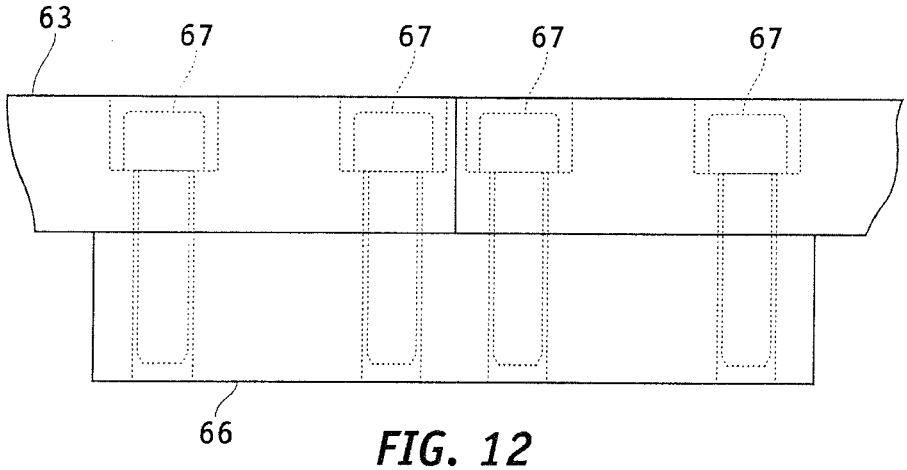
FIG. 12 is a sectional view taken along line g-g of FIG. 8.

FIG. 12 is a sectional view taken along line g-g of FIG. 8 illustrating the splice of stringers 63, which splice is identical to the splice of stringers 62 (not shown). The splice is a moment connection ensured by auxiliary short stinger 66 and bolts 67. Stringers 62 and 63 can be moment connected in line without stringer 66 as well. Stringer 66 is not in the way of the seismic movement of isolator plate 11 (not shown) relative to its corresponding bearing plate 31 (not shown). Stringers 62 and 63 can be several times longer than dimension B previously denoted, if desired.

Figure 13:
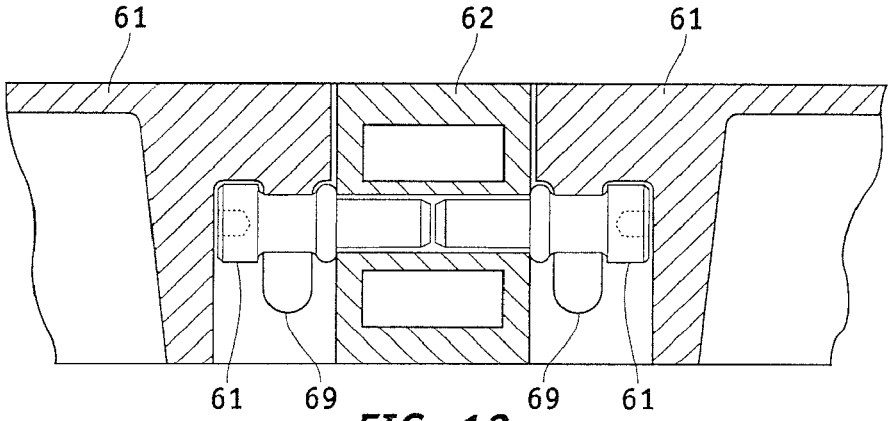
FIG. 13 is a sectional view taken along line h-h of FIG. 8.
Figure 14:
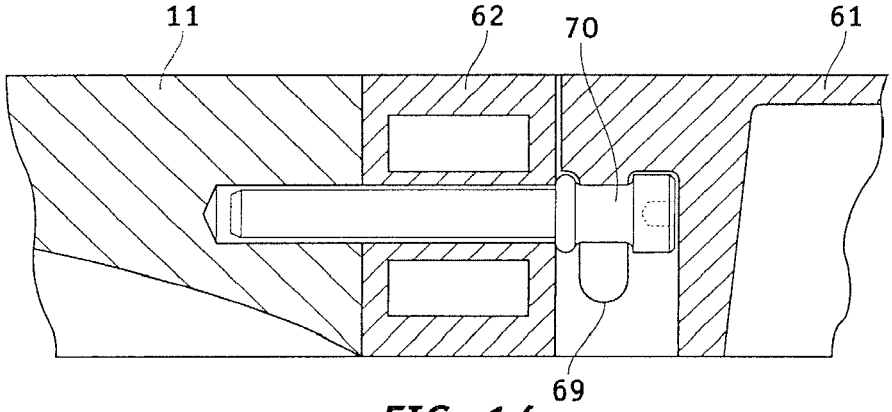
FIG. 14 is a sectional view taken along line i-i of FIG. 8.

FIG. 13 is a sectional view taken along line h-h of FIG. 8 illustrating a pinned connection of stringer 62 to plates 61 on each side using specialized screws 68, which are positioned into specially formed keyholes 69 of the perimeter ribs of plates 61, with the understanding the a plurality of such connection points are used in conjunction therewith, in which the structure of only one connection point is shown for illustrative purposes. FIG. 14 is a sectional view taken along line i-i of FIG. 8 illustrating a moment connection of isolator plate 11 to stringer 62 with a specialized bolt 70, and a pinned connection of plate 61 to stringer 62 using bolt 70, in which plate 61 has a recess 69 formed in a perimeter rib of plate 61 that accepts a head 70A of bolt 70, with the understanding the a plurality of such connection points are used in conjunction therewith, in which the structure of only one connection point is shown for illustrative purposes.

Figure 15:
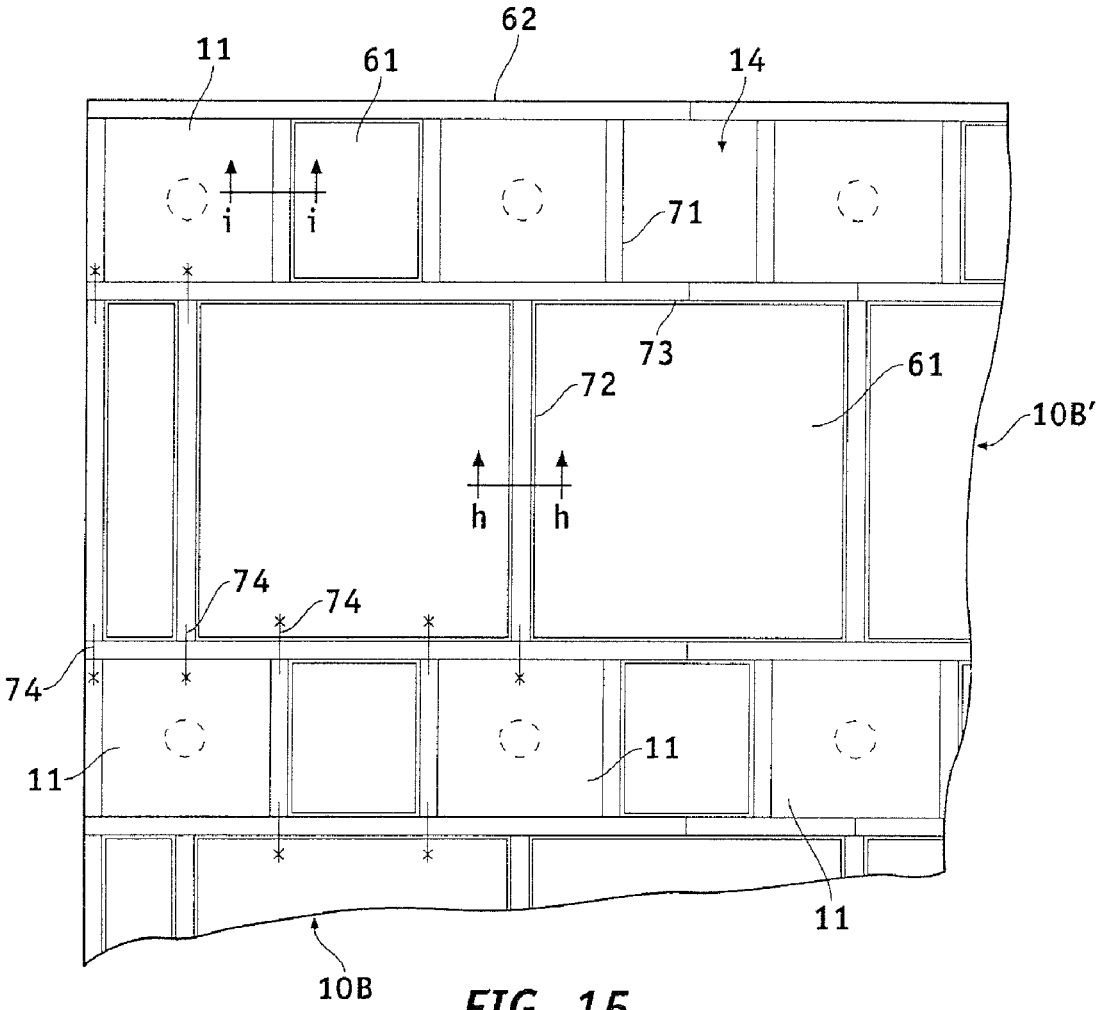
FIG. 15 is a top plan view of a seismic isolation access floor assembly constructed and arranged in accordance with yet another alternate embodiment of the invention.
Figure 16:
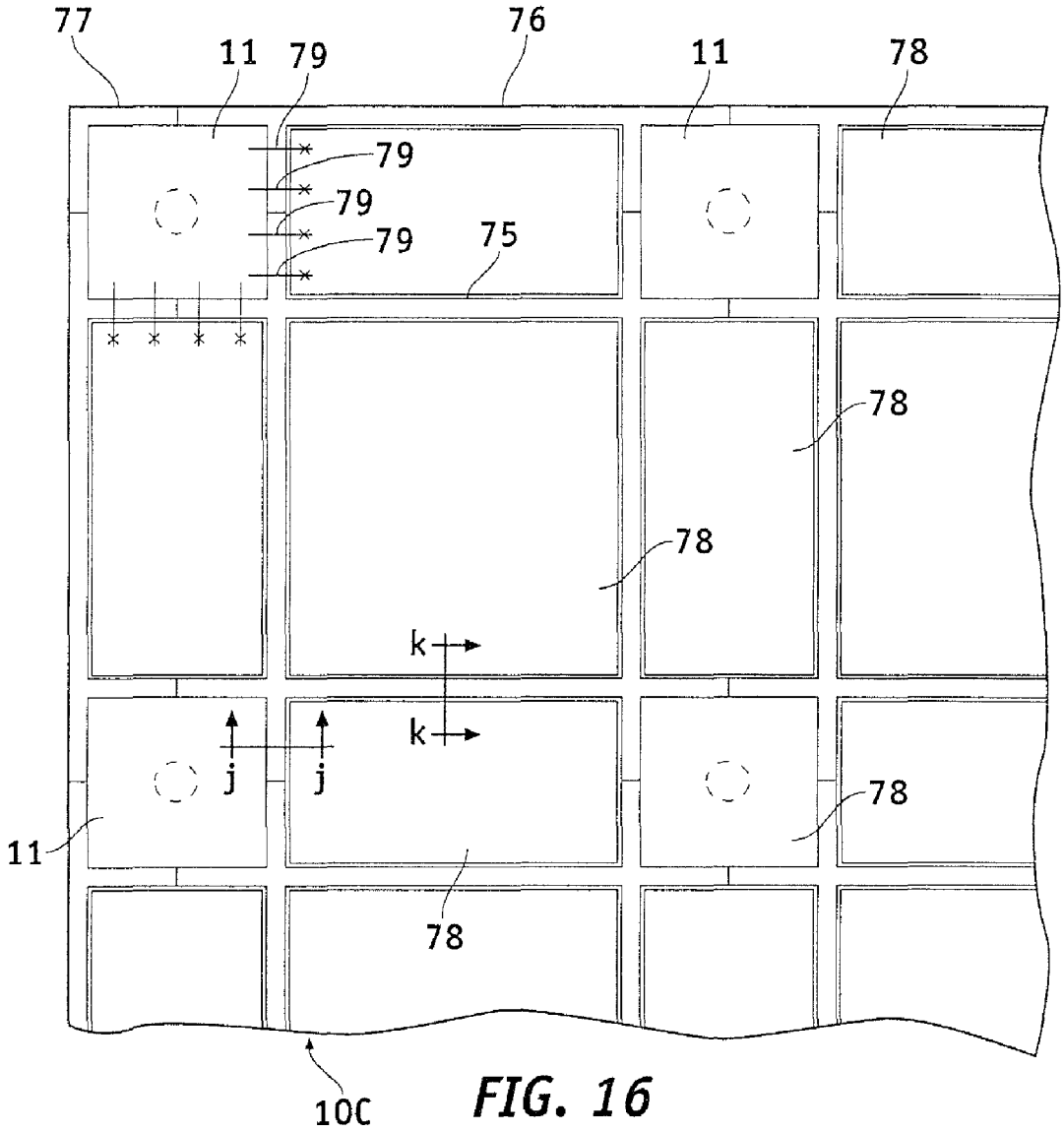
FIG. 16 is a top plan view of a seismic isolation access floor assembly constructed and arranged in accordance with yet still another alternate embodiment of the invention.
Figure 17:
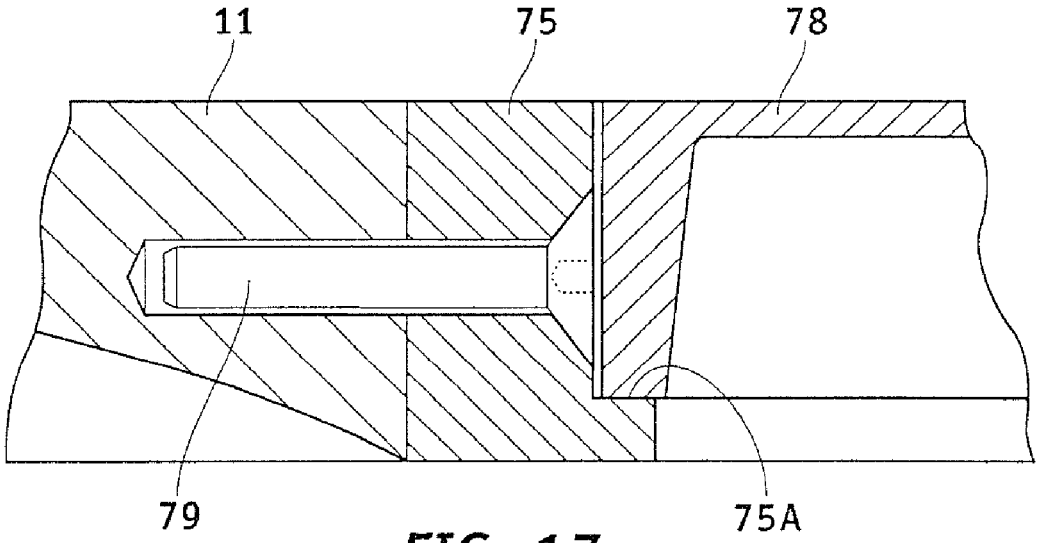
FIG. 17 is a sectional view taken along line j-j of FIG. 16.

FIG. 15 illustrates a top plan view of yet another preferred embodiment of a seismic isolation access floor assembly 10B that like assembly 10A incorporates isolator plates 11, each forming a seismic isolation component as previously discussed in conjunction with FIG. 4, and the other floor plates including floor plates 14 as previously discussed, and also stringers 62, 63, 71 and 72 as in-plane framing supporting inset removable floor plates 61, and together forming an access floor 10B'. The stringers in access floor assembly 10B are spliced by splice 73 either in line or similarly to the splice shown in FIG. 12. Any auxiliary elements in splice 73 do not hit plate 31 at seismic movement of access floor 10B'. FIGS. 16 and 17 are sectional views taken along lines h-h and i-i, which are shown in FIGS. 13 and 14, respectively. Countersunk bolts 74, denoted generally in FIG. 15, ensure moment connections between the stringers, which meet perpendicularly as illustrated.

Figure 18:
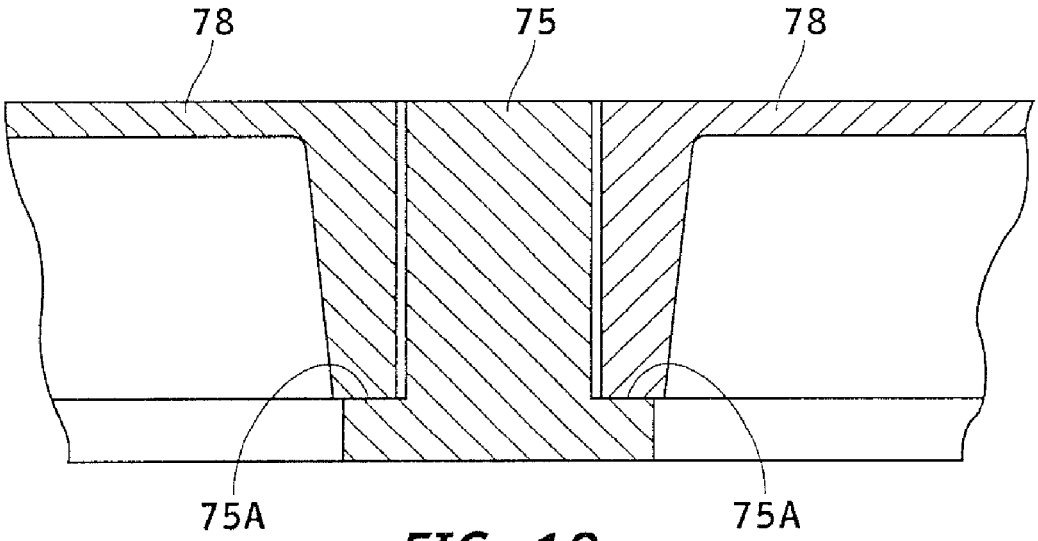
FIG. 18 is a sectional view taken along line k-k of FIG. 16.

FIG. 16 illustrates in top view yet another preferred embodiment of a seismic isolation access floor assembly 10C that, in common with assembly 10B, incorporates isolator plates 11, each forming a seismic isolation component as previously discussed in conjunction with FIG. 4, and floor plates 14 and 61 and also perimeter stringer frames 75, 76 and 77 which are welded or cast framing members supporting removable floor plates 78. FIGS. 17 and 18 are sectional views taken along lines j-j and k-k, respectively, of FIG. 16, illustrating moment and pinned connections, respectively.

FIG. 17 is a sectional view taken along line j-j of FIG. 16 illustrating a moment connection of plate 11 and perimeter frame 75 using countersunk bolt 79. Removable floor plate 78 rests on a lip 75A of frame 75, in which frame 75 and plate 78 form a floor plate or plate assembly. FIG. 18 is a sectional view taken along line k-k of FIG. 16 illustrating the connection of frame 75 and removable floor plates 78 resting on lips 75A of frame 75.

Figure 19:
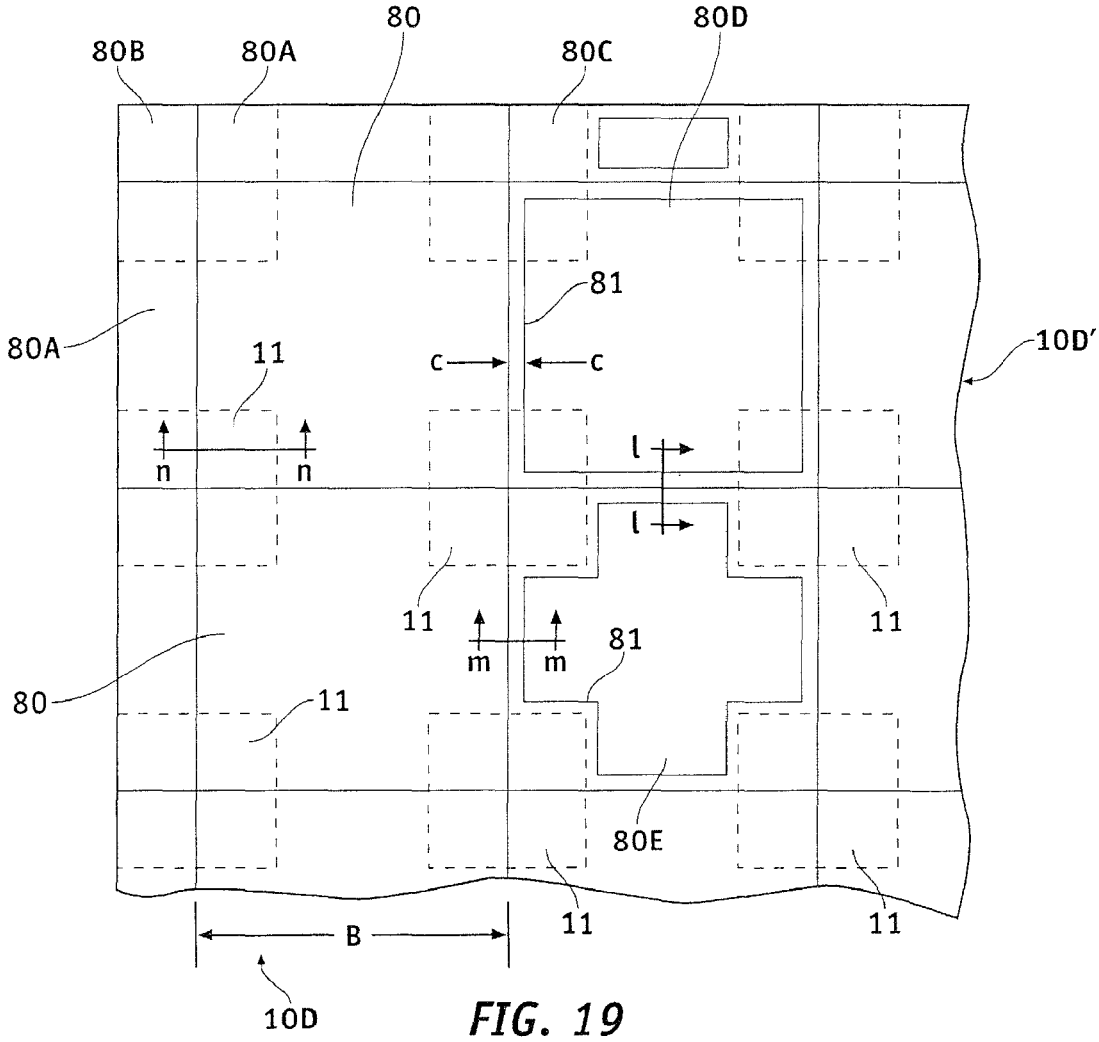
FIG. 19 is a top plan view of a seismic isolation access floor assembly constructed and arranged in accordance with a further alternate embodiment of the invention.
Figure 20:
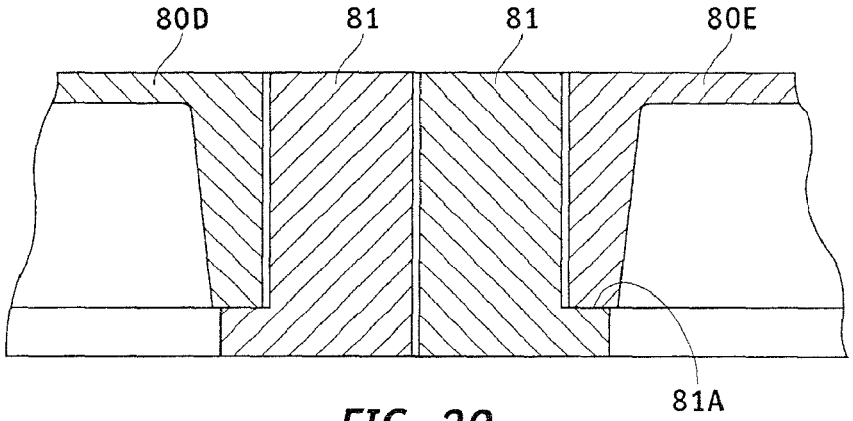
FIG. 20 is a sectional view taken along line l-l of FIG. 19.
Figure 21:
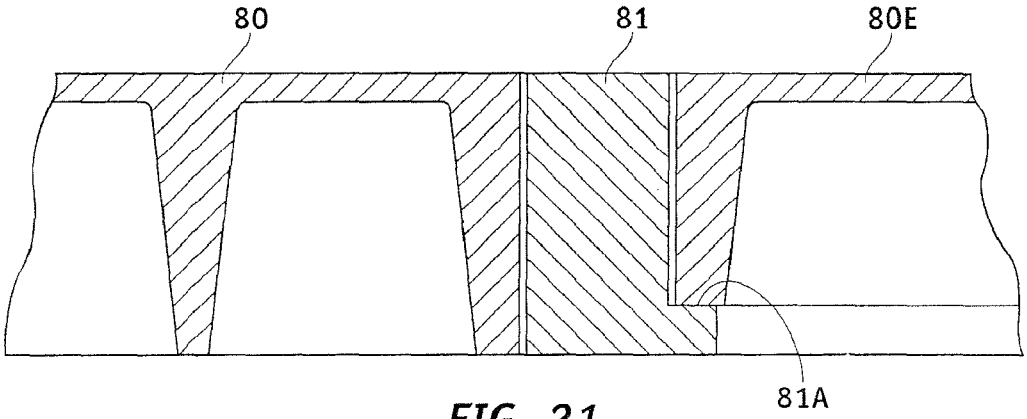
FIG. 21 is a sectional view taken alone line m-m of FIG. 19.
Figure 22:
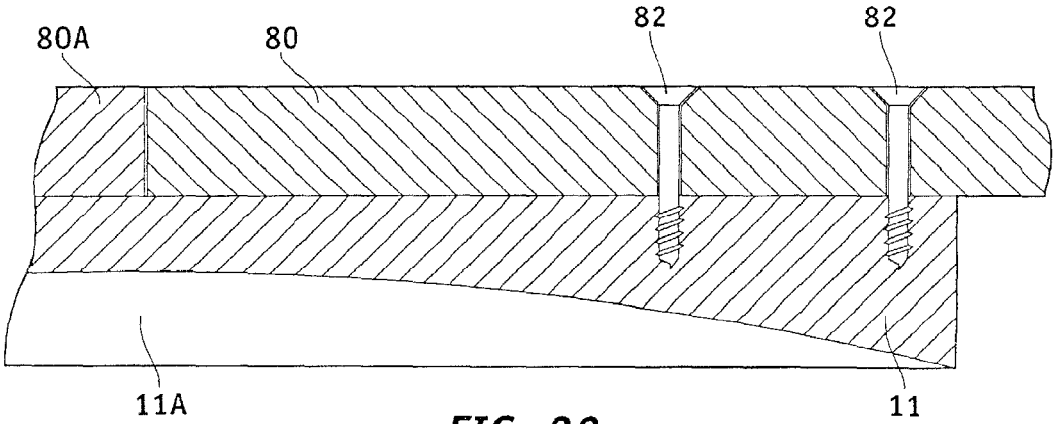
FIG. 22 is a sectional view taken along line n-n of FIG. 19.

FIG. 19 is a top plan view of yet another preferred embodiment of a seismic isolation access floor assembly 10D incorporating isolator plates 11, each forming a seismic isolation component as previously discussed in conjunction with FIG. 4, and floor plates forming an access floor 10D', and which is furnished without stringers, in which floor plates 80 of size B rest attached on isolator plates 11, in accordance with the principle of the invention, in which isolator plates are shown in phantom outline for illustrative purposes. The clear vertical space of access floor 10D' above the base floor (not shown) is similar to that as shown in FIG. 4. Isolator plates 11 occupy some useful area of plates 80, but the connection of plates 11 and 80 is simple and inexpensive. The corners of plates 80 are fastened, such as with screws or bolts, to isolator plates 11. On the perimeter of access floor 10D plates 80 are cut smaller forming a side plates 80A, corner plates 80B and plate 80C being a side with removable floor plate 80D. Some or all of plates 80 each can have perimeter frame 81 of width C, thus allowing holding by gravity of removable floor plates 80D or 80E, where these plates differ only in shape. FIGS. 20-22 are sectional views taken alone lines l-l, m-m and n-n of FIG. 19, respectively, illustrating connections of the floor plates of assembly 10D.

FIG. 20 is a sectional view taken along line l-l of FIG. 19 illustrating a connection of plates 80D and 80E, in which perimeter frames 81 are positioned against one another and onto which are set plates 80D and 80E, respectively. FIG. 21 is a sectional view taken along line m-m of FIG. 10 illustrating the connections of floor plate 80 to floor plate 80E, in which plate 80 is presented up against one side of frame 81 and frame 81 has a lip 81A onto which plate 80E is set on the other side of frame 81. FIG. 22 is a sectional view taken along line n-n of FIG. 19 illustrating a moment connection of isolator plate 11 to plates 80 and 80A with, as a matter of example, self tapping screws 82.

Figure 23:
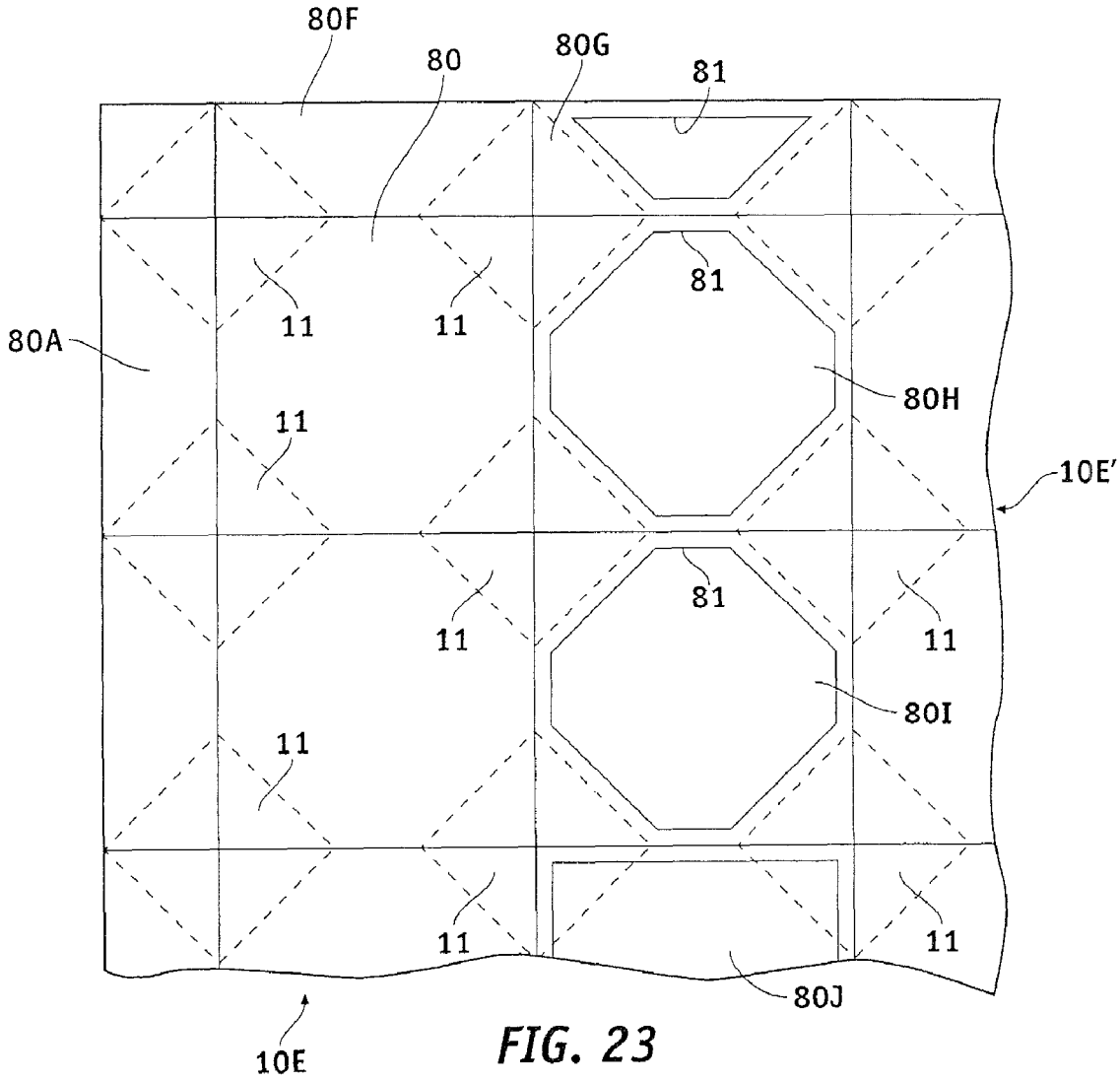
FIG. 23 is a top plan view of a seismic isolation access floor assembly constructed and arranged in accordance with yet a further alternate embodiment of the invention.

FIG. 23 is a top plan view yet another preferred embodiment of a seismic isolation access floor assembly 10E incorporating isolator plates 11, each forming a seismic isolation component as previously discussed in conjunction with FIG. 4, and floor plates 80 together forming an access floor 10E', in which isolator plates 11 are turned in diagonally allowing for larger accessible area in, for instance, floor plates 80G, 80H, 80I and 80J, all of which have a perimeter frame 81 therearound and with corner reinforcement. Floor plates 80A and 80F on the perimeter of assembly 10E are concurrently non-removable.

Figure 24:
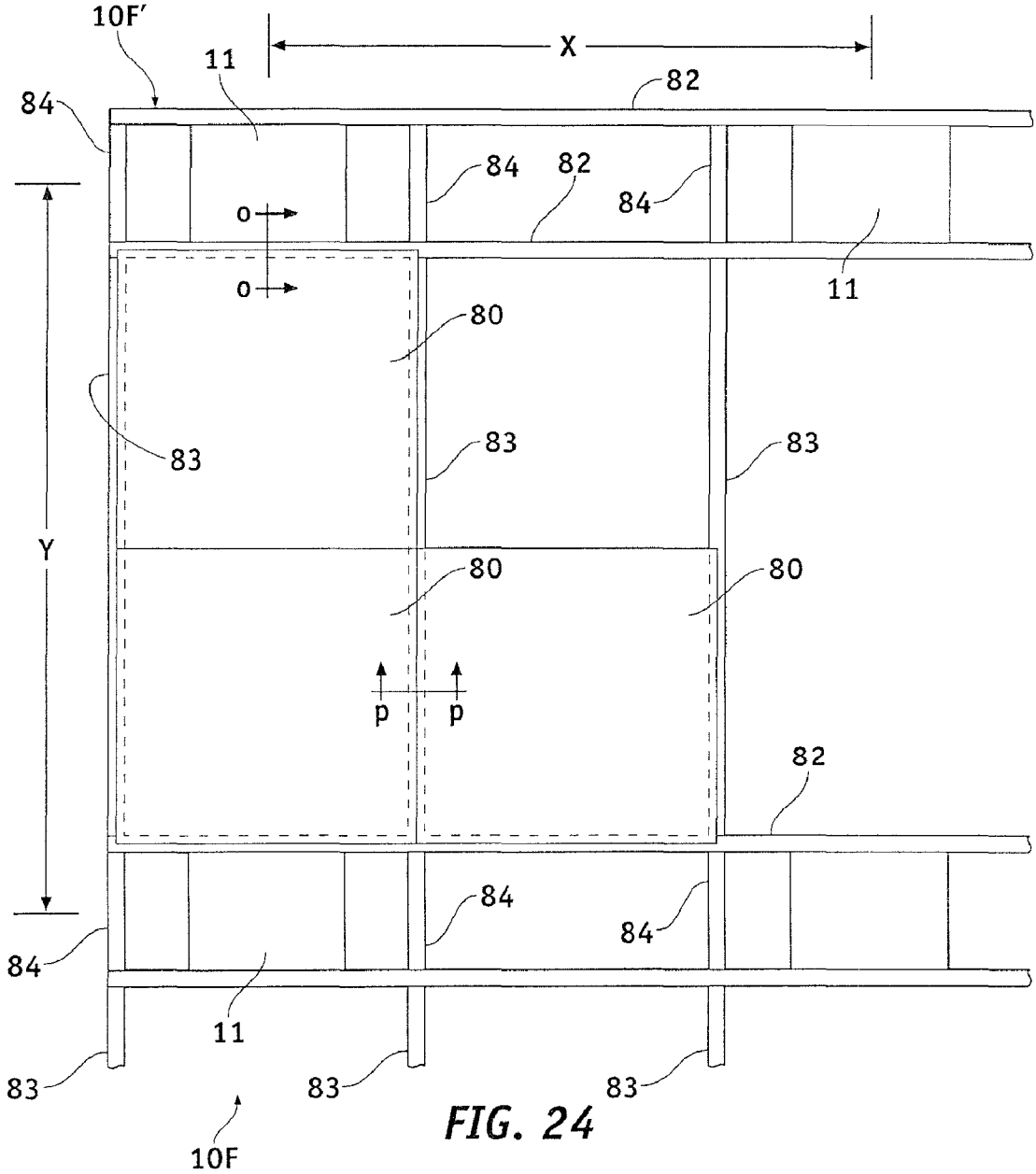
FIG. 24 is a top plan view of a seismic isolation access floor assembly constructed and arranged in accordance with yet still a further alternate embodiment of the invention.
Figure 25:
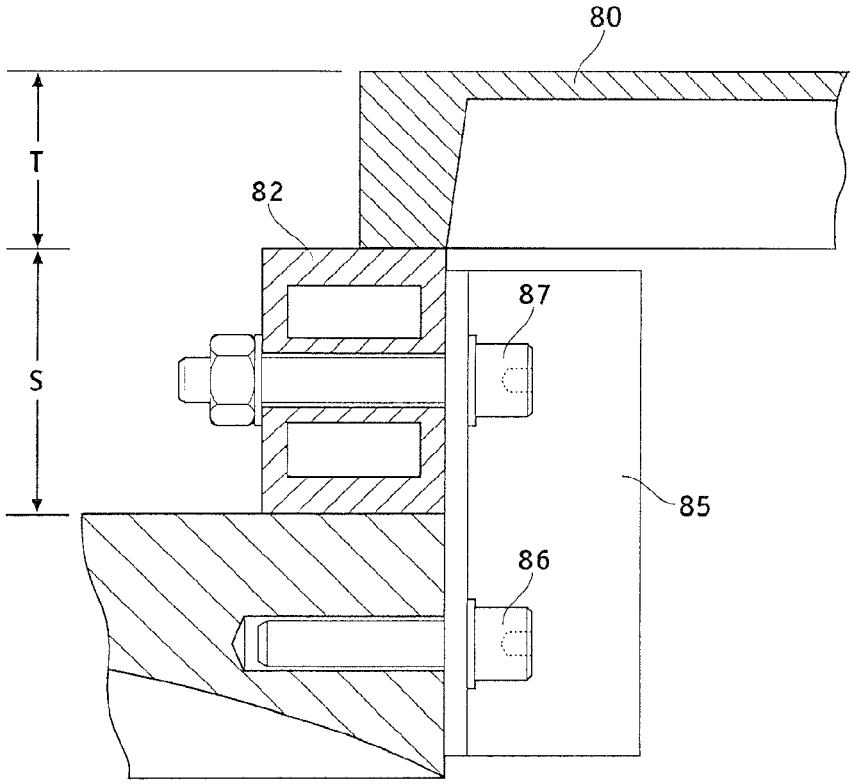
FIG. 25 is a sectional view taken alone line o-o of FIG. 24.
Figure 26:
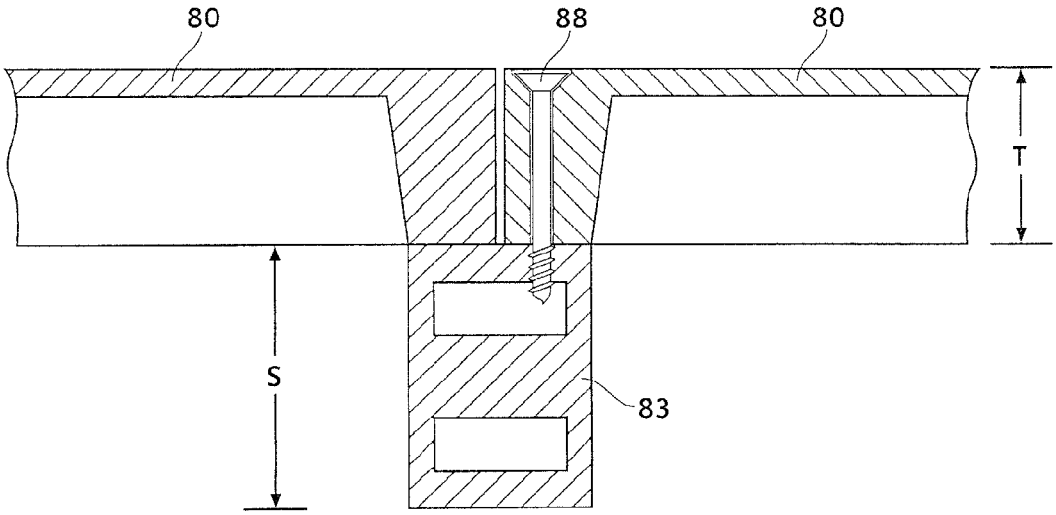
FIG. 26 is a sectional view taken along line p-p of FIG. 24.

FIG. 24 is a top plan view of yet another preferred embodiment of a seismic isolation access floor assembly 10F with X-directional stingers 82 mounted on top of isolator plates 11, each forming a seismic isolation component as previously discussed in conjunction with FIG. 4, and Y-directional stringers 83 between stringers 82 to support floor plates 80, in which isolator plates 11 and floor plates 80 and stingers 82 and 83 form an access floor 10F'. FIGS. 25 and 26 are sectional views taken along lines o-o and p-p, respectively, of FIG. 24 illustrating the stringer 82 to isolator plate 11 moment connection and the floor plate 80 to stringer 83 pinned simple support connection, respectively. Since stringers 82 and 83 are superimposed on isolator plate 11, in this embodiment the vertical clearance of assembly 10F is H−(T+S), where S is the depth of the stringers. The stringers and floor plates have more distributed supports, and dimensions T and S can be reduced or X and Y increased. Such increase would reduce understructure requirement although not in total load bearing capacity.

FIG. 25 is a sectional view taken alone line o-o of FIG. 24 illustrating a preferred attachment of stringer 82 to isolator plate 11 using angle plate 85, in which stringer 82 is set onto isolator plate 11 and cap screw 86 secures an end of angle plate 85 to isolator plate 11 and bolt 87 secures an opposing end of angle plate 85 to stringer 82, with the understanding the a plurality of such connection points are used in conjunction therewith, in which the structure of only one connection point is shown for illustrative purposes. Laid on top of stringer 82 is floor plate 80, which is held there by gravity. FIG. 26 is a sectional view taken alone line p-p of FIG. 24 illustrating two floor plates 80 mounted over stringer 83, in which one of the floor plates is secured by, for instance, a self tapping screw 88, with the understanding the a plurality of such connection points are used in conjunction therewith, in which the structure of only one connection point is shown for illustrative purposes.

Figure 27:
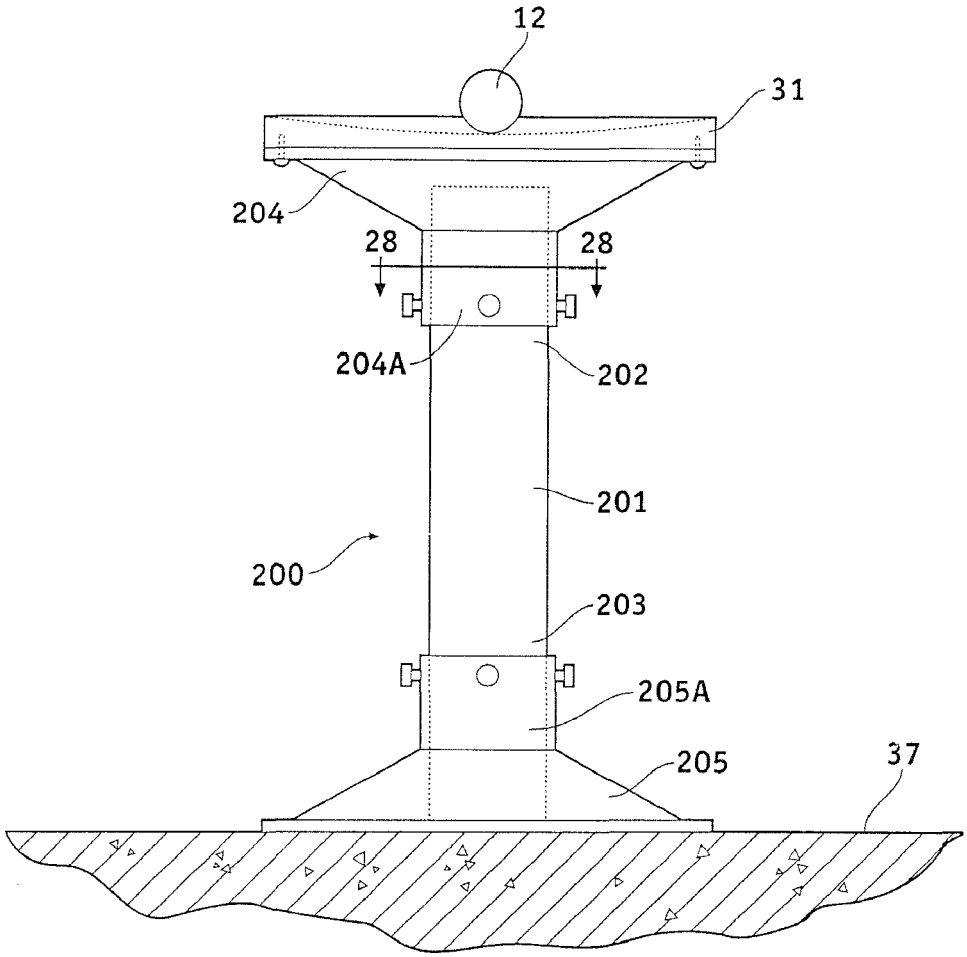
FIG. 27 is a side elevational view of a pedestal for use with a seismic isolation access floor assembly constructed and arranged in accordance with the principle of the invention.
Figure 28:
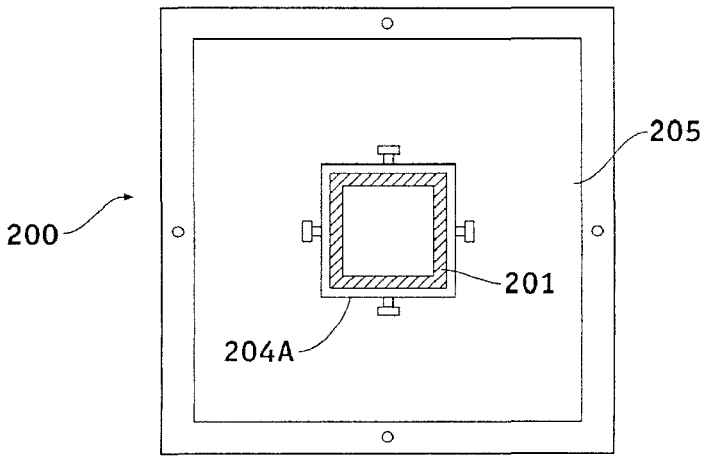
FIG. 28 is a sectional view taken along line 28-28 of FIG. 27.

It is to be understood that the dimensions set forth herein in the embodiments thus far discussed are preferred dimensions, and that other dimensions may be used without departing from the nature and scope of the invention. Also, FIGS. 27 and 28 show another embodiment of a pedestal 200 that may be used for supporting a bearing plate 31 of an isolator component of an access floor assembly constructed and arranged in accordance with the principle of the invention. Referring first to FIG. 27, pedestal 200 is the single support structure for plate 31 including an elongate column 201 having opposing upper and lower ends 202 and 203. Upper end 202 is received into a socket 204A of an upper fixed base column support 204 and is secured thereto with screws or prying bolts. Lower end 203 is received into a socket 205A of a lower fixed base column support 205 and is secured thereto with screws or prying bolts. Plate 31 is set onto upper fixed base column support 204, and onto which ball 12 is set for receiving an isolator plate (not shown) thereon. Ball 12 is positioned on plate 31 for illustrative purposes and for reference and understanding. Lower fixed base column support 205 is positioned against base floor 37 and fastened thereto, such as with a suitable adhesive and/or one or more mechanical fasteners, welding, etc. As a matter of illustration, FIG. 28 is a sectional view taken along line 28-28 of FIG. 7 illustrating socket 204A and upper end 202 extending therethrough.

Also, the floor plates of the various embodiments of the invention thus far discussed, and those to be discussed in the balance of this disclosure, may incorporate windows, doors, ventilation holes, grillage, or the like, if desired, including in their removable inserts should they be incorporated therewith.

Reference is now made to FIG. 29, which is a top plan view of a further embodiment of a seismic isolation access floor assembly 300 constructed and arranged in accordance with the principle of the invention, which consists of alternating courses A and B of plates, in which the plates consist of interconnected floor plates 302 and 303 and isolator plates 11. As previously disclosed, isolator plates 11 form seismic isolation components, and together with floor plates 302 and 303 form access floor 300'. Plates 302, 303, and 11 are mechanically interconnected with framing, bolts, rivets, pins, or the like. Plates 302, 303, and 11 can be rigidly affixed together, if desired. Alternatively, framing or framing elements, such as beams, brackets, or the like, may be coupled between isolator plates 11 and floor plates 302 and 303, onto which floor plates 302 and 303 are removably positioned.

Floor 300' can be used alone, or may be used as the underlying support for additional plates set thereon. Plates set onto floor 300' may be mechanically secured to floor 300', or simply set onto floor 300'. If framing is used between isolator plates 11 and floor plates 302 and 303, additional floor plates set onto floor 300' may be mechanically secured to the framing. Additional floor plates set onto floor 300' can be secured together with brackets or the like, which may in turn be coupled to isolator plates 11, such as with brackets or the like. A sub-floor may first be set onto floor 300' onto which additional plates may be set and secured. The sub-floor can simply be set onto floor 300', or mechanically secured thereto with bolts, screws, adhesive, brackets, or the like. Plates positioned on a sub-floor set onto floor 300' may simply be set onto the sub-floor, or mechanically secured thereto with bolts, screws, adhesive, brackets, or the like.

In general, each course A of floor 300' consists of floor plates 302 and isolator plates 11, and each course B of floor 300' between adjacent courses A consists of floor plates 303, which are each roughly double the size of each floor plate 302 and each isolator plate 11 simply as a matter of example. Isolator plates 11 constitute seismic isolation components of floor 300' and together provide floor 300' with seismic isolation. In FIG. 29 only a portion of floor 300' is illustrated, with the understanding that any number of courses A and B can be used as needed for providing a floor having any specified surface area.

Floor 300' is separated from a wall 305 a distance denoted by D' in FIG. 29. Wall 305 is a stationary wall built over a base floor referenced in FIG. 30 at 306. Base floor 306, which is preferably a concrete base floor, supports a substructure that in turn supports floor 300' at an elevated location relative to base floor 306. When seismic activity shakes floor 300', isolator plates 11, and the structure associated therewith to be presently described, permits floor 300' as a whole to displace and move laterally or otherwise horizontally relative to base floor 306 from its normal resting state and then restore to its normal resting state after the movement activity discontinues thereby providing floor with seismic isolation.

According to the principle of the invention, an expansion joint 310 is coupled between the perimeter of floor 300' and wall 305. Expansion joint 310, which is depicted in FIG. 30, spans distance D' between floor 300' and wall 305 and maintains continuity between wall 305 and floor 300' during periods of seismic activity. Expansion joint 310 consists of a plurality of plates coupled between floor 300' and wall 305, in which only one is shown as a matter of example with the understanding that the ensuing discussion applies to each plate forming the expansion joint.

Plate 311 is coupled between floor 300' and wall 305, and includes an end 312 affixed to wall 305 with a hinge 314, and an opposing end 313 positioned atop floor 300'. End 313 of plate 311 rides over floor 300' in friction contact. When floor 300' displaces laterally due to seismic activity, floor 300' moves relative to plate 311, in accordance with the principle of the invention, in which end 313 of plate 311 slides over floor 300' as floor 300' moves. Hinge 314 provides pivotal movement of plate 310 between lowered and raised positions, which accommodates uplift and downlift to accommodate the bearing rise and fall of floor 300' during seismic activity. If desired, hinge 314 may be spring-loaded for taking up a portion of the load of plate 311. Any suitable form of hinge may be used for hinge 314 for providing hinged/pivotal movement of plate 310. Although only one hinge is illustrated coupling plate 311 to wall 305, more can be used.

With continuing reference to FIG. 30, the substructure supporting floor 300' consists of pedestals 320 which are each anchored between base floor 306 and a corresponding isolator plate 11. Pedestals are structurally identical relative to each other, and different geometries can be used, if desired, consistent with the teachings set forth herein.

Each pedestal 320 has a top head or plate 321 fastened to the underside of a bearing plate 322. Top plate 321 is rigidly coupled to bearing plate 322. Fasteners and/or adhesive may be used to secure top plate 321 to bearing plate 322, although welding may be used, if desired. The isolator plate 11 rests on a ball 12 positioned between isolator plate 11 and bearing plate 322. Top plate 40 is rigidly secured to an upper end 323 of an upstanding stud 324 having a lower end 325 rigidly coupled to base floor 306. Stud 324 is fashioned with an adjustable counter threaded nut 326 for providing height adjustability for pedestal 320 between shortened and lengthened conditions.

Figure 31:
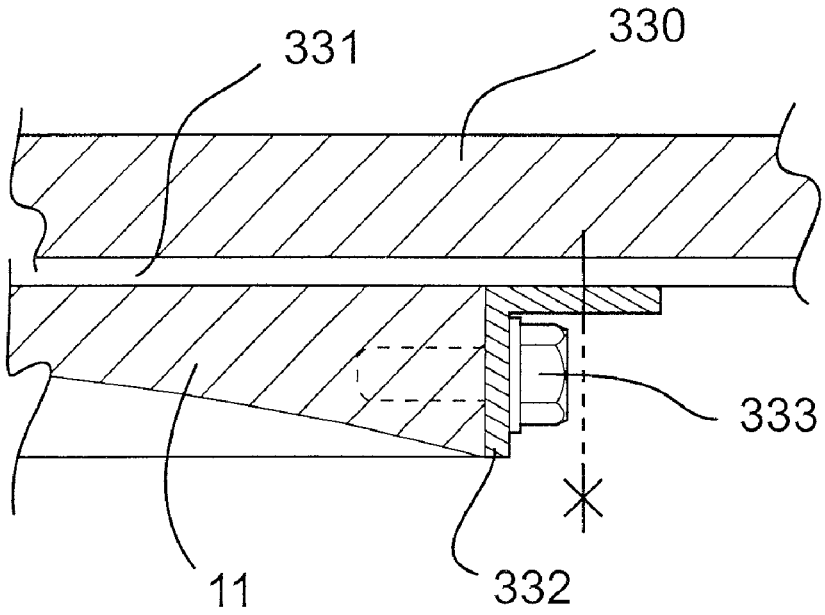
FIG. 31 is a vertical sectional view of an isolator plate of the seismic isolation access floor assembly of FIG. 29 illustrating a floor plate set on a sub-floor positioned on an isolator plate.

As previously explained, floor 300' may be used alone, or may constitute the underlying support for additional plates to be set thereon as previously explained. As a matter of example, FIG. 31 is a vertical sectional view of an isolator plate 11 of floor 300' of FIG. 29 illustrating a floor plate 330 set on a sub-floor 331 positioned on the isolator plate 11. In FIG. 31, a frame 332 is affixed to isolator plate 11 with a fastener, which in this instance is a bolt 333, and sub-floor 331 rests not only on isolator plate 204 but also on frame 332. Sub-floor 331 may be mechanical secured to the top side of isolator plate 11, and/or to frame 332.

Figure 32:
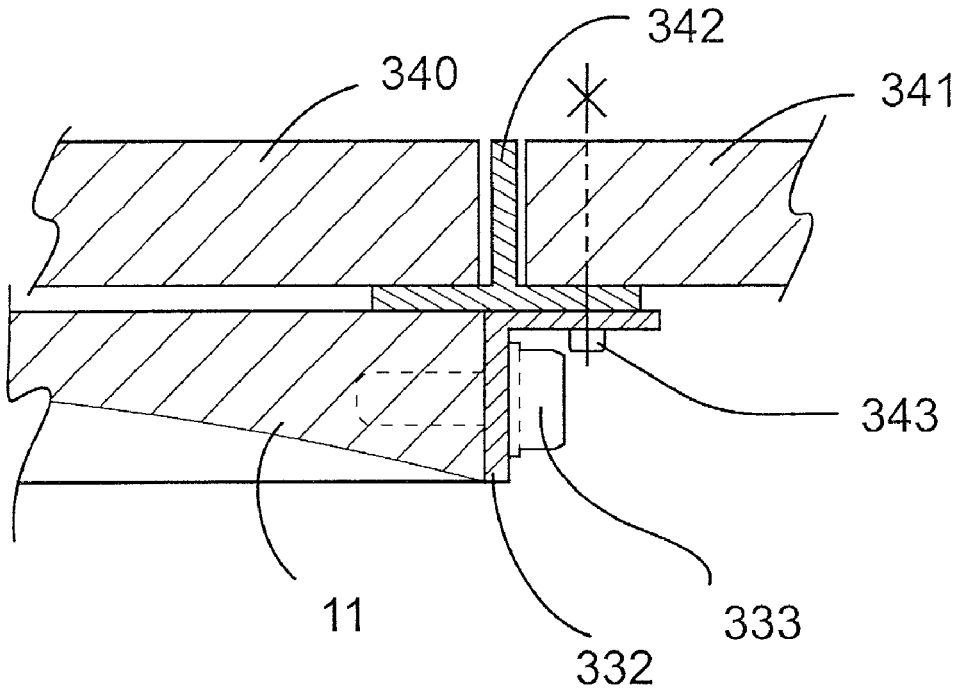
FIG. 32 is a vertical sectional view of an isolator plate of the seismic isolation access floor assembly of FIG. 29 illustrating floor plates positioned on a frame set onto the isolator plate.

FIG. 32 is a vertical sectional view of an isolator plate 11 of floor 300' of FIG. 29 illustrating adjacent floor plates 340 and 341 positioned on a frame 342 set onto the isolator plate 11. In the embodiment set forth in FIG. 32, frame 332, which was first referenced in FIG. 31, is affixed to isolator plate 11 with bolt 333, and frame 342 is concurrently set onto isolator plate 11 and frame 332. Frame 342 may be mechanical secured to the top side of isolator plate 11, and or to frame 332, such as with a bolt 343 in this immediate embodiment or other suitable mechanical fastener. In FIG. 32, plates 340 and 341 are simply set onto frame 342, but may be mechanically secured to frame 342, if desired. FIG. 33 is a vertical sectional view of an isolator plate 11 of floor 300' of FIG. 29 illustrating floor plates 350 and 351 set thereon and secured together with a bracket 352, which is in turn affixed to the isolator plate 11 with a bracket 353.

In FIG. 30, floor 300' is shown positioned atop pedestals 320, which serve as the supporting structure between floor 300' and base floor 306. If desired, floor 300' can be set onto base floor 306 as shown in FIG. 34 thereby forming an exemplary embodiment of the invention. FIG. 34 is a fragmented vertical sectional view of floor 300' shown as it would appear positioned on base floor 306. In FIG. 34, the isolator plate 11 rests on ball 308 positioned directly on base floor 306 without the provision of a bearing plate. A floor plate 354 is set onto isolator plate 11, and a hinge 355 is coupled between, on the one hand, floor plate 354 and isolator plate 11 and, on the other hand, an inner end 356 of a ramp 357 having an outer end 358 set onto base floor 306. Ramp 357 provides convenient access between base floor 306 and floor 300'. Ramp 357 can be coupled between a base floor and any of the access floor assemblies herein described for providing access between the respective access floor assembly and the base floor associated therewith.

According to the principle of the invention, a retainer 360 is mounted to base floor 306 and underlies isolator plate 11. Retainer 360 is rigidly mounted to base floor 360, such as with rivets, threaded fasteners, adhesive, or the like. Retainer 360, which is also illustrated in FIG. 34A, is formed with an opening 361, which, in the present embodiment, is substantially centrally located. As illustrated in FIG. 34, ball 308 is situated in opening 361, whereby retainer 360 captures ball 308 at opening 361 and retains ball 308 relative to base floor 306 preventing ball from uncontrollably rolling relative to base floor 306, and also serves to locate ball 308 the desired location relative to isolator plate 11. Retainer 360 can be fashioned of rigid material, such as steel, aluminum, titanium, plastic, or other selected rigid material or combination of materials. Preferably, and in accordance with a preferred embodiment, retainer 360 is fashioned of compliant material, rubber or other selected elastomeric material, foam, or the like, which provides damping between ball 308 and retainer 360 and also noise dampening. Furthermore, retainer 360 can be fashioned of a combination of rigid and compliant materials as may be desired. In fact, it can be advantageous to form retainer 360 of compliant material at opening 361 encircling ball 308, and the remainder of retainer 360 of rigid material. Forming retainer 360 of compliant material at opening 361 accommodates the seismic displacement of ball 308 as displaces in response to a seismic event, which contributes to the seismic isolation of floor plate 354.

In size retainer 360 is substantially coextensive relative to isolator plate 11. Retainer 360 is a broad, flat body having an outer perimeter 365 formed with alternating keys 366 and keyways 367, much like a piece to a puzzle. A plurality of retainers constructed in accordance with retainer 360 can be provided, mounted to a base floor, such as base floor 306, and puzzled together by engaging the keys and keyways of each retainer to the corresponding keyways and keys of the adjacent retainers forming a mat of interconnected retainers, each of which may be used in conjunction with an isolator plate of a floor according to the teachings specified in connection with retainer 360.

Figure 35:
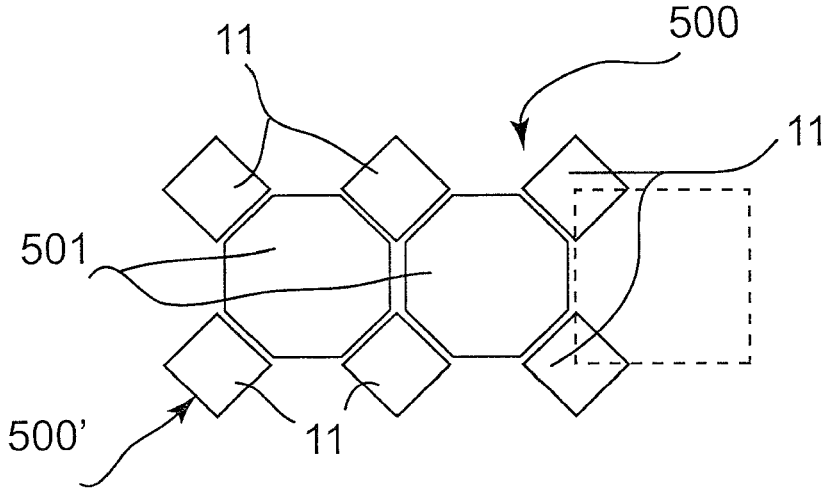
FIG. 35 is a top plan view of a seismic isolation access floor assembly constructed and arranged in accordance with a yet a further alternate embodiment of the invention.

Reference is now directed to FIG. 35, which is a partially schematic a top plan view of a section of a seismic isolation access floor assembly 500 constructed and arranged in accordance with yet another alternate embodiment of the invention. In this embodiment, floor assembly 500 consists of interconnected floor plates 501 and isolator plates 11, which together form access floor 500'. In shape, isolator plates 11 are square, and floor plates 501 are octagonal. Isolator plates 11 are set on alternating sides of floor plates 501. Isolator plates 11 form seismic isolation components of floor 500'. Isolator plates 11 are spaced apart in a predetermined pattern as illustrated, and floor plates 501 are positioned in the spaces formed between isolator plates 11. Each floor plate 501 is surrounded by four, equally spaced-apart isolator plates 11, and each isolator plate 11 is surrounded by four floor plates 501. In FIG. 35, only a portion of access floor assembly 500 is shown, with the understanding that the components of access floor assembly 500 can be multiplied as need for providing an access floor having any specified surface area.

Figure 36:
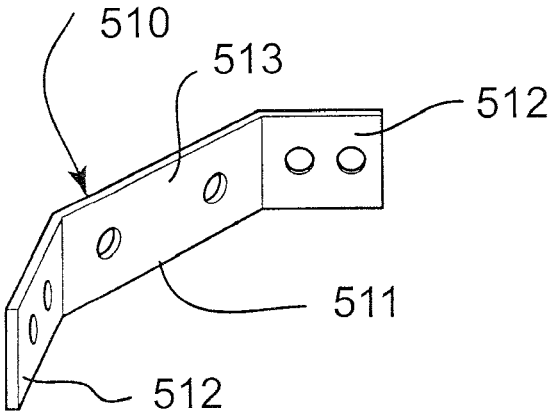
FIG. 36 is a perspective view of a coupling used to mechanically secure isolator plates of the seismic isolation access floor assembly of FIG. 35.
Figure 37:
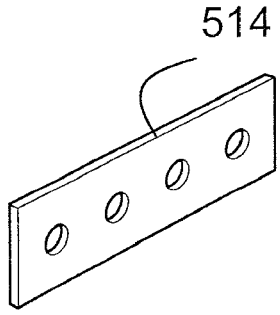
FIG. 37 is a perspective view of a reinforcing bar that may be spliced onto the coupling of FIG. 36 for strength enhancement.

Each isolator plate 11 is coupled to each adjacent isolator plate 11 with a coupling 510, which is illustrated in FIG. 36. Coupling 510 is an elongate band 511 having opposed tags 512 adapted to be secured to opposed isolator plates 11 with fasteners, such as bolts, rivets, pins, or the like, and an intermediate section 513. Each coupling 510 is coplanar with the isolator plates 11 to which it is attached, and has sufficient out-of-floor plane rigidity for resisting moments induced by uneven deflection of the isolator plates 11. If desired, intermediate section 513 can be secured to adjacent floor plates 501, and this is actually beneficial for bolstering the in-plane rigidity. Also, intermediate section 513 can be reinforced with a reinforcing bar 514 depicted in FIG. 37 for increasing the strength of coupling 510, if desired.

Figure 38:
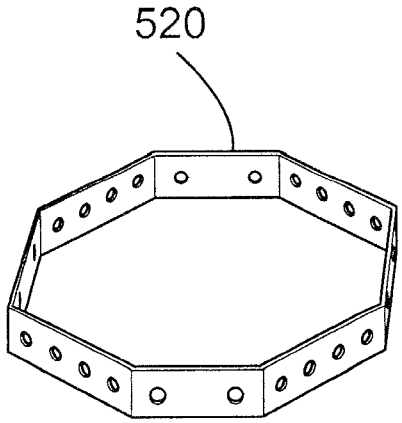
FIG. 38 is a perspective view of a framing member used to mechanically secure floor plates to isolator plates of the seismic isolation access floor assembly of FIG. 35.

Referring to FIG. 38, a continuous framing member 520 is shown, which is used to couple floor plates 501 to isolator plates 11. Framing member 520 is basically a continuous loop, which is formed to encircle a floor plate 501. Because each floor plate 501 is octagonal in shape, so is framing member 520. Framing member 520 is formed with holes, which are used to accept fasteners, such as bolts or rivets or the like, for concurrently securing framing member 520 to floor plate 52 and to the isolator plates 11 associated with the floor plate 501.

Figure 39:
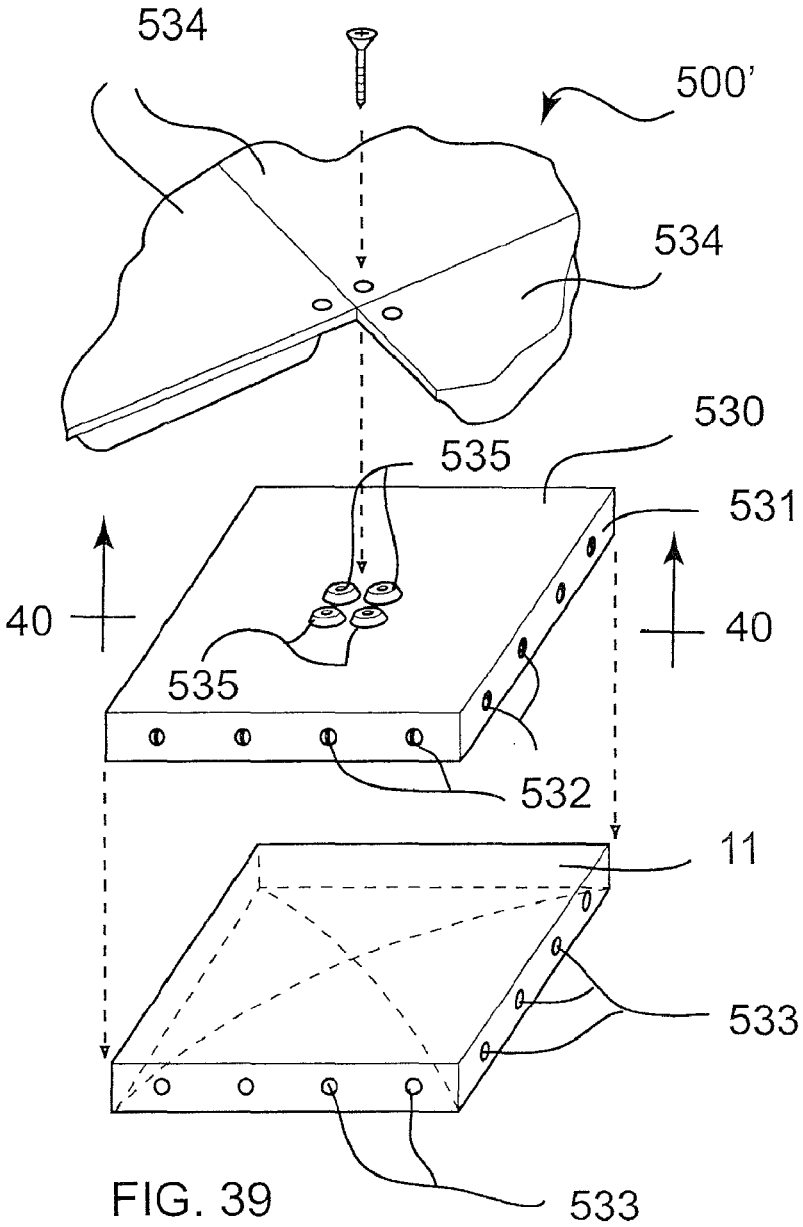
FIG. 39 is a fragmented exploded view of a portion of the seismic isolation access floor assembly of FIG. 35 illustrating floor plates and an isolator plate disposed on either side of a cover plate.

Floor plates can be mounted atop the isolator plates 11 of the seismic isolation access floor assembly 500 of FIG. 35, and FIG. 39 illustrates this aspect in a preferred embodiment of the invention. In FIG. 39, floor plates 534 and one isolator plate 11 are shown positioned on either side of a cover plate 530. Cover plate 530 is broad and flat, and is formed with a continuous sidewall 531 depending downwardly from the outer extremities of plate 530. Sidewall 531 is formed with holes 532, which match corresponding holes 533 formed in the outer edges of isolator plate 11. Plate 530 is set over isolator plate 11, in which continuous sidewall 531 encircles the outer edges of isolator plate 11, and in which the holes formed in sidewall 531 register with the holes formed into the edges of isolator plate 11. The corresponding holes in sidewall 531 and isolator plate 11 accept fasteners, such bolts or rivets or the like, for securing cover plate 530 to isolator plate 11.

Figure 40:
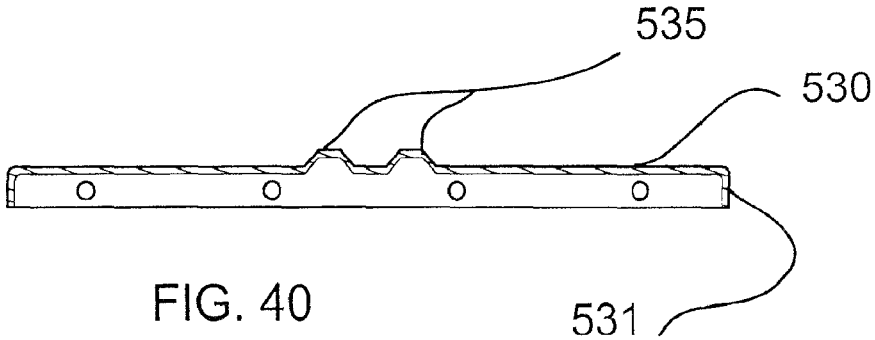
FIG. 40 is a sectional view taken along line 40-40 of FIG. 39.

Cover plate 530 is formed with centrally-located upwardly projecting protuberances 532 (see also FIG. 40). Protuberances 532 are formed with tapped holes, which register with corresponding holes formed in floor plates 534 set onto isolator plate 11, which concurrently accept fasteners, such as screws or bolts or rivets or the like, for securing floor plates 534 to isolator plate 11. After floor plates 534 are attached to isolator plate 11 with cover plate 530, floor plates 534 bolster the in-plane rigidity of floor 500'.

Figure 41:
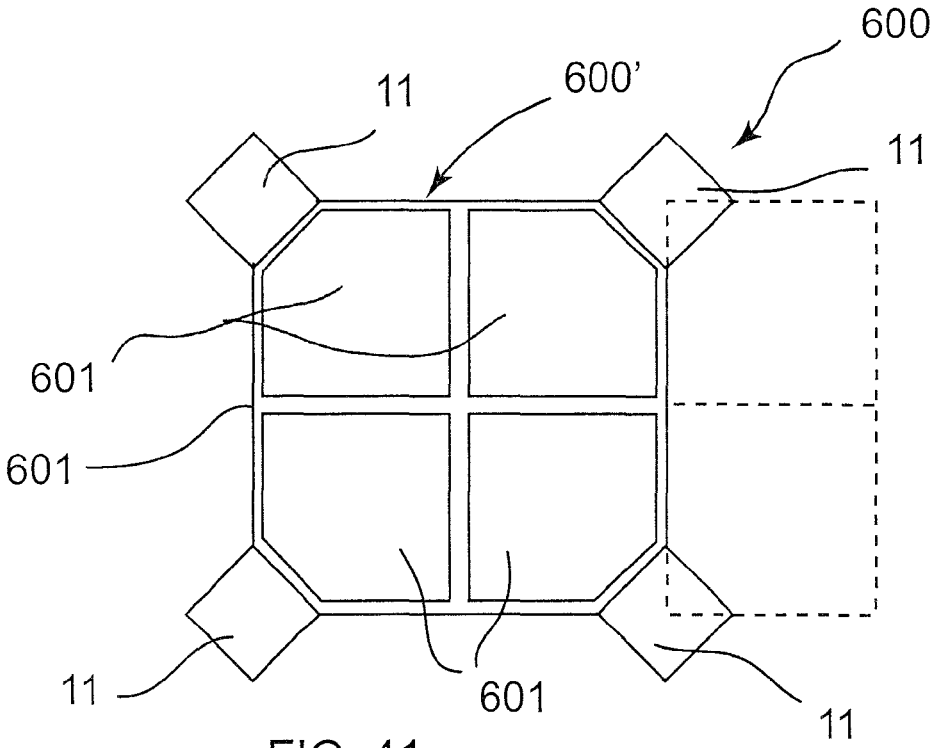
FIG. 41 is a top plan view of a seismic isolation access floor assembly constructed and arranged in accordance with still a further alternate embodiment of the invention.

Floor assembly 500 has seismic isolation support surrounding each floor plate, which results in low isolator forces and economical seismic isolation. Some installations may take advantage of isolation supports surrounding not just one but a plurality of floor plates. To illustrate this, attention is now directed to FIG. 41, which is a top plan view of yet another alternate embodiment of a seismic isolation access floor assembly 600 consisting of floor plates 601 surrounded by isolator plates 11 that together form an access floor 600'. Isolator plates 11, as with the previous embodiments, form seismic isolation components of floor 600'. In this embodiment, isolator plates 11 are in plane with a rigid planar frame 603, which is rigidly affixed to isolator plates 11. The rigid attachment between frame 603 and isolator plates 11 causes frame 603 to form an out-of-plane moment resistant structure that supports conventional access floor plates 604 set thereon. Frame 603 has welded corners and is rigid in the X, Y, and Z directions. The floor assembly embodiment depicted in FIG. 41 is instructive for showing isolator plates providing seismic isolation to a frame onto which is positioned a plurality of floor plates. Again, floor plates can be simply set onto frame 603, or mechanically affixed thereto.

Figure 42:
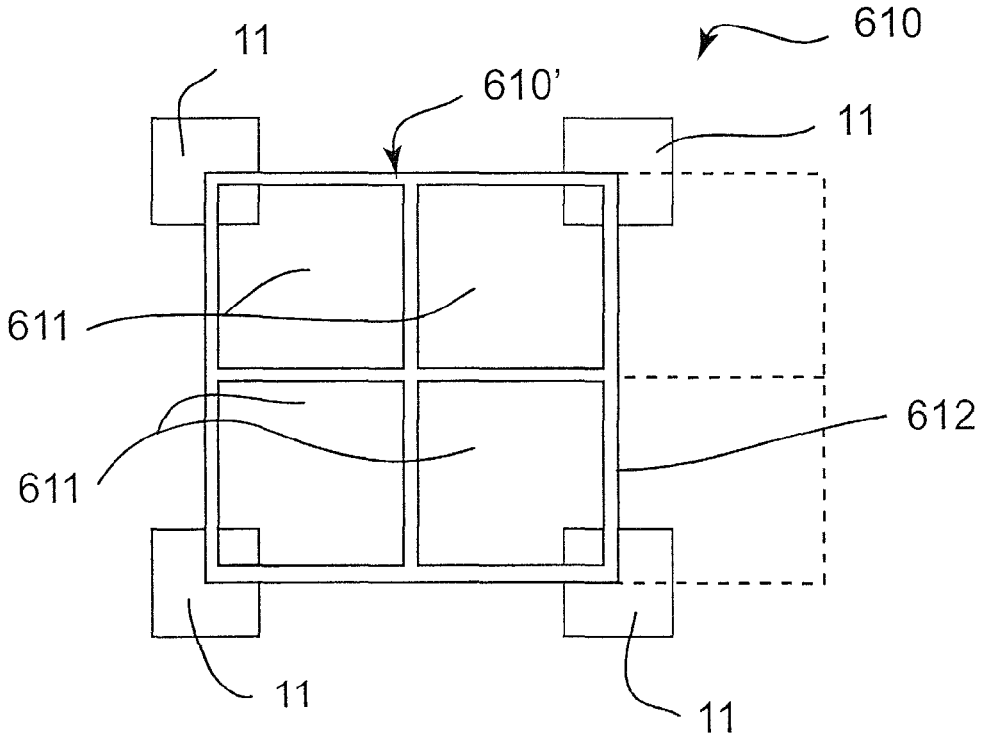
FIG. 42 is a top plan view of a seismic isolation access floor assembly constructed and arranged in accordance with yet still a further alternate embodiment of the invention.

FIG. 42 is instructive of yet another embodiment of a seismic isolation access floor assembly 610 consisting of floor plates 611 and isolator plates 11 that together cooperate forming an access floor 610'. Isolator plates 11, as with the previous embodiments, form seismic isolation components of floor 610'. In this embodiment, a planar frame 612 is set directly onto isolator plates 11, and is rigidly affixed thereto with suitable mechanical fasteners forming a rigid support structure, according to the principle of the invention. Frame 612 supports conventional access floor plates 611 set thereon. The embodiment depicted in FIG. 42 is instructive for showing isolator plates 11 providing seismic isolation to a frame 612 set thereon and onto which is positioned a plurality of floor plates 611. Floor plates 611 can be simply set onto frame 612, or mechanically affixed thereto.

Figure 43:
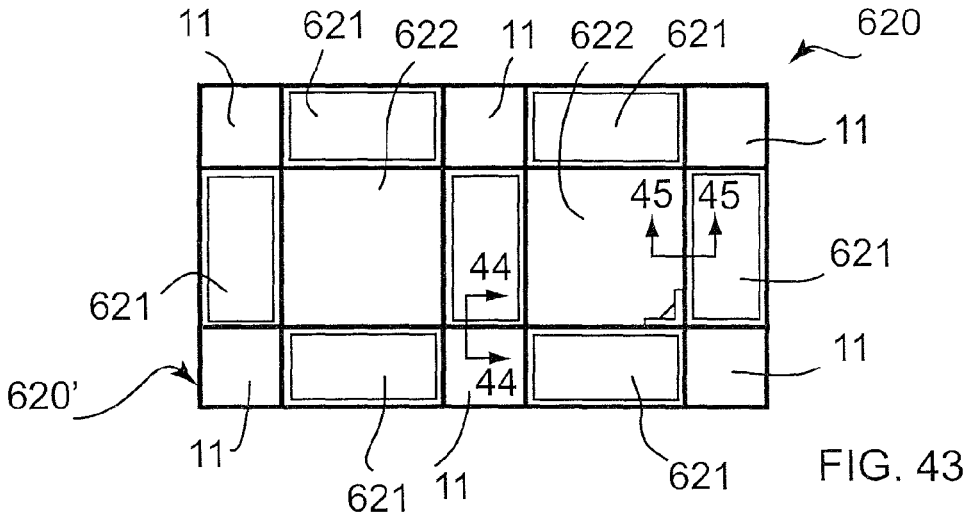
FIG. 43 is a top plan view of a seismic isolation access floor assembly constructed and arranged in accordance with another alternate embodiment of the invention.

Referring now to FIG. 43 there is seen yet another embodiment of a seismic isolation access floor assembly 620 consisting of minor floor plates 621, major floor plates 622, and isolator plates 11, which together cooperate forming an access floor 620'. Isolator plates 11, as with the previous embodiments, form seismic isolation components of floor 620'. In the embodiment set forth in FIG. 43, isolator plates 11 are rigidly interconnected by a rigid ledger frame 623, which in turn supports major floor plates 622 and minor floor plates 621. Preferably, floor plates 621 and 622 and isolator plates 11 are mechanically fastened to ledger frame 623. Floor plates 621 and 622 are preferably removable for cable, wire and conduit access.

Figure 44:
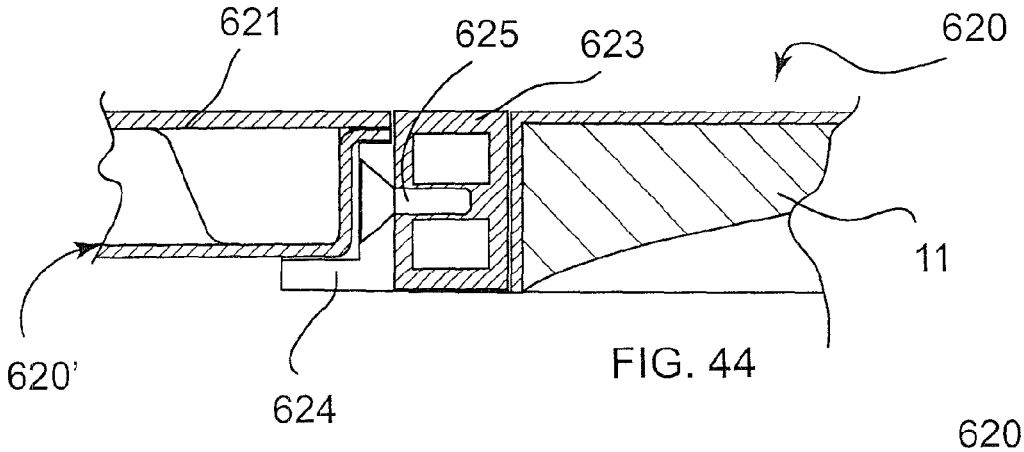
FIG. 44 is a vertical sectional view of an attachment point between an isolator plate and a floor plate of the seismic isolation access floor assembly of FIG. 43.

Turning to FIG. 44, which is a sectional view taken along line 44-44 of FIG. 43, there is illustrated a connection point between isolator plate 11 and floor plate 621, with the understanding the a plurality of such connection points are used in conjunction therewith and that the structure of only one connection point is shown for illustrative purposes. In FIG. 44, one side of isolator plate 11 is affixed with bolts or other suitable fasteners to one side of ledger frame 623. A bracket 624 is secured to the opposing side of ledger frame 623 with a fastener, which in this instance is a bolt 625, although a cap screw or other suitable mechanical fastener can be used, if desired. Plate 621 is set onto bracket 624, and is fastened thereto with mechanical fasteners, such as bolts, etc.

Figure 45:
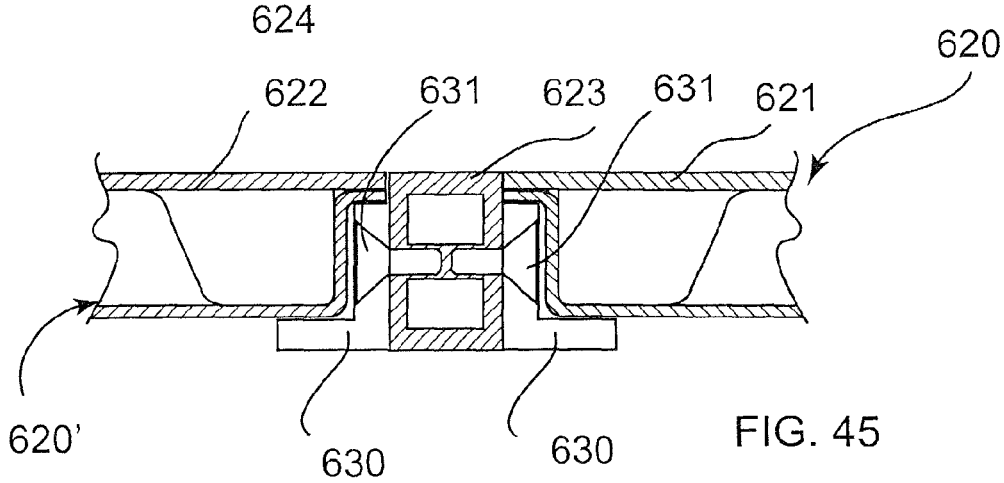
FIG. 45 is a vertical sectional view of an attachment point between floor plates of the seismic isolation access floor assembly of FIG. 43.

Turning to FIG. 45, which is a sectional view taken along line 45-45 of FIG. 43, there is illustrated a connection point between floor plates 621 and 622, with the understanding the a plurality of such connection points are used in conjunction therewith and that the structure of only one connection point is shown for illustrative purposes. In FIG. 45, brackets 630 are secured to either side of ledger frame 623 with fasteners, which in this instance are bolts 631, although cap screws or other suitable mechanical fasteners can be used. Plates 621 and 622 are set onto brackets 630 on either side of ledger frame 623, are secured thereto with bolts or other suitable mechanical fasteners.

Figure 46:
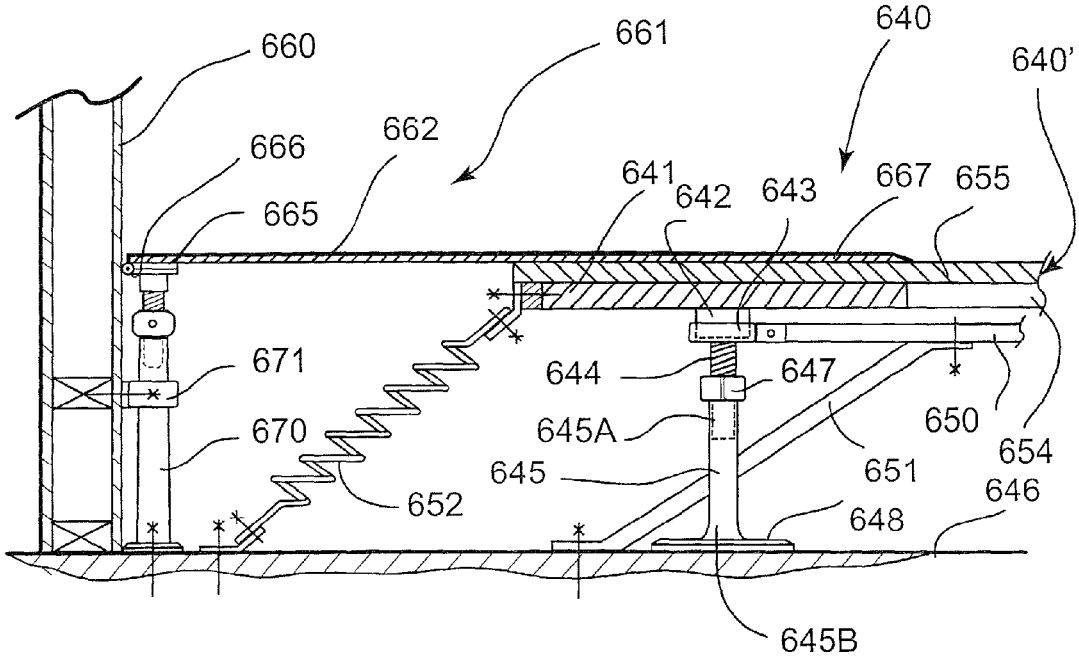
FIG. 46 is a vertical sectional view of a portion of a seismic isolation access floor assembly constructed and arranged in accordance with yet another alternate embodiment of the invention.

The isolator plates set forth in the previously-described embodiments each incorporates a concave cavity designed to receive a ball, whether a compliant ball or a rigid or non-compliant ball. Other types of isolation bearings may be used in conjunction with a seismic isolation access floor assembly, such as in the example set forth in FIG. 46. FIG. 46 is a vertical sectional view of a portion of a seismic isolation access floor assembly 640 incorporating a sliding isolation bearing system and an expansion joint system, which terminates the isolation floor at a wall abutment. While the sliding system of floor assembly 640 has high damping and needs less floor studs, it benefits from braced support framing, an elastic seismic displacement restorer, and a large upper isolator plate, that may be covered with a stainless steel sheet, which interfaces with a Teflon® sliding block, embedded in elastomer material. The sliding isolation system of floor assembly 640, however, does not rise during seismic activation, which somewhat simplifies expansion joint design. The ensuing discussion of floor assembly 640 discusses on a representative portion of floor assembly 640, and it is to be understood that the various components of floor assembly 640 to be herein discussed may be multiplied as needed for forming a floor assembly of any specified size.

Floor assembly 640 consists of an isolator plate 641 supported atop a block 642, which is in turn set into a socket formed in a top plate 643. Top plate 643 is rigidly secured to a relatively short threaded stem 644 that depends downwardly therefrom and is threadably received in the upper end 645A of an upright stud 645 having a lower end 645B fashioned with a load distributor plate 648 rigidly affixed to base floor 646. Threaded nut 647 threadably retains stem 644 at upper end 645A of stud 645. Stem 644 is reciprocally adjustable relative to stud 645, and nut 647 is used to secure stem 644 at whatever position it is adjusted to and thus provides height adjustment for top plate 643 for setting the access floor at a specified height. Although nut 647 is used to secure stem 644 to stud 645, other forms of mechanical devices can be used for providing this function, such as a clamp, a keyed nut, etc.

Top plate 643 is framed by, and mechanically affixed to, a frame 650, which is parallel to base floor 646. Frame 650 is braced to base floor 646 with a diagonal brace 651. Block 642 moves with base floor 646. Friction between block 642 and isolator plate 641 provides damping to this sliding isolation system. Restoring is provided by a restorer 652 coupled between isolator plate 641 of floor assembly 640 and base floor 646, which acts on isolator plate 641 restoring floor assembly 640 after being displaced as a result of seismic activity. If desired, restorer 652 can be coupled to wall 660 rather than base floor 646, in which the function of restorer 652 is the same.

Framing 654 is mechanically affixed to isolator plate 641, and conventional access floor plates 655 are supported by framing 654 and isolator plate 641 thereby forming the floor 640' of floor assembly 640. In the present embodiment, restorer 652 consists of a spring. In other embodiments, restorer 652 can consist of a piston or cylinder, such as a hydraulic piston or cylinder, a pneumatic piston or cylinder, or the like.

According to the principle of the invention, the expansion joint of floor assembly 640, which may be incorporated with any of the seismic isolation access floor assemblies disclosed herein, extends along the perimeter of the floor 640' and is joined to an adjacent wall 660. The expansion joint, which is denoted at 661, is coupled between, and spans the distance between, floor 640' and wall 660, and maintains continuity between wall 660 and floor 640' during periods of seismic activity. Expansion joint 661 consists of a plurality of plates coupled between floor 640' and wall 660, in which only one plate 662 is shown as a matter of example with the understanding that the ensuing discussion applies to each plate forming the expansion joint. Plate 662 is coupled between floor 640' and wall 660, and includes an end 665 affixed to a hinge 666 at wall 660 and an opposing end 667 positioned atop floor 640'. End 667 of plate 662 rides over floor 640' in friction contact. When floor 640' displaces laterally due to seismic activity, floor 640' moves relative to plate 662, in accordance with the principle of the invention, in which end 667 of plate 662 slides over floor 640' as floor 640' moves. Hinge 666 is supported by a floor stud 670 supported by base floor 646, and is secured to wall 660 by an anchor 671, which allows plate 662 to be raised and lowered relative to floor 640' for allowing access underneath floor 640', in accordance with the principle of the invention.

Figure 46A:
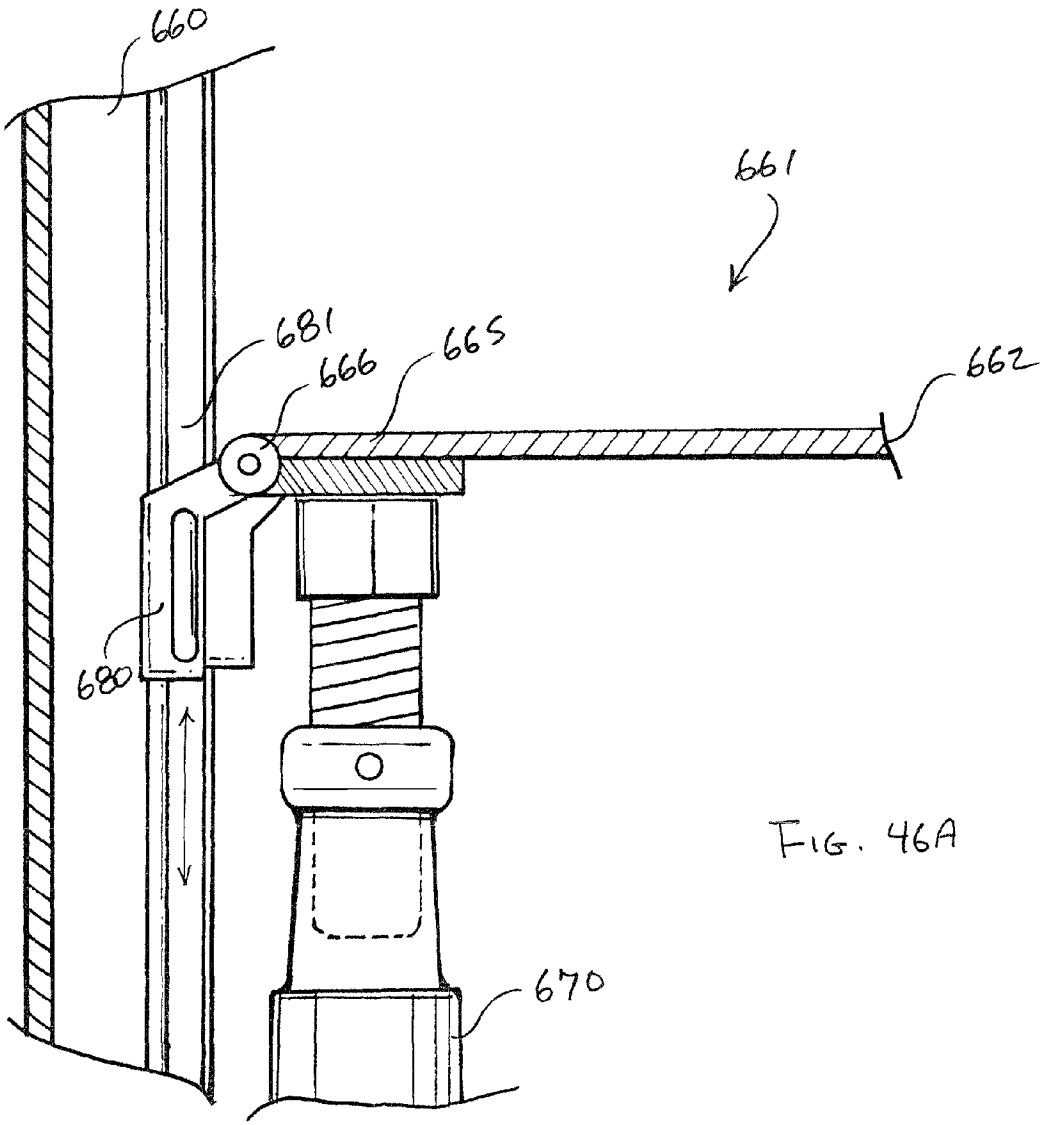
FIG. 46A is an enlarged fragmented perspective view of a hinge of an expansion joint of the seismic isolation access floor assembly of FIG. 46.

FIG. 46A is a fragmented perspective view of hinge 666 of the expansion joint of floor assembly 640 of FIG. 46. Hinge 666 is carried by a coupling 680 mounted to a rail 681 affixed to wall 660. Coupling 680 is mounted to rail 681 for vertical reciprocal movement relative to base floor 646 referenced in FIG. 46, which, in turn, constitutes a mounting of end 665 of plate 662 of the expansion plate to wall 660 for vertical reciprocal movement thereby permitting vertical reciprocal displacement of the expansion joint plate.

Figure 47:
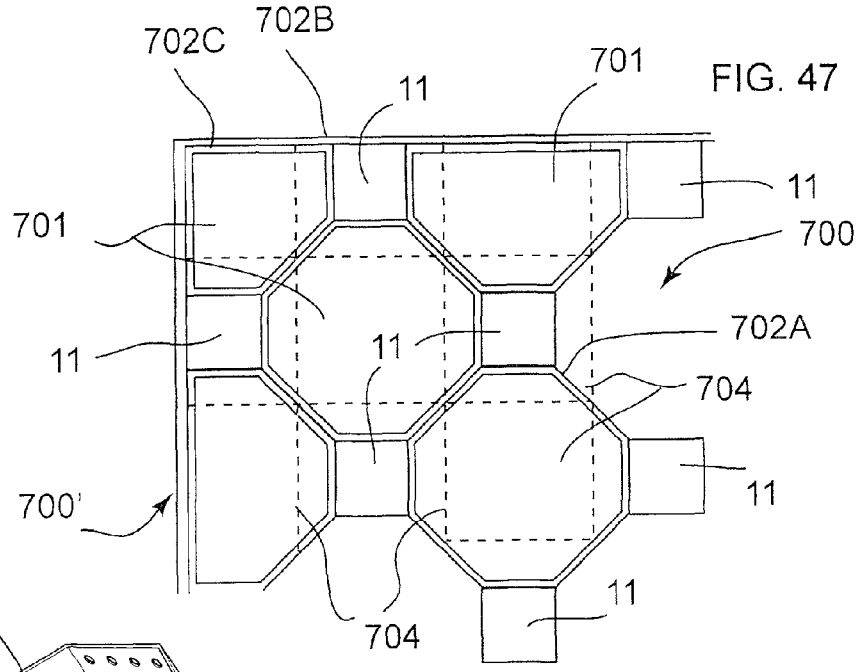
FIG. 47 is a top plan view of a seismic isolation access floor assembly constructed and arranged in accordance with a still another alternate embodiment of the invention.

Reference is now made to FIG. 47, which is a top plan view of a further alternate embodiment of a seismic isolation access floor assembly 700. In this embodiment, floor assembly 700 consists of interconnected floor plates 701 and isolator plates 11, which together form access floor 500'. Isolator plates 11 form seismic isolation components of floor 700'. Isolator plates 11 are spaced apart in a predetermined pattern, and floor plates 701 are positioned in the spaces formed between isolator plates 11. Isolator plates 11 and floor plates 701 are rigidly coupled together with framing, which is denoted generally at 702, and which consists of infield framing 702A, outfield or edge framing 702B, and corner framing 702C. Floor plates or panels 704, which are denoted in dotted outline for illustrative purposes, are set atop floor 700' and are considered part of floor 700'. Floor plates 704 are supported by framing 702, and are rigidly secured thereto, such as with fasteners including bolts or the like.

Figure 48A:
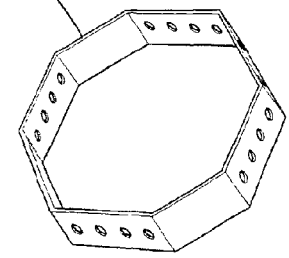
FIGS. 48A-48E illustrate examples of framing elements of framing used to mechanically interconnect floor plates and isolator plates of the seismic isolation access floor assembly of FIG. 47.
Figure 48B:
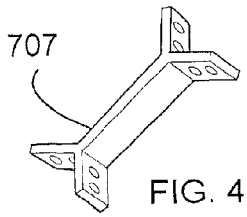
Figure 48C:
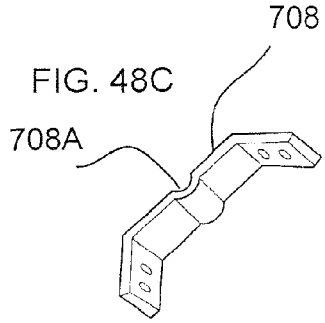
Figure 48D:
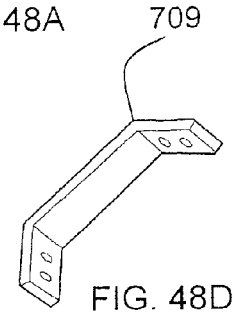
Figure 48E:
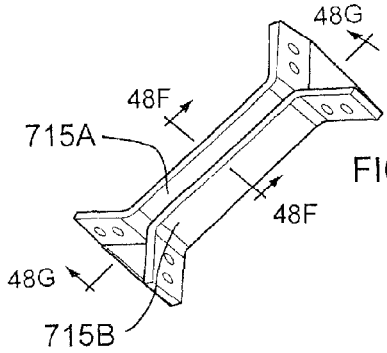
Figure 48F:
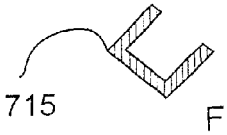
FIG. 48F is a sectional view taken along line 48F-48F of FIG. 48E.
Figure 48G:
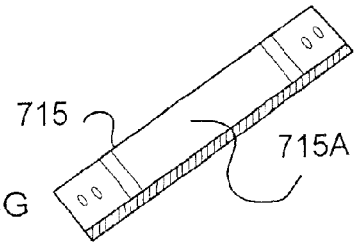
FIG. 48G is a sectional view taken along line 48G-48G of FIG. 48E.

Framing 702 consists of stirrups and tie bars and the like, which are preferably made of cast aluminum or steel or the like and are formed with holes for accepting fasteners. Examples of a stirrup and tie bars constituting framing 702 are set forth as a matter of example in FIGS. 48A-48G. FIG. 48A illustrates a stirrup 706 that is used to secure a floor plate 701 to adjacent floor plates 701 and isolator plates 701. FIGS. 48B-48F set forth examples of tie bars 707, 708, 709, and 715 respectively, which may be used in lieu of stirrups or together with stirrups to mechanically interconnect the floor plates and the isolator plates of floor 700'. Tie bar 708 is formed with a break 708A as a matter of example for accommodating a pedestal supporting floor 700' above a base floor. FIG. 48F is a sectional view of the midsection of tie bar 715 taken along line 48F-48F of FIG. 48E illustrating generally U-shaped cross-section of the midsection of tie bar 715 formed between opposed tie bar elements 715A and 715B of tie bar 715. FIG. 48G is a sectional view taken along line 48G-48G of FIG. 48E illustrating a side elevational view of tie bar element 715A, which is substantially the same as the corresponding side elevational view of tie bar element 715B illustrated in FIG. 48E.

Figure 49A:
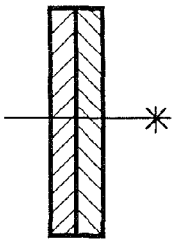
FIGS. 49A-49D illustrate examples of cross-sectional geometries of the framing used to mechanically interconnect floor plates and isolator plates of the seismic isolation access floor assembly of FIG. 47.
Figure 49B:
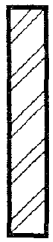
Figure 49C:
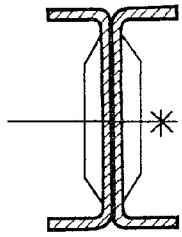
Figure 49D:
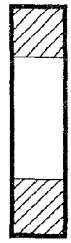

Various parts of framing 702 may have varying cross-sectional geometries, some of which are illustrated as a matter of example in FIGS. 49A-49D. FIG. 48A illustrates a flat bar section, FIG. 48B illustrates a single solid flat bar section, FIG. 48C illustrates a coupled bent plate section, and FIG. 49D illustrates a solid bar section with a hole formed in its midsection to lighten it up and provide it with increased structural rigidity.

Figure 50:
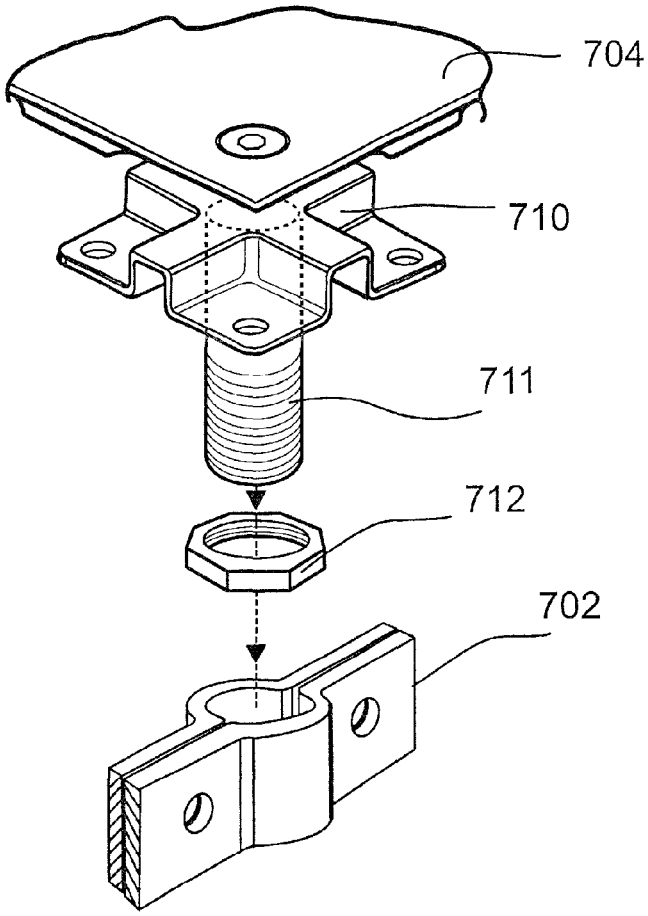
FIG. 50 is an exploded perspective view of a pedestal used to secure floor plates to framing of the seismic isolation access floor assembly of FIG. 47.

Floor plates/panels 704 are supported as they are in conventional non-isolated-access floor assemblies, typically at each corner thereof by a pedestal head 710 as shown in FIG. 50. Pedestal head 710 is secured to a threaded shaft 711, which is threaded to framing 702. A nut 712 is secured between threaded shaft 711 and framing 72 for securing threaded shaft 711 in place disposing pedestal head 710 at a specified height. Nut 712 is threaded onto threaded shaft 711, and not only is used to secure threaded shaft 711 at a specified location for locating pedestal head 710 at a predetermined height, but is, moreover, used to level floor plate 704. FIG. 50 shows just one example of a pedestal for coupling floor plates 704 to frame 702. Those having regard for the art will readily appreciate that there is great variety of pedestal heads (circular, built-up, welded, padded) that may be used in lieu of pedestal head 710 without departing from the invention.

Figure 51:
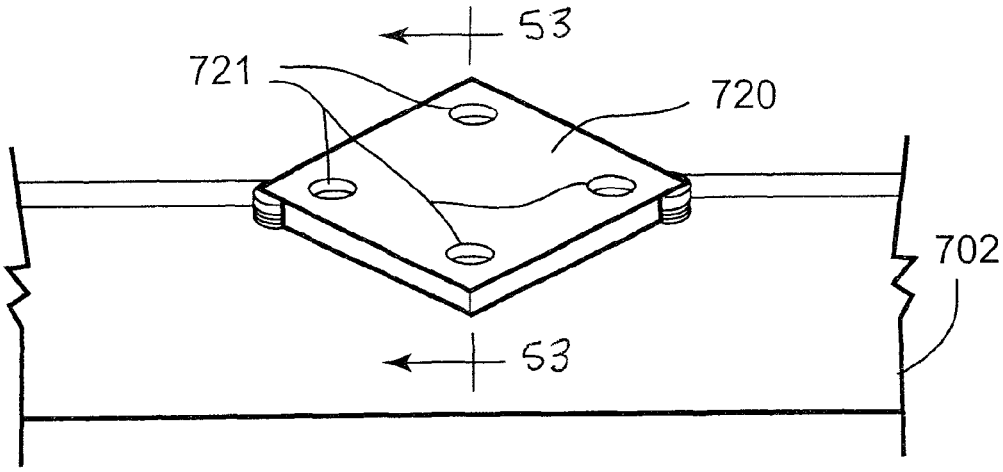
FIG. 51 is a fragmented perspective view of an element of framing of the seismic isolation access floor assembly of FIG. 47 shown configured with a receiver plate used to secure a floor plate set thereon.
Figure 52:
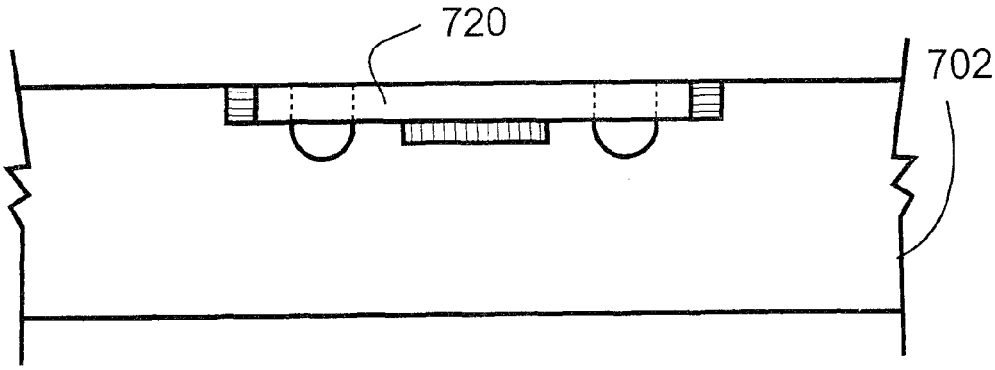
FIG. 52 is a side elevational view of the element of framing set forth in FIG. 51.
Figure 53:
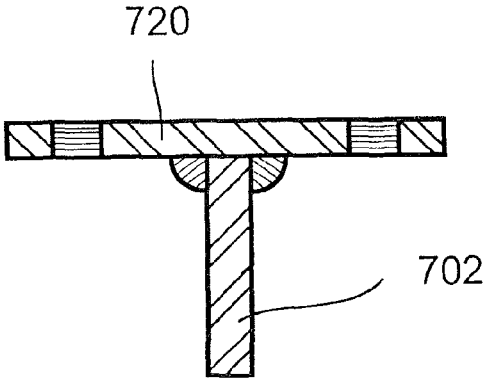
FIG. 53 is a vertical sectional view taken along line 53-53 of FIG. 51.

If desired, framing 702 can be configured with other forms of supporting structure in lieu of pedestals for supporting and securing floor plates/panels 704. As a matter of example, FIG. 51 is a fragmented perspective view of an element of framing 702 shown formed with a receiver plate 720 formed with tapped holes 721 to which the corners of floor panels 704 can be screwed or bolted down. As a matter of illustration, FIG. 52 is a side elevational of the framing 702 element of FIG. 51 illustrating the receiver plate 720, and FIG. 52 is a vertical sectional view of the framing 702 element of FIG. 51 illustrating the receiver plate 720. Other ways of attaching floor plates/panels 704 to framing 702 can be used without departing from the invention.

In a particular embodiment, the framing used to mechanically secure isolator plates to floor plates is integrated with the isolator plates, which results in simplicity, savings in labor and cost and floor height, and which allows more access space utilized for cables, conduits, ducts and junction boxes underneath the floor panels. As with conventional floor panels, isolator plates formed with integrated framing may be fashioned of aluminum alloy castings, steel, etc. Since the isolation bearing portions of such elements need to be stronger than the bracing portions, any voids in the floor may be filled with cementitious infill as similar prior art floor panels are made for high load bearing capacity today.

Figure 54:
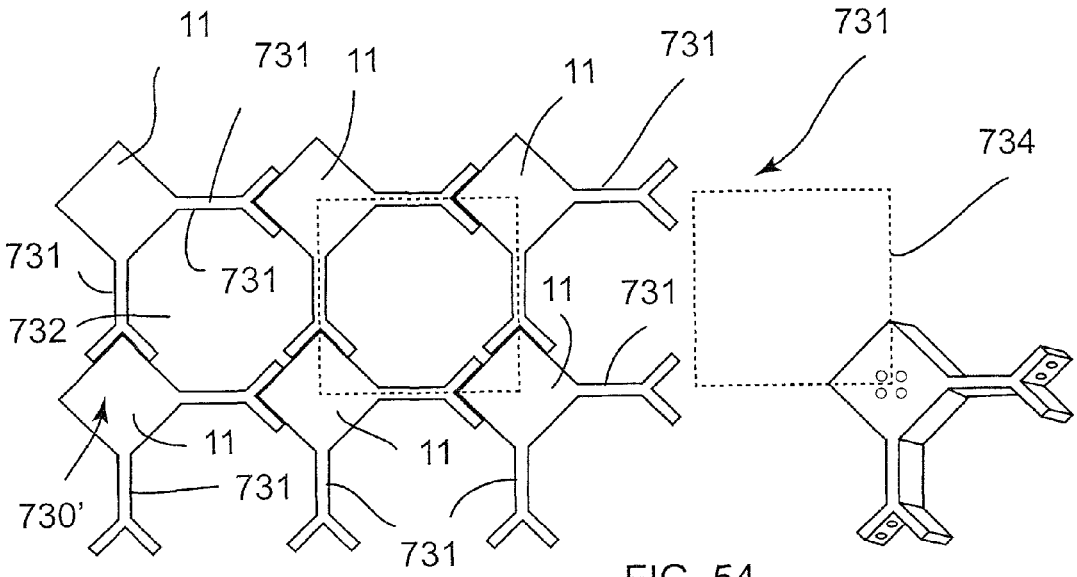
FIG. 54 is a top plan view of a seismic isolation access floor assembly constructed and arranged in accordance with yet another alternate embodiment of the invention.

Seismic isolation access floor assemblies incorporating isolator plates having integrated framing are considered unified systems. FIG. 54 is a top plan view of just such a unified seismic isolation access floor assembly 730. Considering FIG. 54 in conjunction with FIG. 55, which is a sectional view taken along line 55-55 of FIG. 54, floor assembly 730 includes isolator plates 11 each formed with integrated framing 731 mechanically securing isolator plates 11 together and to floor plates 732 forming an access floor 730' onto which floor plates/panels 734 can be set and secured according, for instance, to the system set forth in conjunction with FIG. 39. As with the previous embodiments, isolator plates 11 form seismic isolation components of floor 730'. Isolator plates 11 are spaced apart in a predetermined pattern, and floor plates 732 are positioned in the spaces formed between isolator plates 11. Isolator plates 11 and floor plates 732 are rigidly coupled together with integrated framing 731.

Figure 56:
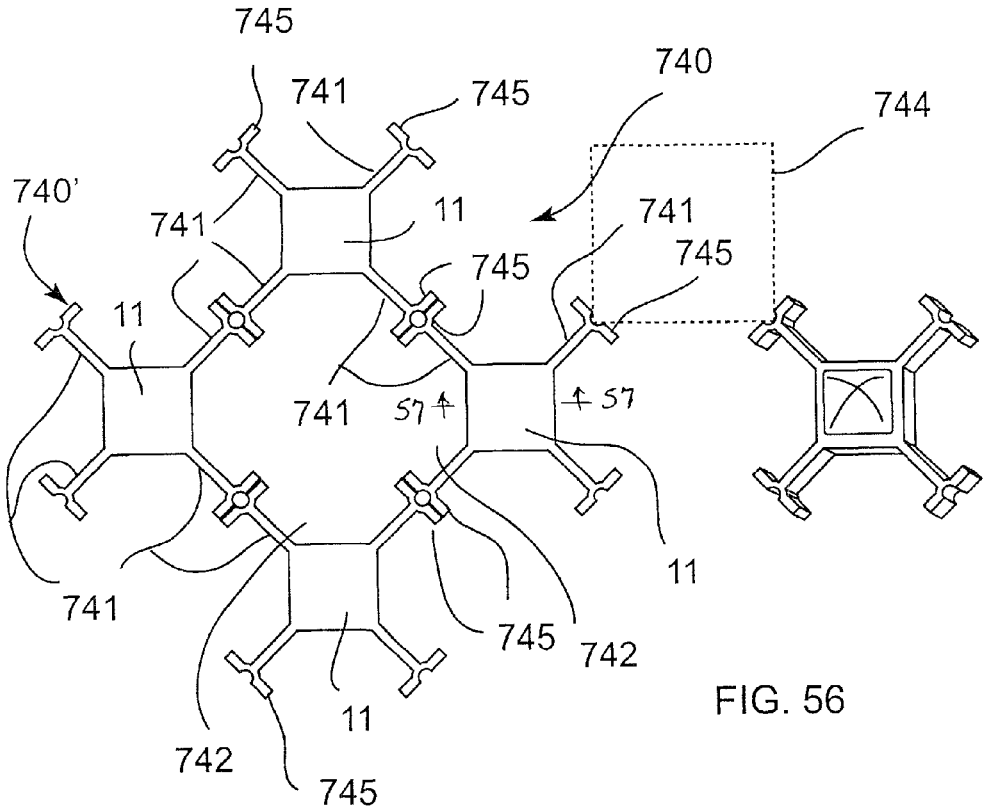
FIG. 56 is a top plan view of a seismic isolation access floor assembly constructed and arranged in accordance with yet still another alternate embodiment of the invention.
Figure 55:
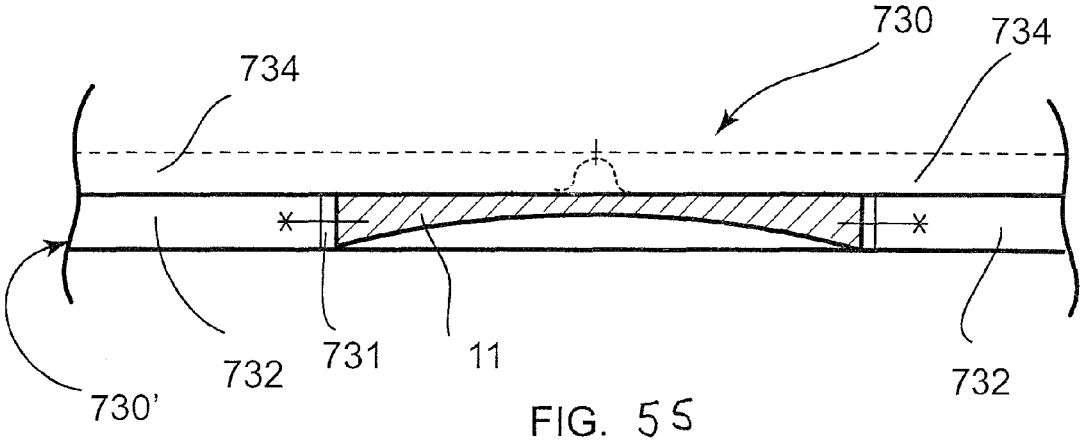
FIG. 55 is a sectional view taken along line 55-55 of FIG. 54.
Figure 57:
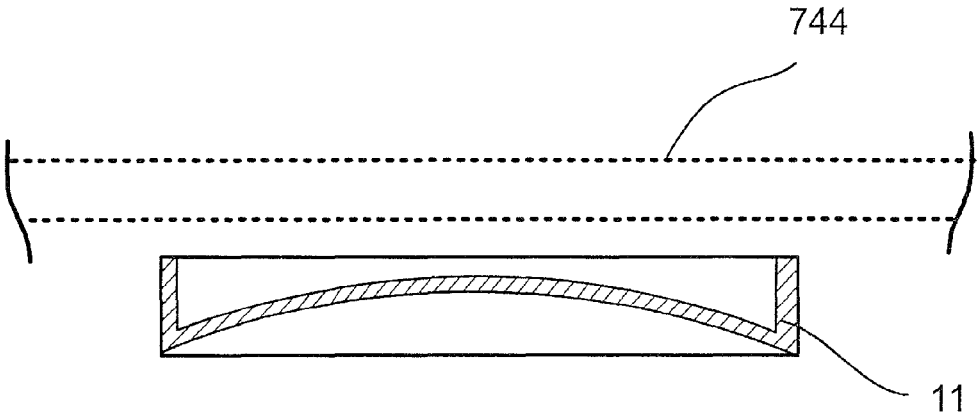
FIG. 57 is a sectional view taken along line 57-57 of FIG. 56.

FIG. 56 is a top plan view of another embodiment of a unified seismic isolation access floor assembly 740 including isolator plates 11 each formed with integrated framing 741 mechanically securing isolator plates 11 together and to floor plates 742 (only one shown) forming an access floor 740' onto which floor plates/panels 744 can be set and secured according, for instance, to the system set forth in conjunction with FIG. 39. As with the previous embodiments, isolator plates 11 form seismic isolation components of floor 740'. Isolator plates 11 are spaced apart in a predetermined pattern, and floor plates 742 are positioned in the spaces formed between isolator plates 11. Isolator plates 11 and floor plates 742 are rigidly coupled together with integrated framing 741. In this embodiment, framing 741 includes tessellating elements 745 used to support conventional floor plates/panels 746. In FIG. 55, panels 746 are set at the moment connections of tessellating elements 745. As a matter of illustration, FIG. 57 is a sectional view taken along line 57-57 of FIG. 56 illustrating a floor plate/panel 744 positioned atop an isolator plate 11 of the floor assembly 740 of FIG. 56. Tessellating elements 745 floor assembly 740 contribute to frame 741 deflection, whereby rigid balls and/or compliant balls may therefore be used as desired in conjunction with isolator plates 11.

Figure 58:
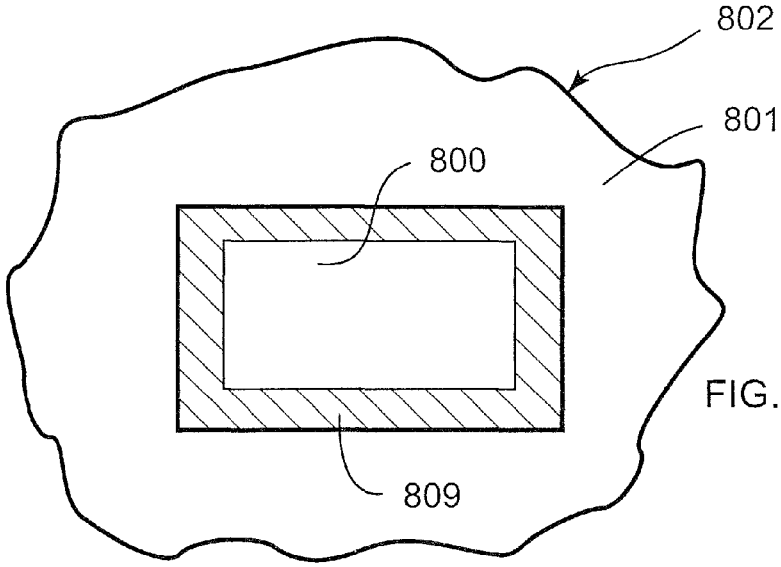
FIG. 58 is a highly generalized top plan view of a seismic isolation floor assembly incorporated into a larger non-isolated floor thereby together forming a floor structure.
Figure 59:
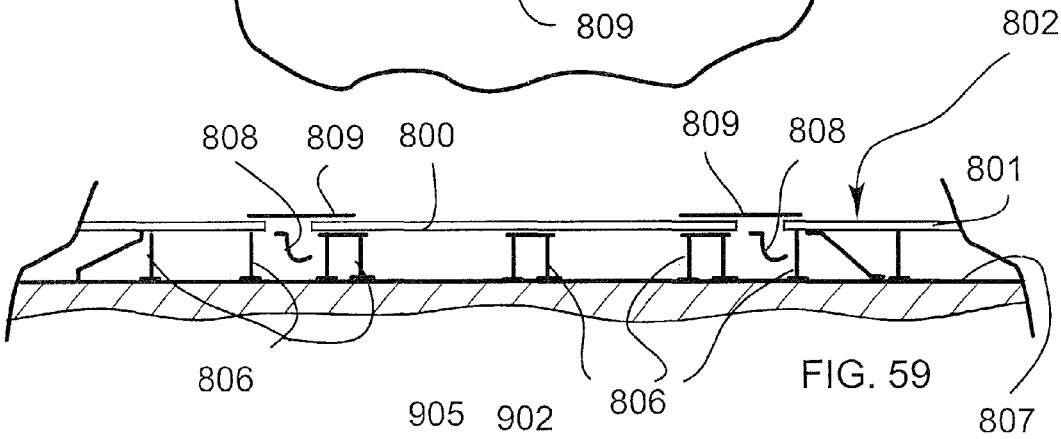
FIG. 59 is a highly generalized vertical sectional view of the floor structure of FIG. 58.

A seismic isolation floor assembly constructed and arranged in accordance with the principle of the invention according to any of the previously described embodiments may be incorporated into a larger non-isolated floor, and used to isolate individual tools or equipment. As a matter of example, FIG. 58 is a highly generalized top plan view of a seismic isolation floor assembly, generally indicated by the reference character 800, shown incorporated into a larger non-isolated floor denoted generally at 801, thereby together forming a floor structure 802. With additional reference to FIG. 59, which is a highly generalized vertical sectional view of floor structure 802, floor assembly 800 and non-isolated floor 801 are supported by pedestals 806 at an elevated location relative to a base floor 807. A gap 808 is formed between non-isolated floor 801 and the perimeter of floor assembly 800, and is provided to accommodate seismic isolation movement of floor assembly 800. An expansion joint, designated generally at 809 constructed and arranged in accordance with the teachings set forth in FIG. 30, is coupled between the perimeter of floor assembly 800 and non-isolated floor 801.

Figure 60:
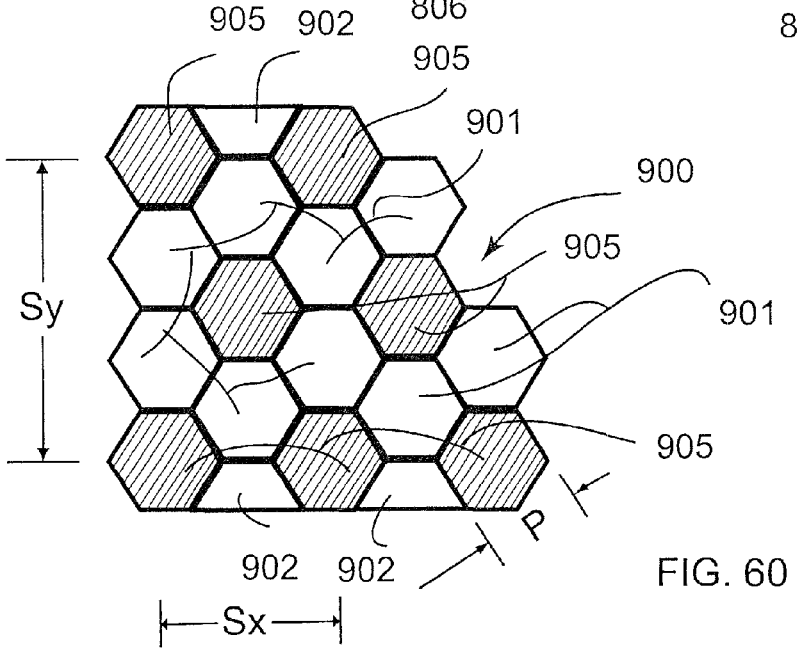
FIG. 60 is a top plan view of a seismic isolation access floor assembly constructed and arranged in accordance with a further alternate embodiment of the invention.

Referring now to FIG. 60 there is seen a top plan view of yet another alternate embodiment of a seismic isolation access floor assembly generally designated by the reference character 900. In this embodiment, floor assembly 900 consists of interconnected floor plates 701 and isolator plates 11, which together form access floor 500'. Isolator plates 11 each forms a seismic isolation component of floor 700'. Isolator plates 11 are spaced apart in a predetermined pattern, and floor plates 701 are positioned in the spaces formed between isolator plates 11. Isolator plates 11 and floor plates 701 are rigidly coupled together with framing Floor assembly 900 is a tessellating isolation access floor system, including isolator plates 905 mechanically interconnected to framed removable field floor plates 901 and edge plates 902, which together form access floor 900'. Isolator plates 905 are supported by a gravity restoring or friction sliding or other isolation system. Isolator plates 905 are each fashioned with a narrow, closed loop, hexagonal perimeter frame. Isolator plates 905 and floor plates 901 have a hexagonal plan arrangement, in which isolator plates 905 are staggered on $S_X$ and $S_Y$ gauges, where $S_X$=2.31P and $S_Y$=3P. Floor 900' is otherwise the same as any one of the seismic isolation access floor assemblies of the invention discussed previously in this specification.

Figure 61:
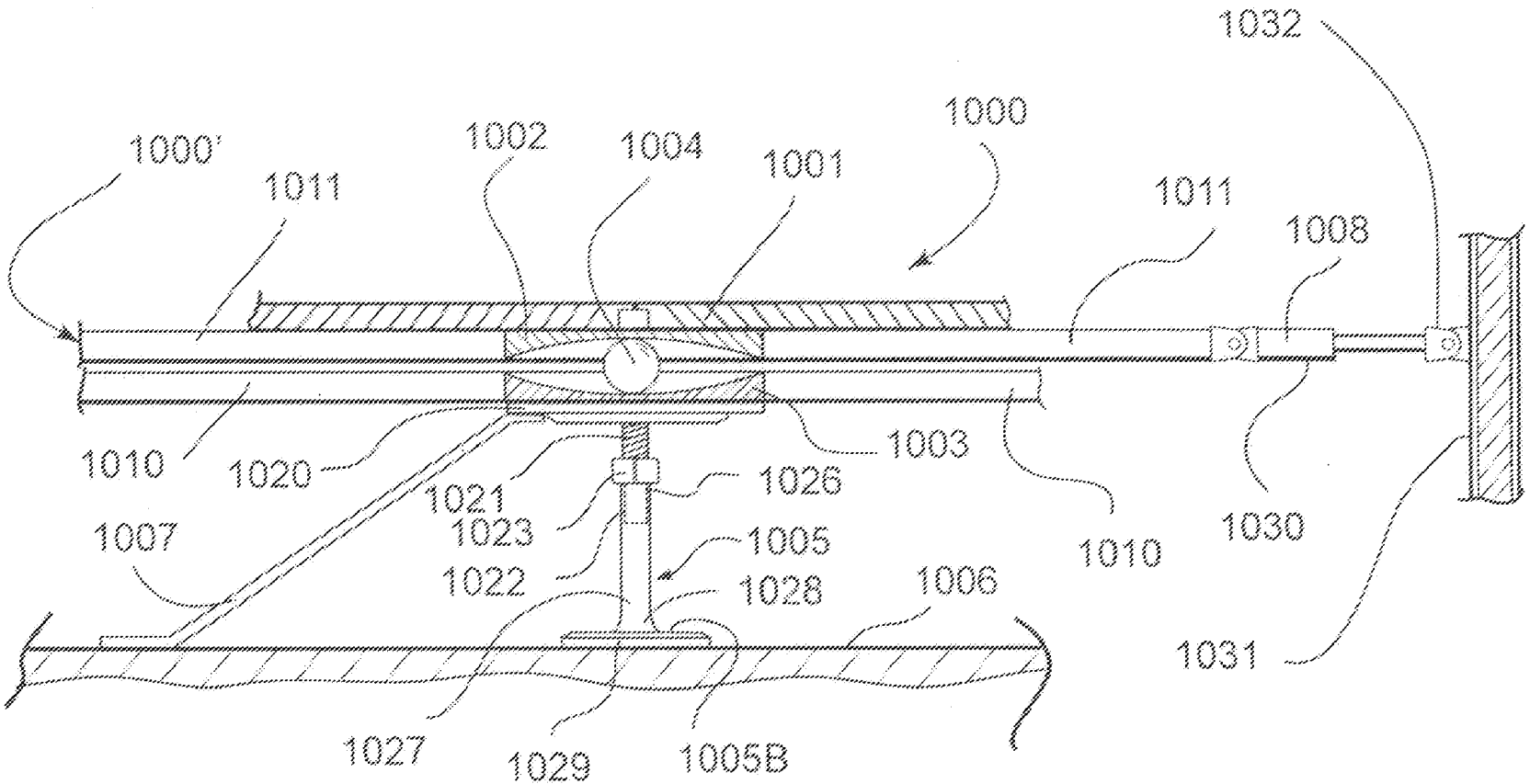
FIG. 61 is vertical sectional view of a seismic isolation access floor assembly constructed and arranged in accordance with yet a further alternate embodiment of the invention.

Reference is now made to FIG. 61, which is a vertical sectional view of a seismic isolation access floor assembly 1000 constructed and arranged in accordance with yet a further alternate embodiment of the invention. FIG. 61 illustrates only a small portion of the floor assembly, and it is to be understood that the various elements set forth in conjunction with floor assembly 1000 my be multiplied as needed for providing a floor assembly having any desired size. Floor assembly 1000 consists of a bearing plate 1003 set onto an adjustable pedestal 1005 supporting bearing plate 1003 at an elevated location relative to base floor 1006.

A ball 1004 is set onto bearing plate 1003, and isolator plate 11 is positioned on ball 1004 overlying bearing plate 1003. Access floor support elements 1010 are mechanically affixed to the perimeter of bearing plate 1003, and seismic isolation supports elements 1011 are mechanically affixed to the perimeter of isolator plate 11. Support elements 1011 overly support elements 1010, and are seismically isolated via bearing plate 11, and support elements 1010 are firmly secured above base floor 1006 via pedestal and brace 1007. Floor plates 1001 are in turn set onto support elements 1011, onto which equipment may be set and mounted. Support elements 1010 and 1011 are each a floor plate or a frame.

Pedestal 1005 forms part of the substructure or understructure of floor assembly 1000, which rests on base floor 1006. In this embodiment, pedestal 1005 has a top plate 1020, which is fastened to the underside of bearing plate 1003. Top plate 1020 is rigidly coupled to bearing plate 1003 with, for instance, a suitable adhesive, and/or one or more screws, bolts, nut-and-bolt assemblies, etc. Top plate 1020 may, if desired, be welded to the underside of bearing plate 1003. Top plate 1020 is rigidly secured to a relatively short threaded stem 1021 that depends downwardly therefrom to a distal end 1022 which projects through a threaded nut 1023 positioned atop an upper end 1026 of upright stud 1027, and also is partially received into upper end 1026 of upright stud 1027. Threaded nut 1023 threadably retains stem 1021 at upper end 1026 of stud 1027. Stud 1027 extends downwardly from upper end 1026 to a lower end 1028, which is rigidly affixed to a load distributor plate 1029 positioned against base floor 1006. By nut 1023 relative to stem 1021, stem 1021 is reciprocally adjustable relative to stud 1027 for adjusting pedestal 1005 between shortened and lengthened conditions, in which nut 1023 is used to secure stem 1021 at whatever position it is adjusted to and thus providing height adjustment for bearing plate 1003 for setting the access floor at a specified height. Stem 1021 and stud 1027 have complementing cylindrical shapes in the preferred embodiment, but can be provided in other complementing shapes, such as square, triangular, etc. Also, although nut 1027 is used to secure stem 1021 to stud 1027, other forms of mechanical devices can be used for providing this function, such as a clamp, a keyed nut, etc. Brace 1007 is coupled between top plate 1020 of pedestal 1005 and base floor 1006 providing lateral stability and lateral bracing between pedestal 1005 and base floor 1006 against seismic shifts.

As previously mentioned, support elements 1010 are mechanically affixed to the perimeter of bearing plate 1003, seismic isolation supports elements 1011 are mechanically affixed to the perimeter of isolator plate 11, support elements 1011 overly support elements 1010, and are seismically isolated via bearing plate 11, and support elements 1010 are firmly secured above base floor 1006 via pedestal and brace 1007. A damper 1030, which in this instance is a piston or cylinder such as a hydraulic cylinder or a pneumatic cylinder or the like, is coupled between a support element 1011 and an opposing upright wall 1031. Damper 1030 is a damper, which dampens or otherwise attenuates seismic movement imparted to elements 1011 during seismic events, in accordance with the principle of the invention. By coupling damper 1030 between wall 1031 and support element 1011, the coupling of support element 1011 to isolator plate 11 provides an operative coupling of damper 1030 between wall 1031 and isolator plate 11 and, therefore, a damping between wall 1031 and isolator plate 11. Although damper 1030 is coupled between wall 1031 and floor assembly 1000, damper 1030 may be coupled between base floor 1006 and floor assembly 1000.

A pivot mount or hinge 1032 is used to secure damper 1030 to wall 1031, which allows damper 1030 to pivot relative to wall 1031 during seismic events, and in response to adjustment of the height of floor assembly 1000 with pedestal 1005. Although one damper is set forth in FIG. 61, floor assembly 1000 may incorporate any desired number of such dampers.

Figure 62:
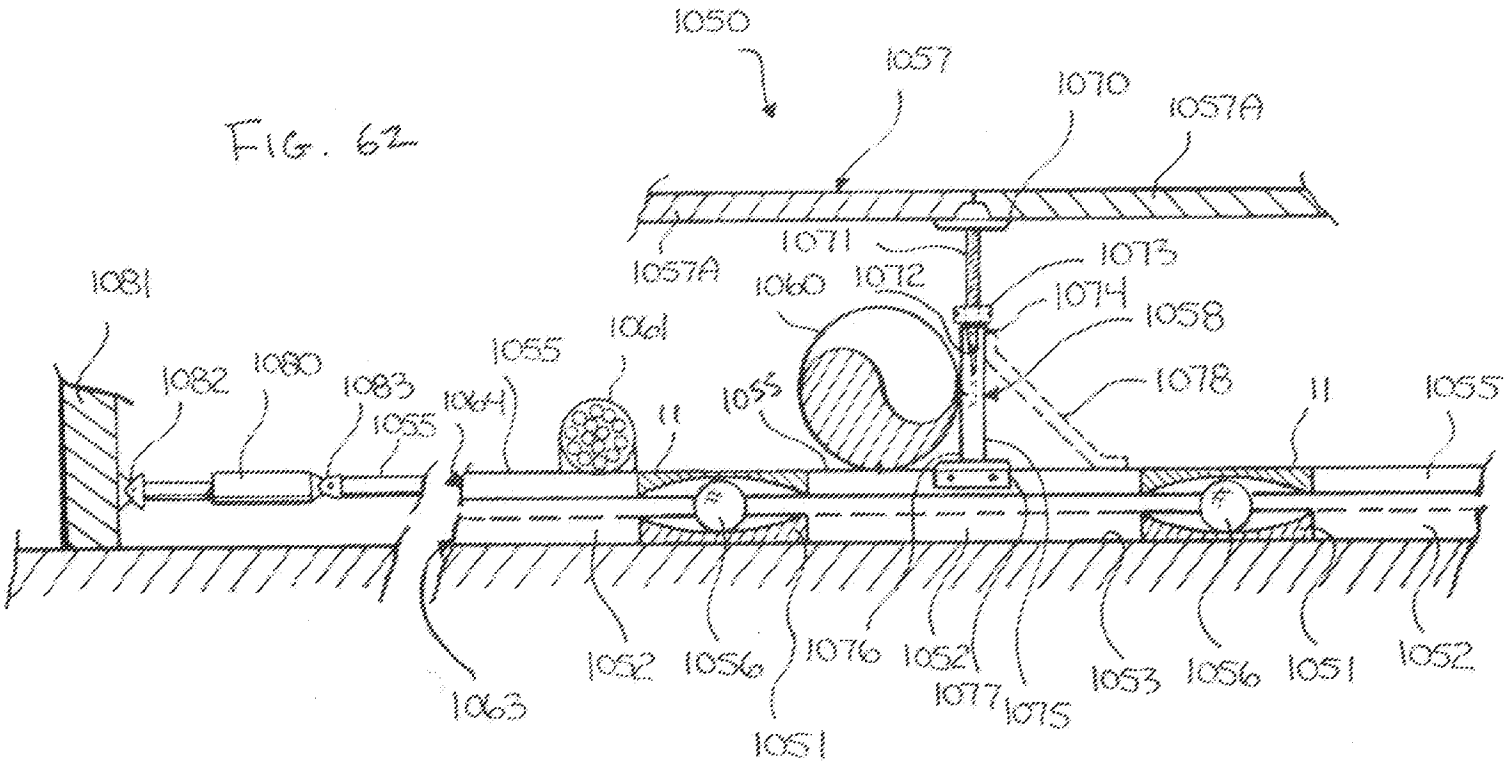
FIG. 62 is a fragmented vertical sectional view of a portion of a seismic isolation access floor assembly, configured with a damper shown secured to an upright wall, constructed and arranged in accordance with yet still another alternate embodiment of the invention.

Referring to FIG. 62 there is seen a fragmented vertical sectional view of a seismic isolation access floor assembly 1050 constructed and arranged in accordance with yet another alternate embodiment of the invention. FIG. 62 illustrates only a small portion of the floor assembly, and it is to be understood that the various elements set forth in conjunction with floor assembly 1050 my be multiplied as needed for providing a floor assembly having any desired size.

Floor assembly 1050 includes a bearing floor 1063, consisting of bearing plates 1051 interconnected by framing components 1052, set onto a base floor 1053. Bearing plates 1051 and/or framing components 1052 are secured to base floor with adhesive, rivets, nut-and-bolt assemblies, welding, or the like. An isolator floor 1064, including isolator plates 11 interconnected by framing components 1055, is set atop bearing floor 1063. Isolator plates 11 are positioned atop bearing plates 1051, respectively, and a ball 1056 is captured between each isolator plate 11 and the corresponding bearing plate 1051. The provision of isolator plates 11 and balls 1056 captured between isolator plates 11 and the corresponding bearing plates 1051 mounted to base floor 1053, seismically isolates isolator floor 1064, including framing components 1055, relative to bearing floor 1063 and base floor 1053. The framing interconnecting bearing plates 1051 and the framing interconnecting isolator plates 11 stiffens the isolator and bearing plates in horizontal and vertical planes so isolator floor 1064 and bearing floor 1063 can move parallel relative to each other ensuring seismic isolation. An access floor 1057 is, in turn, supported at an elevated location by pedestals 1058 (only one shown) coupled between access floor 1057 and isolator floor 1064. Because isolator floor 1064 is seismically isolated as previously disclosed, access floor 1057 is, in turn, also seismically isolated, in accordance with the principle of the invention. Access floor 1057, which in this embodiment consists of a plurality of interconnected floor plates 1057A, is used to support equipment and fixtures and the like, and space 1059 between the underside access floor 1057 and the top side of isolator floor 1064 accommodates utilities, such as ducts 1060 and power cables 1061 and the like, provided to service the equipment and fixtures supported atop access floor 1057.

Pedestal 1058 forms part of the substructure or understructure of floor assembly 1050. Pedestal 1058 has a top plate 1070, which is fastened to the underside of access floor 1057. Top plate 1070 is rigidly coupled to access floor 1057 with, for instance, brackets, a suitable adhesive, and/or one or more screws, bolts, nut-and-bolt assemblies, etc. Top plate 1070 may, if desired, be welded to the underside of access floor 1057. Top plate 1070 is rigidly secured to a relatively short threaded stem 1071 that depends downwardly therefrom to a distal end 1072 which projects through a threaded nut 1073 positioned atop an upper end 1074 of upright stud 1075, and also is partially received into upper end 1074 of upright stud 1075. Threaded nut 1073 threadably retains stem 1071 at upper end 1074 of stud 1075. Stud 1075 extends downwardly from upper end 1074 to a lower end 1076, which is rigidly affixed to a framing component 1055 of isolator floor 1064, such as with rivets, welding, nut-and-bolt assemblies, a bracket 1077, or the like. By rotating nut 1073 relative to stem 1071, stem 1071 is reciprocally adjustable relative to stud 1075 for adjusting pedestal 1058 between shortened and lengthened conditions, in which nut 1073 is used to secure stem 1071 at whatever position it is adjusted to and thus providing height adjustment for access floor 1057 for setting access floor 1057 at a specified height relative to base floor 1053. Stem 1071 and stud 1075 have complementing cylindrical shapes in the preferred embodiment, but can be provided in other complementing shapes, such as square, triangular, etc. Also, although nut 1073 is used to secure stem 1071 to stud 1075, other forms of mechanical devices can be used for providing this function, such as a clamp, a keyed nut, etc. Brace 1078 is coupled between stud 1075 of pedestal 1058 and isolator floor 1064, in this instance a framing component 1055 of isolator floor 1064, providing lateral stability and lateral bracing between pedestal 1058 and base floor 1053 against seismic shifts. Although brace 1078 is secured to one framing component 1055, it can be coupled to a plurality of framing components 1055, to one isolator plate 11, or to one isolator plate 11 and an adjacent framing component 1055.

Figure 63:
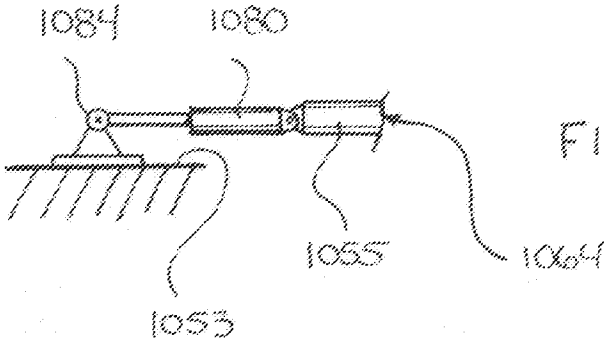
FIG. 63 is a fragmented view of the seismic isolation access floor assembly of FIG. 62 illustrating the damper as it would appear secured to a base floor.

A damper 1080, which in this instance is a piston or cylinder such as a hydraulic cylinder or a pneumatic cylinder or the like, is coupled between isolator floor 1064 and an opposing upright wall 1081 projecting upwardly from base floor 1053. In this embodiment, damper 1080 is secured to a framing element 1055 of isolator floor 1064, although it can be coupled to an isolator plate 11 of isolator floor 1064, if desired. Damper 1030 is a damper, which dampens or otherwise attenuates seismic movement imparted to isolator floor 1064, and thus to access floor 1057, during seismic events, in accordance with the principle of the invention. Pivot mounts or hinge 1082 and 1083 are used to secure damper 1080 to wall 1081 and isolator floor 1064, respectively, which allows damper 1080 to pivot relative to wall 1081 and isolator floor 1064 during seismic events. Although one damper is set forth in FIG. 62, floor assembly 1050 may incorporate any desired number of such dampers. Furthermore, although damper 1080 is mounted to wall 1081, it may be mounted to base floor 1053, such as with a pivot mount bracket 1084, as illustrated in FIG. 63. Any suitable form of access floor can be used in conjunction with floor assembly 1050.

Figure 64:
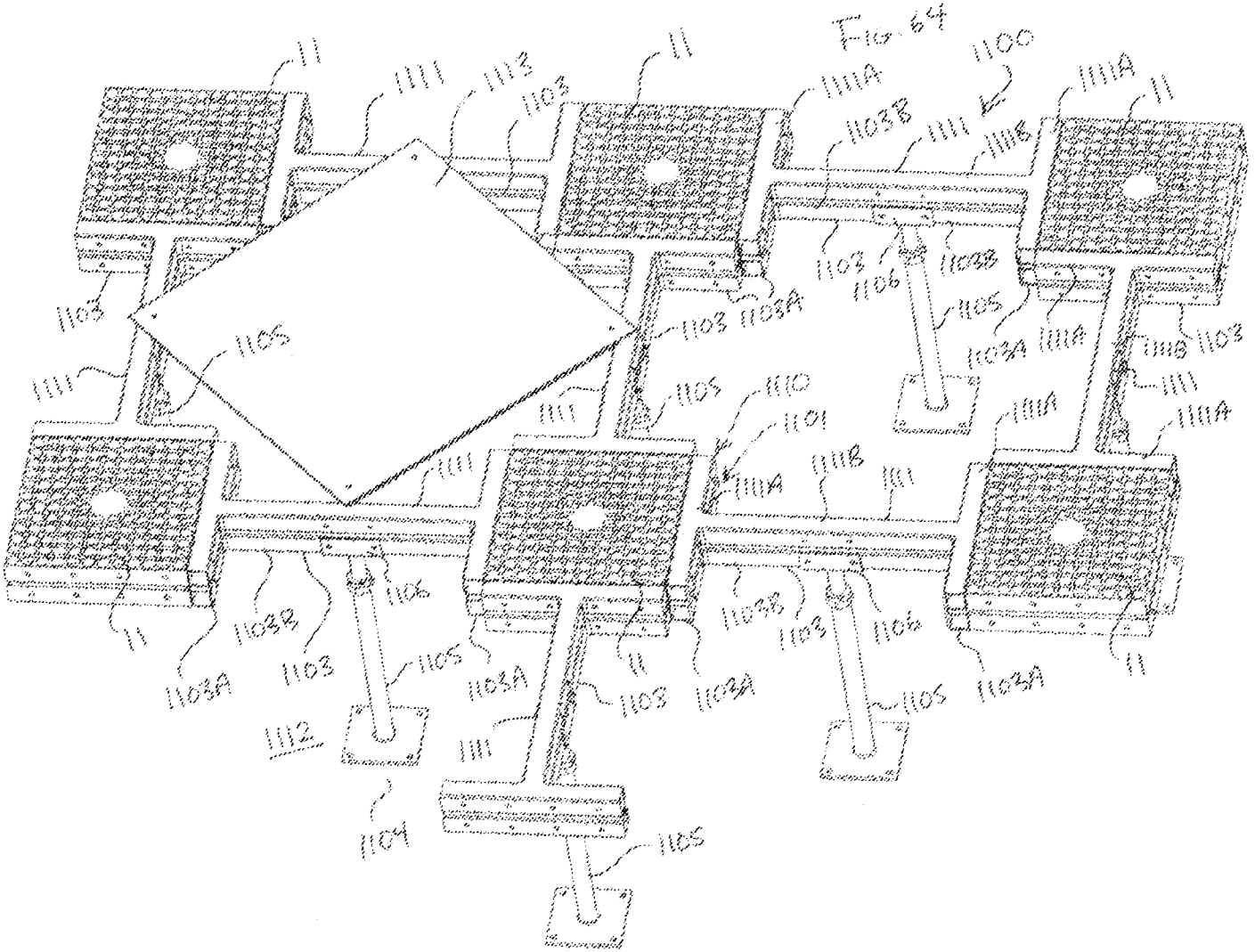
FIG. 64 is a top perspective view of a seismic isolation access floor assembly constructed and arranged in accordance with yet another alternate embodiment of the invention.
Figure 65:
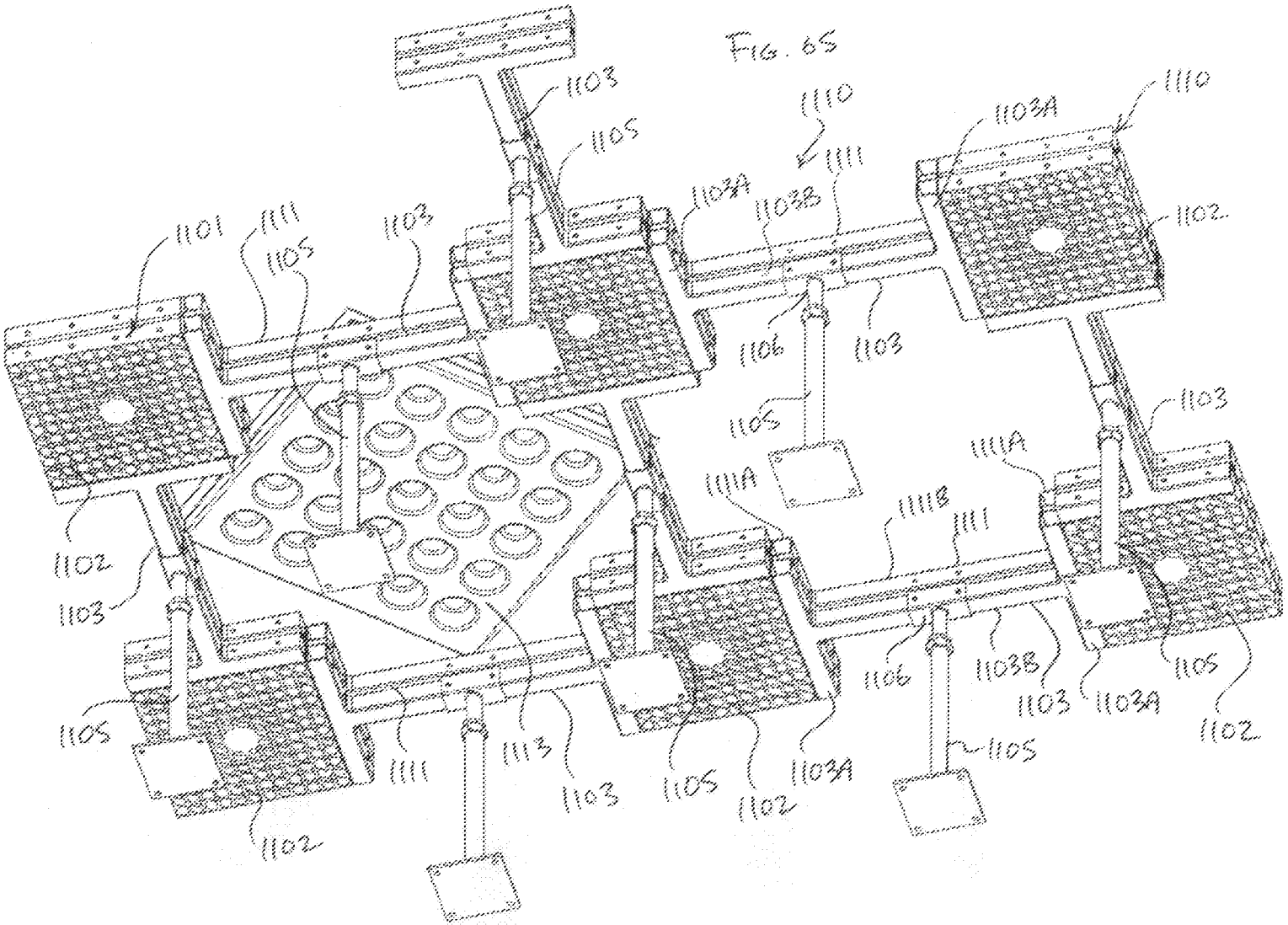
FIG. 65 is a bottom perspective view of the seismic isolation access floor assembly of FIG. 64.

Attention is now directed to FIGS. 64 and 65, in which there is seen top and bottom perspective views, respectively, of a seismic isolation access floor assembly 1100 constructed and arranged in accordance with yet another alternate embodiment of the invention. Only a small portion of floor assembly 1100 is illustrated, and it is to be understood that the various elements set forth in conjunction with floor assembly 1100 my be multiplied as needed for providing a floor assembly having any desired size.

Figure 66:
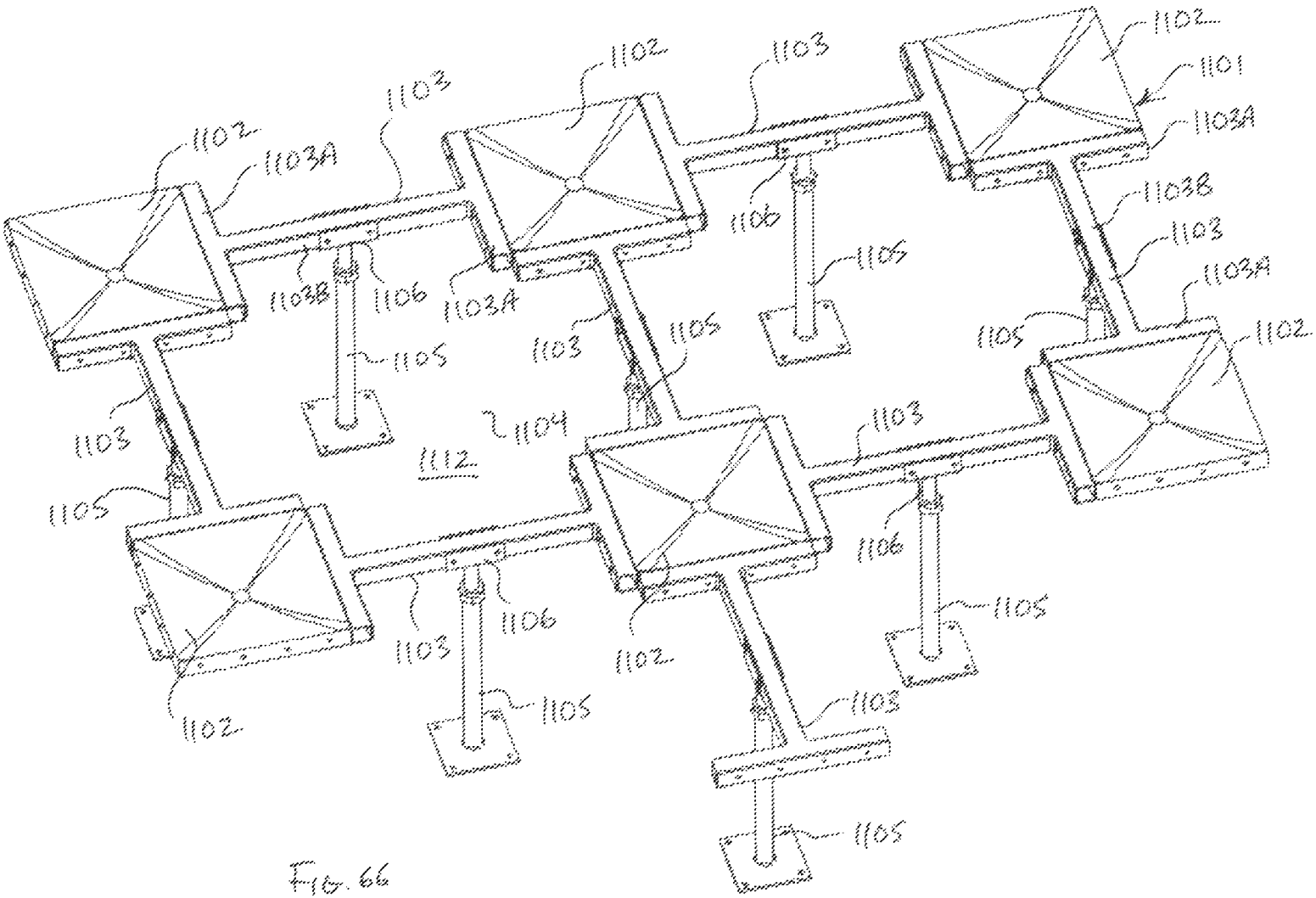
FIG. 66 is a perspective view of the seismic isolation access floor assembly of FIG. 64 illustrating framing coupled to bearing plates supported above a base floor by pedestals.

Floor assembly 1100 includes a bearing floor 1101 and an isolator floor 1110. With continuing reference to FIGS. 64 and 66, and additional regard to FIG. 66, bearing floor 1101 consists of bearing plates 1102 (FIG. 65) interconnected by framing components 1103, supported at an elevated location relative to a base floor 1104 (FIG. 64) with pedestals 1105. Isolator floor 1110, which includes isolator plates 11 (FIG. 64) interconnected by framing components 1111, is set atop bearing floor 1101. Isolator plates 11 are positioned atop, and substantially equal in size relative to, bearing plates 1102, respectively, and a ball (not shown) is captured between each isolator plate 11 and the corresponding bearing plate 1052. The provision of isolator plates 11 and balls (not shown) captured between isolator plates 11 and the corresponding bearing plates 1102 seismically isolates isolator floor 1110, including framing components 1111, relative to base floor 1104. The framing interconnecting bearing plates 1102 and the framing interconnecting isolator plates 11 stiffens the isolator and bearing plates in horizontal and vertical planes so isolator floor 1110 and bearing floor 1101 can move parallel relative to each other ensuring seismic isolation. An access floor is, in turn, supported atop isolator floor 1110 thereby being supported at an elevated location relative to base floor 1104. Because isolator floor 1110 is seismically isolated, an access floor positioned on isolator floor 1110 is, in turn, also seismically isolated, in accordance with the principle of the invention. The access floor located atop isolator floor 1110 is, as with the previous embodiments, used to support equipment and fixtures and the like, and space 1112 (FIG. 64) between the underside isolator floor 1110 and base floor 1104 accommodates utilities, such as ducts and power cables and the like, provided to service the equipment and fixtures supported atop the access floor supported atop isolator floor 1110. The access floor is formed by floor plates, such as floor plate 1113, positioned atop isolator floor 1110. Although FIGS. 64 and 65 illustrate one floor plate 1113, it is to be understood that an access floor is formed by locating a plurality of floor plates atop isolator floor 1110.

Pedestals 1105 form part of the substructure or understructure of floor assembly 1100, and are substantially identical in structure to pedestals 1058 previously discussed in conjunction with floor assembly 1050 providing height adjustment, whereby the previous discussion of pedestal 1058 applies to each of pedestals 1105. Unlike pedestals 1058, pedestals 1105 are anchored to base floor 1104, such as with adhesive, rivets, nut-and-bolt assemblies, welding, or the like. As with previous floor assembly embodiments, such as floor assembly 1050, floor assembly 1100 may be configured with braces for bracing bearing floor 1101 to base floor 1104, and dampers for dampening isolator floor 1110.

Framing components 1103 of bearing floor 1101 are identical in structure and size to framing components 1111 of isolator floor 1110, in which each framing component 1103 is formed generally in the shape of an H including opposed parallel members 1103A interconnected by a central transverse member 1103B extending therebetween, and in which each framing component 1111 is formed generally in the shape of an H including opposed parallel members 1111 interconnected by a central transverse member 1111B extending therebetween. Each framing component 1111 of isolator floor 1110 is paired with a corresponding framing component 1103 of bearing floor 1101. As to each pair of corresponding framing components 1103 and 1111, framing component 1111 overlies and is coextensive with the corresponding framing component 1103, and the framing components 1103 and 1111 extend between opposed pairs of corresponding isolator and bearing plates. Referencing framing components 1103 of bearing floor 1101, the opposed parallel members 1103A interconnected by transverse member 1103B are anchored to the outer edges of opposed, spaced-apart bearing plates 1102. Referencing framing components 1111, the opposed parallel members 111A interconnected by transverse member 111B are anchored to the outer edges of opposed, spaced-apart isolator plates 11. In this embodiment, each pedestal 1105 is coupled between a transverse member 1103B, at a generally intermediate location between the corresponding opposed parallel members 1103A, and base floor 1104. Pedestals 1105 are each anchored to a corresponding transverse member 1103B with a generally U-shaped bracket 1106 in the present embodiment, whereby each transverse member 1103B is fitted in the U-shaped bracket 1106 of the corresponding pedestal 1105 and anchored thereto with rivets, nut-and-bolt assemblies, welding, or the like.

Figure 67:
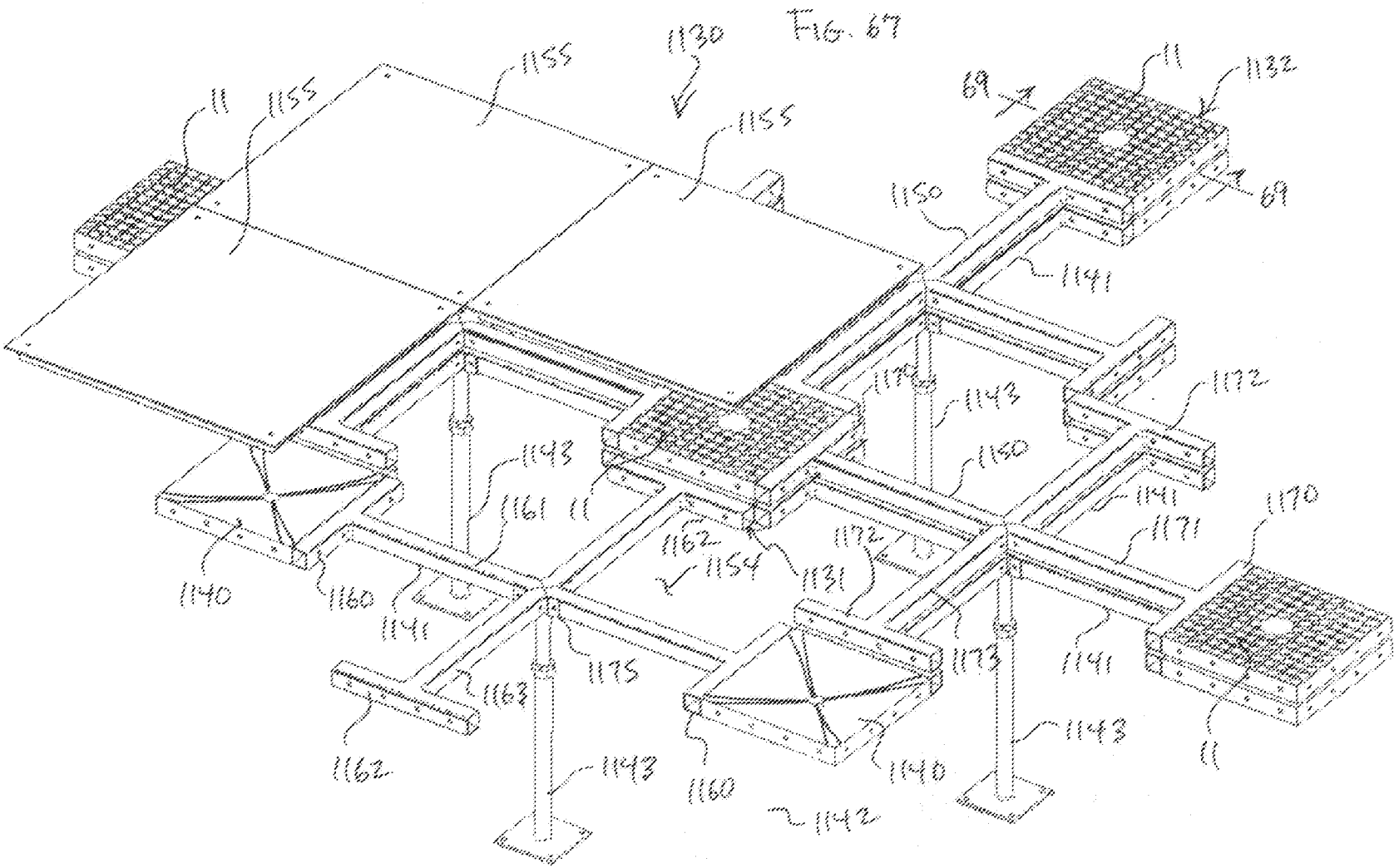
FIG. 67 is a top perspective view of a seismic isolation access floor assembly constructed and arranged in accordance with a further alternate embodiment of the invention.
Figure 68:
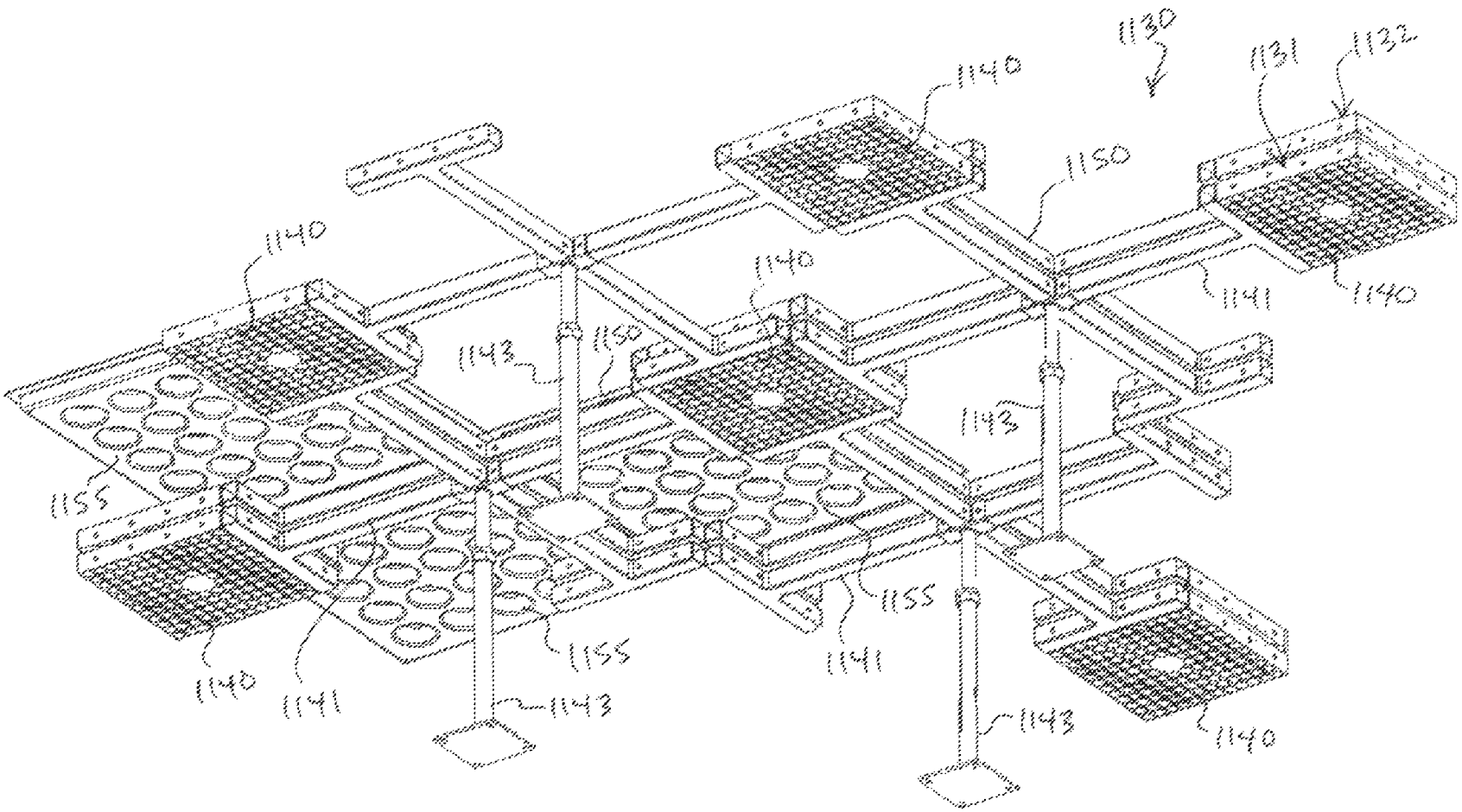
FIG. 68 is a bottom perspective view of the seismic isolation access floor assembly of FIG. 67.

Attention is now directed to FIGS. 67 and 68, in which there is seen top and bottom perspective views, respectively, of a seismic isolation access floor assembly 1130 constructed and arranged in accordance with yet another alternate embodiment of the invention. Only a small portion of floor assembly 1130 is illustrated, and it is to be understood that the various elements set forth in conjunction with floor assembly 1130 my be multiplied as needed for providing a floor assembly having any desired size.

Figure 69:
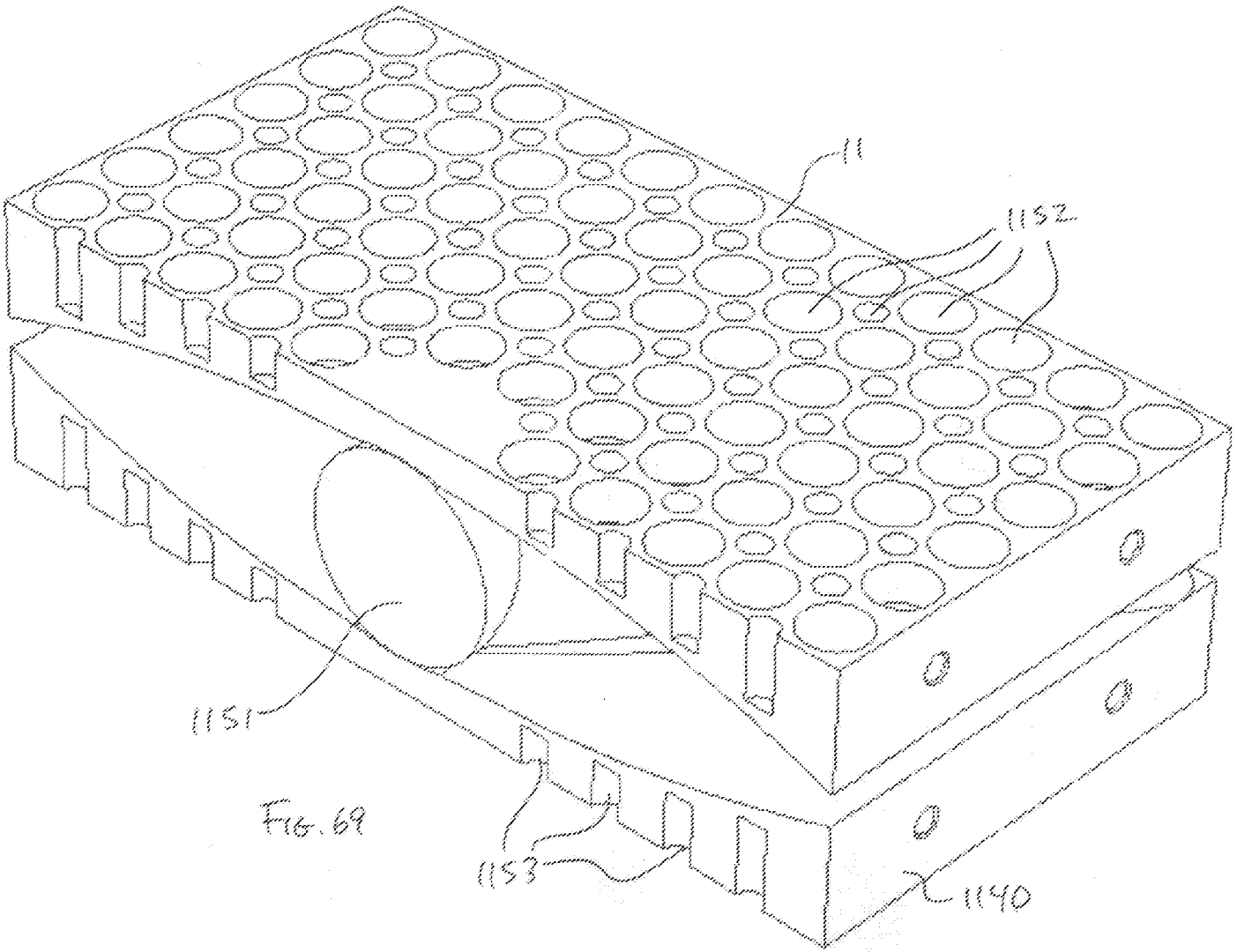
FIG. 69 is a sectional view taken along line 69-69 of FIG. 67.

Floor assembly 1130 includes a bearing floor 1131 and an isolator floor 1132. Referencing FIGS. 67 and 68, bearing floor 1131 consists of bearing plates 1140 interconnected by framing components 1141, supported at an elevated location relative to a base floor 1142 (FIG. 67) with pedestals 1143. Isolator floor 1132 includes isolator plates 11 (FIG. 67) interconnected by framing components 1150, is set atop bearing floor 1131. Isolator plates 11 are positioned atop, and substantially equal in size relative to, bearing plates 1140 respectively, and a ball 1151, which is referenced in FIG. 69 illustrating a sectional taken along line 69-69 of FIG. 67, is captured between each isolator plate 11 and the corresponding bearing plate 1140. As seen in FIG. 69, each isolator plate 11 and each bearing plate 1140 are formed with a pattern openings or channels for weight reduction purposes. The channels or openings formed in isolator plate 11 are referenced at 1152 in FIG. 69, and the channels or openings formed in bearing plate 1140 are referenced at 1153.

The provision of isolator plates 11 and balls, such as ball 1151 depicted in FIG. 69, captured between isolator plates 11 and the corresponding bearing plates 1140 seismically isolates isolator floor 1132, including framing components 1150, relative to base floor 1142. The framing interconnecting bearing plates 1140 and the framing interconnecting isolator plates 11 stiffens the isolator and bearing plates in horizontal and vertical planes so isolator floor 1132 and bearing floor 11131 can move parallel relative to each other ensuring seismic isolation. An access floor is, in turn, supported atop isolator floor 1132 thereby being supported at an elevated location relative to base floor 1142. Because isolator floor 1132 is seismically isolated, an access floor positioned on isolator floor 1132 is, in turn, also seismically isolated, in accordance with the principle of the invention. The access floor located atop isolator floor 1132 is, as with the previous embodiments, used to support equipment and fixtures and the like, and space 1154 (FIG. 67) between the underside isolator floor 1132 and base floor 1142 accommodates utilities, such as ducts and power cables and the like, provided to service the equipment and fixtures supported atop the access floor supported atop isolator floor 1132. The access floor is formed by floor plates, such as floor plate 1155, positioned atop isolator floor 1132. Although FIGS. 67 and 68 illustrate three floor plate 1155, it is to be understood that an access floor is formed by locating an additional number of floor plates atop isolator floor 1132.

Pedestals 1143 form part of the substructure or understructure of floor assembly 1130, and are substantially identical in structure to pedestals 1058 previously discussed in conjunction with floor assembly 1050 providing height adjustment, whereby the previous discussion of pedestal 1058 applies to each of pedestals 1143. Unlike pedestals 1058, pedestals 1143 are anchored to base floor 1142, such as with adhesive, rivets, nut-and-bolt assemblies, welding, or the like. As with previous floor assembly embodiments, such as floor assembly 1050, floor assembly 1130 may be configured with braces for bracing bearing floor 1131 to base floor 1142, and dampers for dampening isolator floor 1132.

Framing components 1141 of bearing floor 1131 are identical in structure and size to framing components 1150 of isolator floor 1132. Each framing component 1141 is formed generally in the shape of an X including opposed parallel members 1160 interconnected by a central transverse member 1161 extending therebetween, and opposed parallel members 1162 interconnected by a central transverse member 1163 extending therebetween. Transverse members 1161 and 1163 intersect each other at their midpoints, and are substantially perpendicular relative to one another. In this embodiment, transverse members 1161 and 1163 are severed at their midpoints where they intersect one another, in which brackets are used to join the severed ends together. The severed ends can be secured together in other ways, such as by welding, rivets, nut-and-bolt assemblies, or the like. Alternatively, framing component 1141 may be integrally formed.

Each framing component 1150 of isolator floor 1132 is formed generally in the shape of an X including opposed parallel members 1170 interconnected by a central transverse member 1171 extending therebetween, and opposed parallel members 1172 interconnected by a central transverse member 1173 extending therebetween. Transverse members 1171 and 1173 intersect each other at their midpoints, and are substantially perpendicular relative to one another. In this embodiment, transverse members 1171 and 1173 are severed at their midpoints where they intersect one another, in which brackets are used to join the severed ends together. The severed ends can be secured together in other ways, such as by welding, rivets, nut-and-bolt assemblies, or the like. Alternatively, framing component 1150 may be integrally formed.

Figure 70:
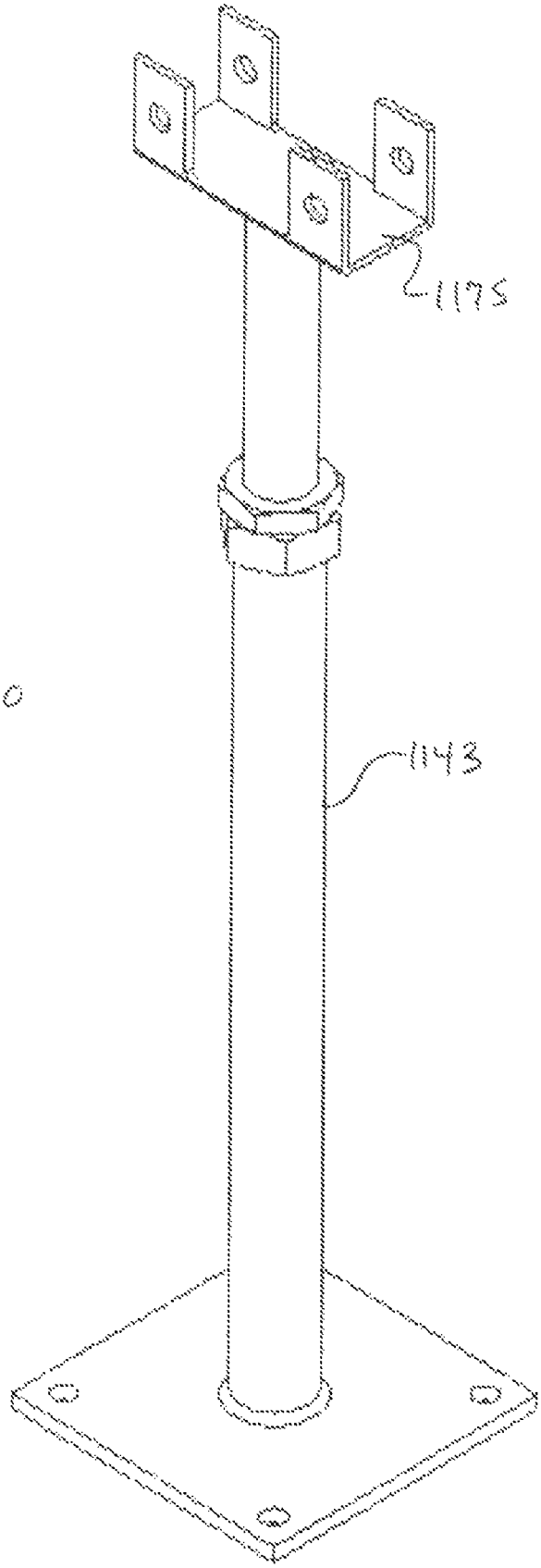
FIG. 70 is an enlarged perspective view of a pedestal of the seismic isolation access floor assembly of FIG. 67.

Each framing component 1150 of isolator floor 1132 is paired with a corresponding framing component 1141 of bearing floor 1131. As to each pair of corresponding framing components 1141 and 1150, framing component 1150 overlies and is coextensive with the corresponding framing component 1141, and the framing components 1150 and 1141 extend between two opposed pairs of corresponding isolator and bearing plates. Referencing framing components 1141 of bearing floor 1131, the opposed parallel members 1160 interconnected by transverse member 1161 are anchored to the outer edges of opposed, spaced-apart bearing plates 1140, and opposed parallel members 1162 interconnected by transverse member 1163 are anchored to the outer edges of opposed, spaced-apart bearing plates 1140. Referencing framing components 1150, the opposed parallel members 1170 interconnected by transverse member 1171 are anchored to the outer edges of opposed, spaced-apart isolator plates 11, and opposed parallel members 1172 interconnected by transverse member 1174 are anchored to the outer edges of opposed, spaced-apart isolator plates 11. In this embodiment, each pedestal 1143 is coupled to a framing component 1141 at the intersection of transverse members 1161 and 1163 with, as seen in FIG. 70, a bracket 1175 formed at the upper end of each pedestal 1143. Each bracket 1175 is secured in place with rivets, nut-and-bolt assemblies, welding, or the like.

Figure 71:
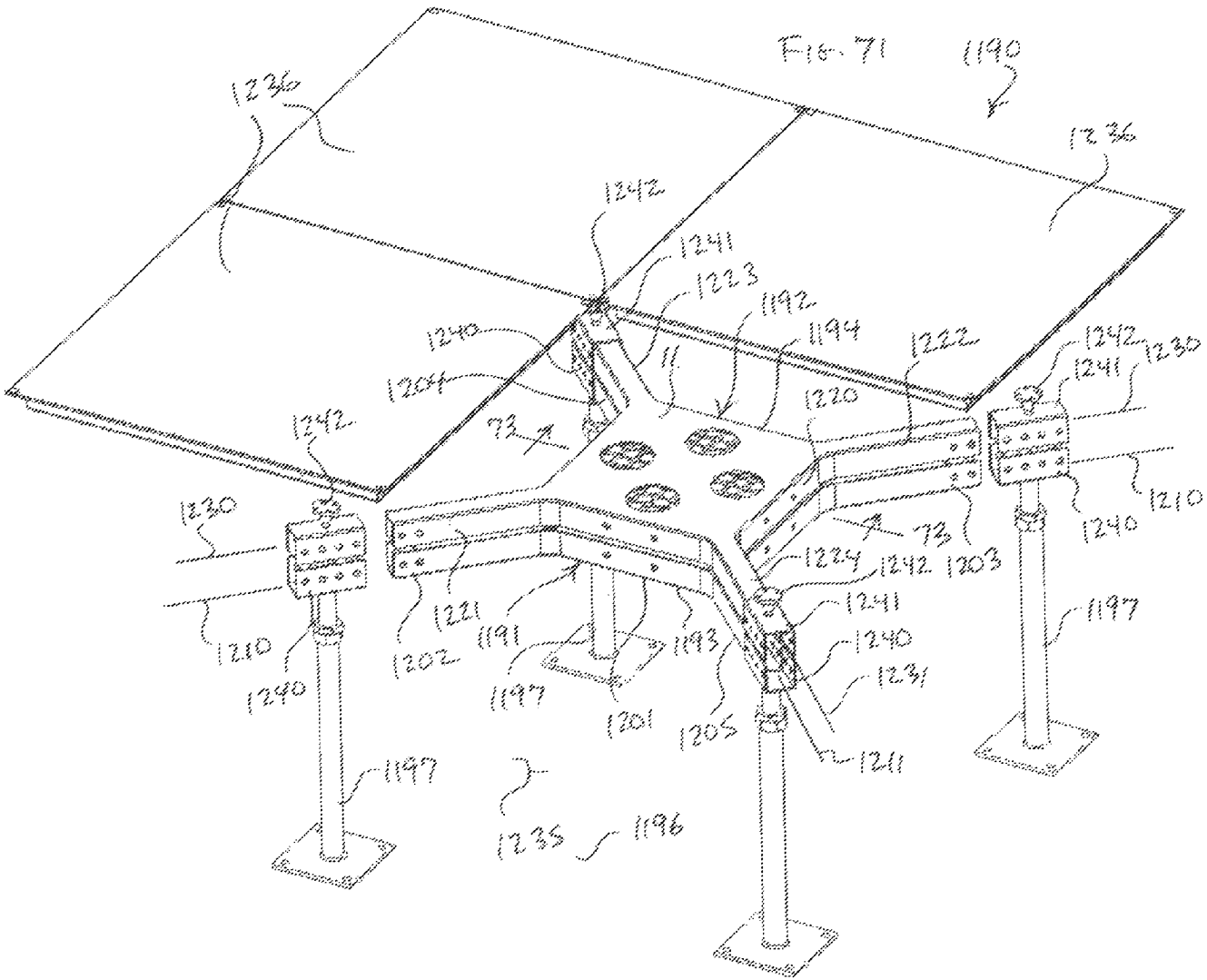
FIG. 71 is a top perspective view of a seismic isolation access floor assembly constructed and arranged in accordance with a further alternate embodiment of the invention.

Attention is now directed to FIG. 71, in which there is seen a top perspective view of a seismic isolation access floor assembly 1190 constructed and arranged in accordance with yet another alternate embodiment of the invention. Only a small portion of floor assembly 1190 is illustrated, and it is to be understood that the various elements set forth in conjunction with floor assembly 1190 my be multiplied as needed for providing a floor assembly having any desired size.

Floor assembly 1190 includes a bearing floor 1191 and an isolator floor 1192. Bearing floor 1191 is supported at an elevated location relative to a base floor 1196 with pedestals 1197. Isolator floor 1192 is set atop bearing floor 1191. Bearing floor 1191 consists of a plurality of interconnected bearing plate components, and isolator floor 1192 consists of a plurality of interconnected isolator plate components. In FIG. 71, only one bearing plate component 1193 is illustrated, and only one corresponding isolator plate component 1194 is illustrated, with the understanding that such components are multiplied as needed for providing a floor assembly having any desired size.

Figure 74:
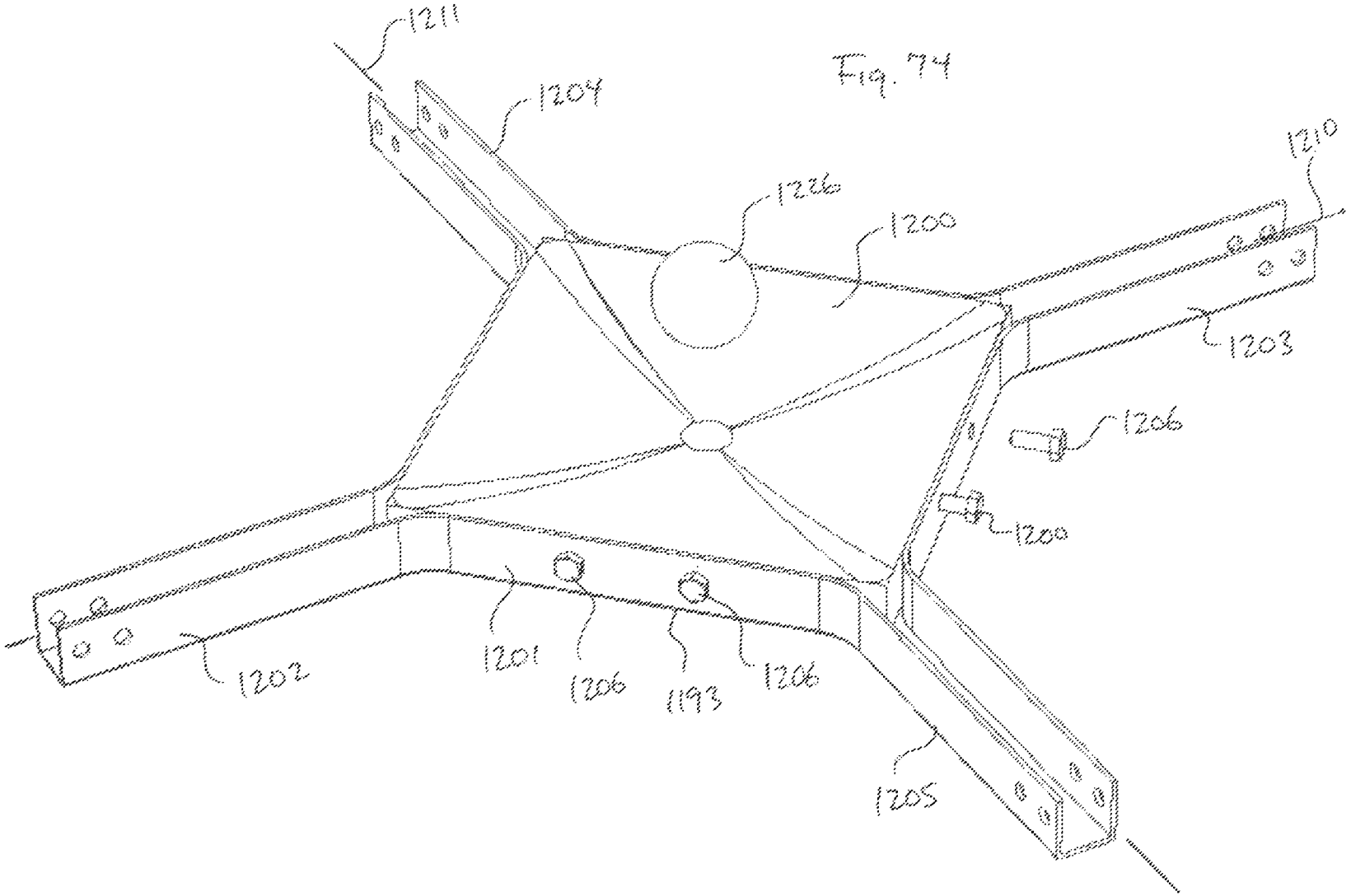
FIG. 74 is a top perspective view of ball opposing a bearing plate component including a bearing plate secured to framing of the seismic isolation access floor assembly of FIG. 71.

Each bearing plate component 1193, as illustrated in FIG. 74, includes a bearing plate 1200 fitted in and mounted to a frame component 1201 having four frame arms 1202-1205 extending laterally outwardly relative to the outer perimeter or marginal edges of bearing plate 1200. Frame arms 1202 and 1203 extend along an axis 1210, and frame arms 1204 and 1205 extend along an axis 1211, which is substantially perpendicular relative to axis 1210. Frame component 1201 is secured to the outer perimeter or marginal edges of bearing plate 1200 with threaded bolts 1206, although rivets, nut-and-bolt assemblies, welding, or the like may be used, if desired.

Figure 73:
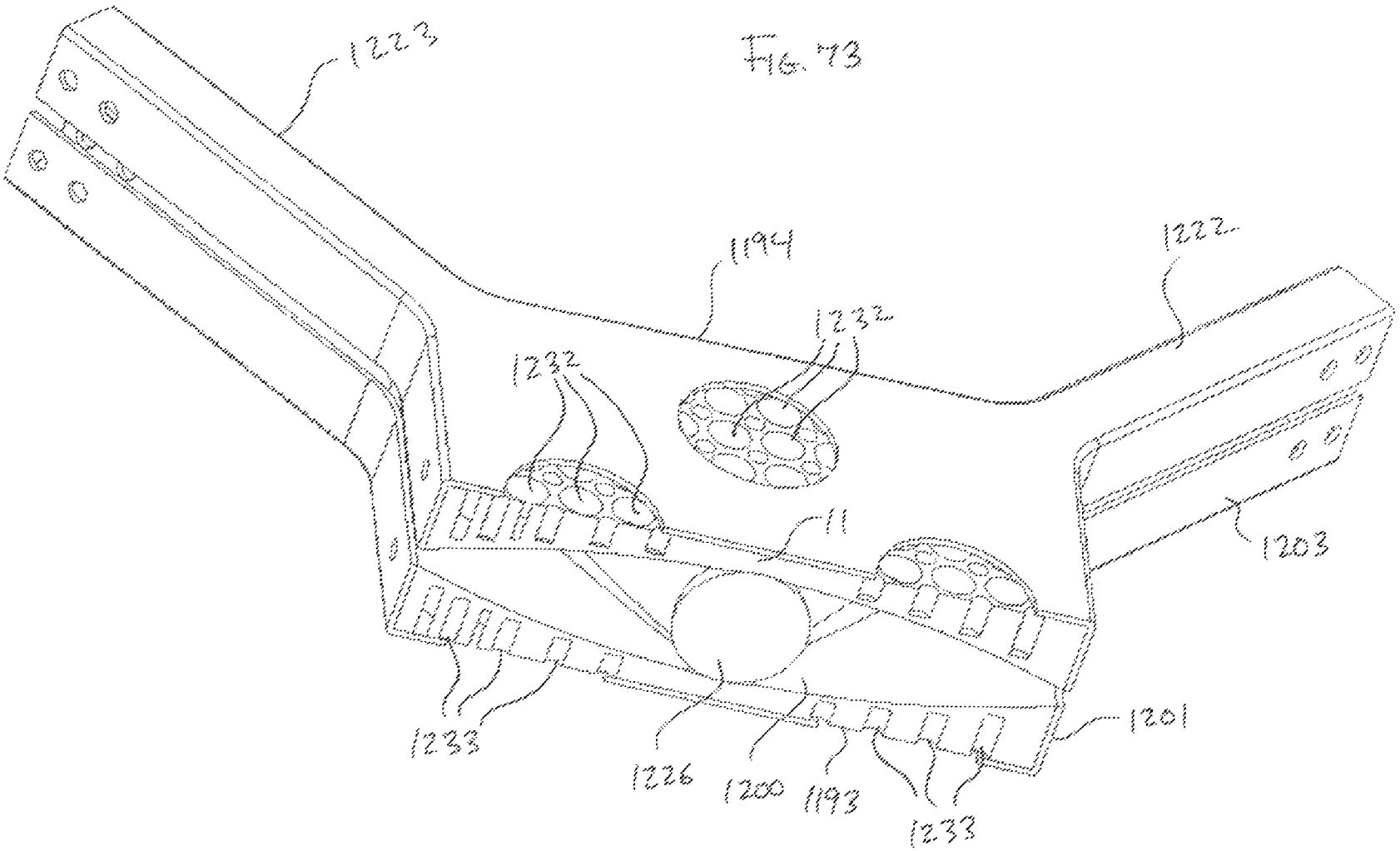
FIG. 73 is a sectional view taken along line 73-73 of FIG. 71.

Referring to FIGS. 71 and 73 in relevant part, each isolator plate component 1194 includes an isolator plate 11 fitted in and mounted to a frame component 1220 having four frame arms 1221-1224 extending laterally outwardly relative to the outer perimeter or marginal edges of isolator plate 11. As seen in FIG. 71, frame arms 1221 and 1222 extend along an axis 1230, and frame arms 1223 and 1224 extend along an axis 1231, which is substantially perpendicular relative to axis 1230. Frame component 1220 is secured to the outer perimeter or marginal edges of isolator plate 11 with threaded bolts (not shown), although rivets, nut-and-bolt assemblies, welding, or the like may be used, if desired.

Each isolator plate component 1194 is positioned atop, and substantially equal in size relative to, a corresponding bearing plate component 1193, and a ball 1226, which is referenced in FIG. 73 illustrating a sectional taken along line 73-73 of FIG. 71, is captured between each isolator plate 11 and the corresponding bearing plate 1200. As seen in FIG. 73, each isolator plate 11 and each bearing plate 1200 are formed with a pattern openings or channels for weight reduction purposes. The channels or openings formed in isolator plate 11 are referenced at 1232 in FIG. 73, and the channels or openings formed in bearing plate 1200 are referenced at 1233 in FIG. 73. In FIG. 74, ball 1226 is shown spaced from and overlying bearing plate 1200.

The provision of isolator plates 11 and balls, such as ball 1226 depicted in FIG. 73, captured between isolator plates 11 of the isolator plate components 1194 and the corresponding bearing plates 1200 of bearing plate components 1193 seismically isolates isolator floor 1192, which is formed of a network of interconnected isolator plate components 1914, relative to base floor 1196 (FIG. 71). An access floor is, in turn, supported atop isolator floor 1192 thereby being supported at an elevated location relative to base floor 1196. Because isolator floor 1192 is seismically isolated, an access floor positioned on isolator floor 1192 is, in turn, also seismically isolated, in accordance with the principle of the invention. The access floor located atop isolator floor 1192 is, as with the previous embodiments, used to support equipment and fixtures and the like, and space 1235 (FIG. 71) between the underside isolator floor 1192 and base floor 1196 accommodates utilities, such as ducts and power cables and the like, provided to service the equipment and fixtures supported atop the access floor supported atop isolator floor 1192. The access floor is formed by floor plates, such as floor plate 1236, positioned atop isolator floor 1192. Although FIG. 71 illustrates three floor plate 1236, it is to be understood that an access floor is formed by locating an additional number of floor plates atop isolator floor 1192.

Referring to FIG. 71, pedestals 1197 form part of the substructure or understructure of floor assembly 1190, and are substantially identical in structure to pedestals 1058 previously discussed in conjunction with floor assembly 1050 providing height adjustment, whereby the previous discussion of pedestal 1058 applies to each of pedestals 1197. Unlike pedestals 1058, pedestals 1197 are anchored to base floor 1196, such as with adhesive, rivets, nut-and-bolt assemblies, welding, or the like. As with previous floor assembly embodiments, such as floor assembly 1050, floor assembly 1190 may be configured with braces for bracing bearing floor 1191 to base floor 1196, and dampers for dampening isolator floor 1192.

As previously mentioned, bearing plate components 1193 and isolator plate components 1194 are substantially identical in structure and size, including the size and shape of arms 1202-1205, 1221-1224. As to each pair of corresponding bearing plate and isolator plate components 1193 and 1194, the isolator plate component 1194 overlies and is coextensive with the corresponding bearing plate component 1193 as shown in FIG. 71, whereby axes 1210 and 1230 are parallel relative to one another and reside in a common vertical plane, and axes 1211 and 1231 are parallel relative to one another and reside in a common vertical plane. Accordingly, properly set atop a bearing plate component 1193, isolator plate 11 overlies bearing plate 1200 capturing a ball therebetween, arms 1221 and 1222 of isolator plate component 1994 overly and extend along arms 1202 and 1203, respectively, of bearing plate component 1193, and arms 1223 and 1224 of isolator plate component 1994 overly and extend along arms 1204 and 1205, respectively, of bearing plate component 1193.

Figure 72:
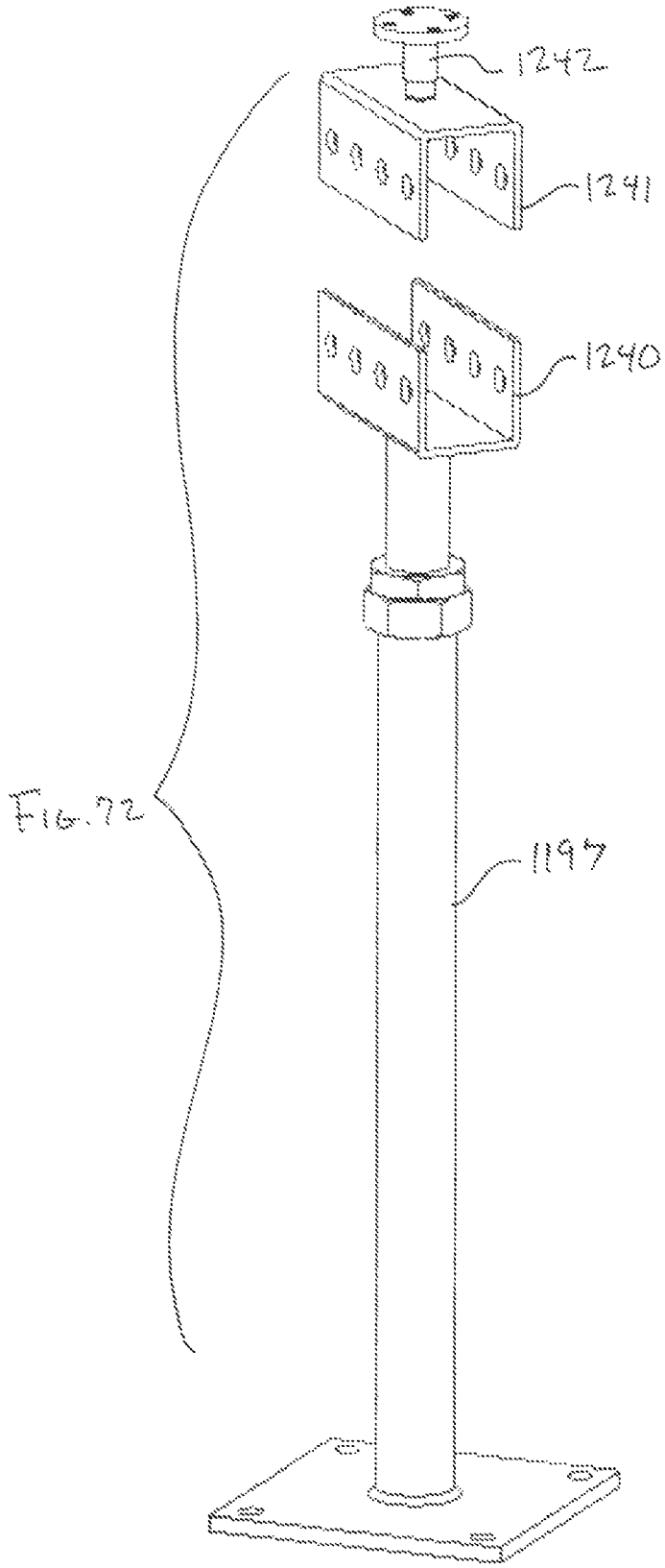
FIG. 72 is an enlarged perspective view of a pedestal and top bracket of the seismic isolation access floor assembly of FIG. 71.
Figure 75:
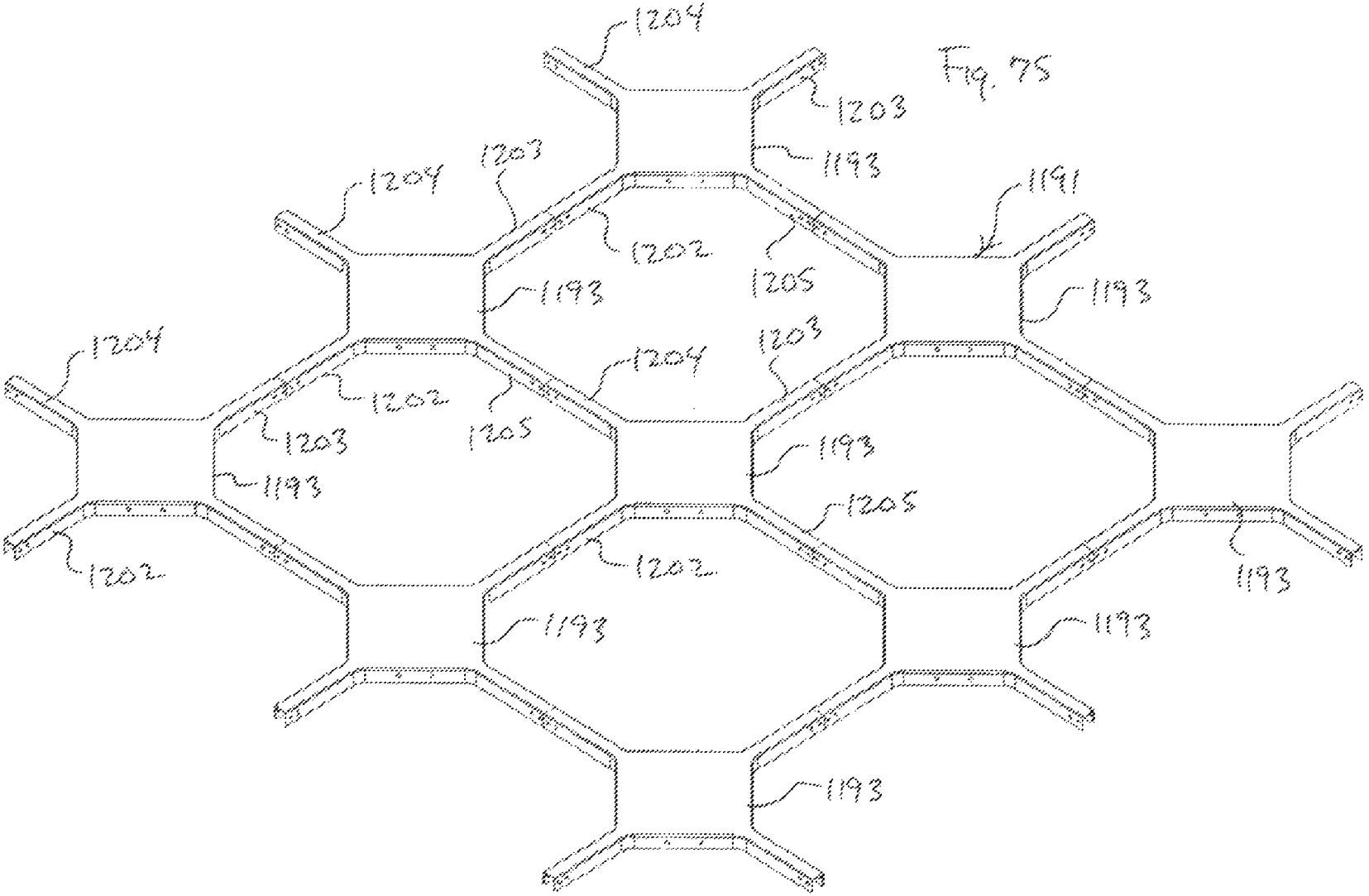
FIG. 75 is a highly generalized top perspective view of a plurality of the bearing plate components of FIG. 74 shown as they would coupled together forming a network of interconnected bearing plate components.

To complete the formation of bearing floor 1191, the outer ends of arms 1202-1205 are coupled to the outer ends of adjacent bearing plate components 1193 to form a network of interconnected bearing plate components 1993 as seen in FIG. 75. In the present embodiment, the opposed outer ends of adjacent bearing plate components 1993 are set into generally U-shaped brackets 1240 formed at the upper ends of pedestals 1197 as shown in FIG. 71, and secured thereto with rivets, bolts, nut-and-bolt assemblies, welding, or the like. In this regard, pedestals 1197 are secured to bearing plate components 1193 at the intersection of opposed ends of the arms of adjacent bearing plate components 1193, according to the principle of the invention. FIG. 72 is an enlarged perspective view of a pedestal 1197 illustrating bracket 1240 formed at the top thereof.

Figure 76:
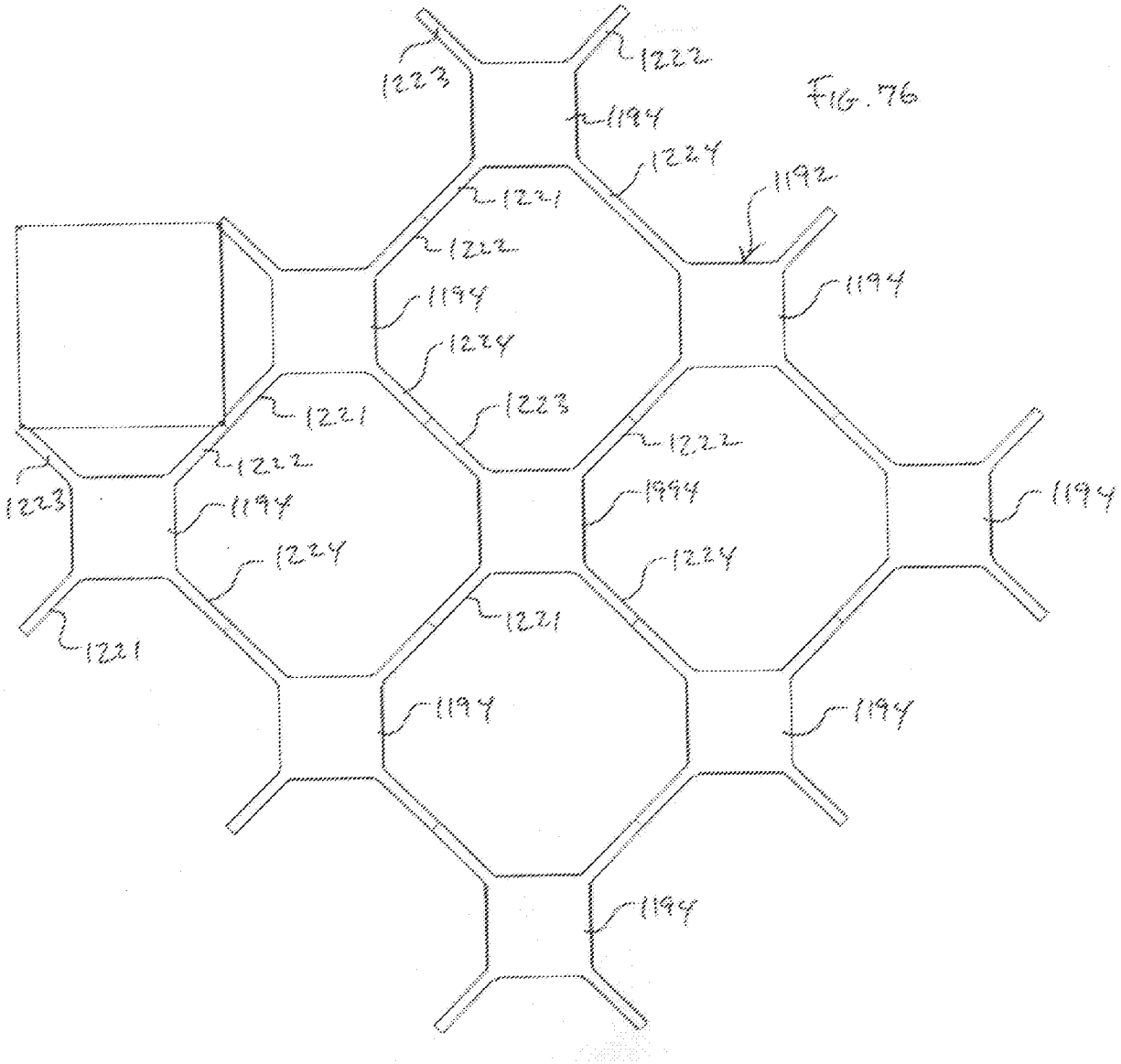
FIG. 76 is a highly generalized top plan view of a plurality of isolator plate components of the seismic isolation access floor assembly of FIG. 71 shown as they would appeared coupled together forming a network of interconnected isolator plate components.

To complete the formation of isolator floor 1194 atop bearing floor 1191, the outer ends of arms 1221-1224 are coupled to the outer ends of adjacent isolator plate components 1194 to form a network of interconnected isolator plate components 1994 as seen in FIG. 76. In the present embodiment, the opposed outer ends of adjacent isolator plate components 1994 are set into generally U-shaped cap brackets 1241 as shown in FIG. 71 and FIG. and secured thereto with rivets, bolts, nut-and-bolt assemblies, welding, or the like. In this regard, cap brackets 1241 are utilized to secure the opposed ends of the arms of adjacent isolator plate components 1994, according to the principle of the invention. Cap brackets 1241 support upstanding supports 1242, onto which floor plates, such as floor plates 1236, are set and secured, in accordance with the principle of the invention.

The present invention is described above with reference to preferred embodiments. However, those skilled in the art will recognize that changes and modifications may be made in the described embodiments without departing from the nature and scope of the present invention. For instance, in the various embodiments in which the dampers are disclosed as each consisting of a piston or cylinder such as a hydraulic cylinder or a pneumatic cylinder or the like, it is to be understood that other forms of dampers can be used, if desired, such as wire and/or rope dampers, spring dampers, or other suitable damper forms, and that the dampers can be located on the perimeter of the isolator floor or elsewhere, such as between isolator plates or other components of the isolator floor constructed and arranged in accordance with the principle of the invention.

Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. Apparatus, comprising:

a base floor;

an isolator plate overlying the base floor;

a ball disposed between and concurrently directly contacting the base floor and the isolator plate;

a retainer mounted to the base floor underlying the isolator plate retaining the ball relative to the base floor;

the retainer comprises a body having an opening formed therein, and the ball located at the opening retaining the ball relative to the base floor and locating the ball relative to the isolator plate; and wherein the retainer is constructed of compliant material providing damping between the ball and the retainer.

2. Apparatus according to claim 1, further comprising a floor plate coupled to the isolator plate and together forming an access floor disposed at an elevated location relative to the base floor.

3. Apparatus according to claim 1, further comprising a frame coupled to the isolator plate and capable of receiving and supporting a floor plate.

4. Apparatus according to claim 1, further comprising:

a frame coupled to the isolator plate; and a floor plate supported by the frame.

5. Apparatus according to claim 1, further comprising:

a concave cavity formed into the isolator plate; and the ball contacting the concave cavity formed into the isolator plate.

* * * * *